US010895818B2

(12) United States Patent
Otsubo et al.

(10) Patent No.: US 10,895,818 B2
(45) Date of Patent: Jan. 19, 2021

(54) IMAGE FORMING APPARATUS INCLUDING A MOVING UNIT FOR AN OPTICAL PRINT HEAD

(71) Applicant: CANON KABUSHIKI KAISHA, Tokyo (JP)

(72) Inventors: Yoshitaka Otsubo, Tokyo (JP); Yasuaki Otoguro, Abiko (JP); Yuta Okada, Moriya (JP); Daisuke Aruga, Abiko (JP); Hitoshi Iwai, Abiko (JP); Shinichiro Hosoi, Tokyo (JP); Yuichiro Imai, Tokyo (JP); Toshiki Momoka, Tokyo (JP); Saimon Gokyu, Tokyo (JP); Takehiro Ishidate, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/713,852

(22) Filed: Dec. 13, 2019

(65) Prior Publication Data

US 2020/0117114 A1 Apr. 16, 2020

Related U.S. Application Data

(63) Continuation of application No. PCT/JP2018/023716, filed on Jun. 15, 2018.

(30) Foreign Application Priority Data

Jun. 16, 2017 (JP) ..... 2017-119001

(51) Int. Cl.
*G03G 15/04* (2006.01)

(52) U.S. Cl.
CPC ..... *G03G 15/04036* (2013.01)

(58) Field of Classification Search
USPC ..... 399/4
See application file for complete search history.

(56) References Cited

U.S. PATENT DOCUMENTS 8,427,519 B2 4/2013 Umezawa
8,879,950 B2 11/2014 Sato et al.
(Continued)

FOREIGN PATENT DOCUMENTS

JP H09-152758 A 6/1997
JP 2005-014497 A 1/2005
(Continued)

OTHER PUBLICATIONS

International Search Report issued in corresponding parent International Application No. PCT/JP2018/023716 dated Aug. 28, 2018.

*Primary Examiner* — Quana Grainger
(74) *Attorney, Agent, or Firm* — Venable LLP

(57) ABSTRACT

An image forming apparatus includes a third link portion which is rotatably connected to said first link portion at a position between said first connecting portion and said first moving portion so that said first moving portion and said second moving portion are moved toward said drum unit by rotation of said first link portion about said first connecting portion as a rotation shaft and by rotation of said second link portion about said second connecting portion as a rotation shaft in interrelation with slide of said slidable portion, and which is rotatable relative to the apparatus main assembly. The third link portion is out of contact with the optical print head at a portion corresponding to an end portion on the optical print head side.

20 Claims, 24 Drawing Sheets

(56) References Cited

U.S. PATENT DOCUMENTS

| | | | | |
|---|---|---|---|---|
| 9,471,030 | B2 | 10/2016 | Sato et al. | |
| 2012/0128387 | A1 | 5/2012 | Kim et al. | |
| 2013/0164027 | A1* | 6/2013 | Sato | G03G 21/1666 399/110 |
| 2013/0259516 | A1 | 10/2013 | Ikeda et al. | |
| 2018/0364609 | A1* | 12/2018 | Ishidate | G03G 15/04054 |

FOREIGN PATENT DOCUMENTS

| | | | |
|---|---|---|---|
| JP | 2011-070143 | A | 4/2011 |
| JP | 2013-134370 | A | 7/2013 |
| JP | 2013-228665 | A | 11/2013 |

* cited by examiner

REAR TOWARD FRONT ON DRAWING SHEET : FRONT
FRONT TOWARD REAR ON DRAWING SHEET : REAR (a)

(b)

(a)

(b)

(a)

(b)

(a)

(b)

(c)

(d)

(a)

(b)

(a)

(b)

(a)

(b)

(a)

(b)

IMAGE FORMING APPARATUS INCLUDING A MOVING UNIT FOR AN OPTICAL PRINT HEAD

TECHNICAL FIELD

The present invention relates to an optical print head, an image forming apparatus including a moving mechanism for contacting and urging an optical print head from a position retracted from an exchange unit including a photosensitive drum toward the exchange unit by moving the optical print head.

BACKGROUND ART

An image forming apparatus, such as a printer and a copying machine, includes an optical print head provided with a plurality of light emitting elements for exposing a photosensitive drum to light. There are optical print heads that use, for example, an LED (light emitting diode) or an organic EL (electro-luminescence) device as a light emitting element (device). A plurality of the light emitting elements may be arranged along a rotational axis direction of the photosensitive drum in a row (line) or in two rows (lines) with a staggered pattern. Further, the optical print head may include a plurality of lenses for concentrating light beams, emitted from the plurality of light emitting elements, onto the photosensitive drum. The plurality of lenses are disposed opposed to the surface of the photosensitive drum so as to extend along an arrangement direction of the light emitting elements between the light emitting elements and the photosensitive drum. The light beams emitted from the plurality of light emitting elements are concentrated on the surface of the photosensitive drum through the lenses. As a result, an electrostatic latent image is formed on the surface of the photosensitive drum.

The photosensitive drum is one of consumables, and therefore is exchanged periodically. An operator such as a user or maintenance person can perform maintenance of the image forming apparatus by exchanging the exchange unit including a photosensitive drum. The exchange unit is constituted so as to be mountable in and dismountable from an image forming apparatus main assembly by being extracted from and inserted into the image forming apparatus main assembly. At an exposure position (position close to an opposing a drum surface) which is a position of the optical print head when the optical print head exposes the photosensitive drum to light, an interval between the lenses and the photosensitive drum surface is very narrow. Therefore, during exchange of the exchange unit, there is a possibility that the optical print head and the photosensitive drum or the like contact each other and the photosensitive drum surface and the lenses are damaged if the optical print head is retracted from the exposure position. Therefore, there is a need that the image forming apparatus is provided with a mechanism for reciprocating the optical print head between the exposure position and a retracted position where the optical print head is retracted from the exchange unit than the exposure position is.

In Japanese Laid-Open Patent Application (JP-A) 2013-134370, a mechanism for moving the optical print head between the exposure position and the retracted position is disclosed. As shown in FIG. 2 of JP-A 2013-134370, an LED unit 12 includes an LED array 50, a first frame 51 for supporting the LED array 50, and a moving mechanism 60 for moving the LED array 50 between the exposure position and the retracted position. The LED array 50 is supported by the first frame 51. Further, the first frame 51 is provided with two positioning rollers 53 opposing a photosensitive drum 15 on both (opposite) end sides with respect to a longitudinal direction thereof. On each of the both end sides of the first frame 51 with respect to the longitudinal direction, one end of a compression spring 54 is mounted on an opposite side from a side where the photosensitive drum 15 is disposed. The other ends of the respective compression springs 54 are mounted on both end sides, with respect to a longitudinal direction, respectively of a holding member 63 provided on an opposite side from the side where the photosensitive drum 15 is disposed. That is, the first frame 51 is supported by the holding member 63 through the compression springs 54. The first frame 51 is movable in a direction in which the first frame 51 reciprocates between the exposure position and the retracted position.

The moving mechanism 60 is disposed on an opposite side with respect to the LED array 50 from the side where the photosensitive drum 15 is disposed, and includes a holding member 63, a slidable member 61 sliding (moving) in a rotational axis direction of the photosensitive drum 15, and a movable member 62. The movable member 62 includes a front side movable member 62F and a rear side movable member 62R. Each of the front side movable member and the rear side movable member is provided with a first link portion 85 and a second link portion 89 as shown in FIG. 2 of JP-A 2013-134370.

In the following, the front side movable member 62 will be described. As described above, the first link portion 85 and the second link portion 89 are connected so as to be rotatable relative to each other about a shaft portion 95 as a rotation center, and form a pantograph mechanism. At one end side of the first link portion 85 with respect to the longitudinal direction, the first link portion 85 is rotatable connected to the slidable member 61 and moves in a front-rear direction while rotating in a main assembly side guiding portion 99 fixed to a main assembly, with a slide (movement) of the slidable member 61. At the other end side of the first link portion 85 with respect to the longitudinal direction, the first link portion 85 is rotatably connected in an engaging hole 106 provided in the holding member 63. At one end side of the second link portion 89 with respect to the longitudinal direction, the second link portion 89 is rotatably connected to a main assembly side engaging portion 100 fixed to the main assembly. At the other end side of the second link portion 89 with respect to the longitudinal direction, the second link portion 89 is connected rotatably in a guiding hole 105 provided in the holding member 63 and movably in the front-rear direction. Incidentally, also as regards the rear side movable member 62R, a similar constitution is employed.

By the above-described constitution, when the slidable member 61 slides (moves), the holding member 63 reciprocates between the exposure position and the retracted position. Further, with the movement of the holding member 63, the first frame 51 and the LED array 50 also move in a direction in which the first frame 51 and the LED array 50 reciprocate between the exposure position and the retracted position. When the first frame moves from the retracted position to the exposure position, the positioning roller 53 contacts the photosensitive drum 13, and the compression spring 54 is compressed. By a restoring force of the compressed compression spring 54, the positioning roller 53 toward the photosensitive drum 15 is urged, so that a gap is formed between the photosensitive drum 15 and the LED array 50 and thus the LED array 50 is in the exposure position.

SUMMARY OF THE INVENTION

Problem to be Solved by the Invention

However, in order to provide the moving mechanism with a simple structure, when a moving mechanism as a comparison example as shown in FIG. 24 is constituted without using a holding member described in JP-A 2013-134370, the following problem arises. FIG. 24 shows a link mechanism in which a link member 281 and a link member 283 cross each other in an X-character shape. The link member 281 corresponds to the second link portion 89 in JP-A 2013-134370, and the link member 283 corresponds to the first link portion 85 in JP-A 2013-134370. A projection 210 which is a connecting portion between the link member 281 and a holding member 205 contacts a coil spring 147 in a spring mounting portion 261 formed on the holding member 205 and is rotatably connected to the holding member 205. A projection 211 which is a connecting portion between the link member 283 and the holding member 205 is movable in a front-rear direction in a state in which movement in an up-down direction relative to the holding member 205 is restricted and is rotatably connected to the holding member 205.

In order that an urging force for urging the holding member 205 toward a drum unit 518 is imparted to the holding member 205 in a moving mechanism 240 in FIG. 24, it is desirable that a structure in which the holding member 205 contacts the drum unit 518 and thereafter the projection 210 further moves toward a drum unit 518 side and by this movement of the projection 210, the coil spring 147 is deformed and thus the urging force for urging the holding member 205 toward the drum unit 518 is imparted to the holding member 205 is formed. However, in this moving mechanism, the projection 211 engages in an opening 257 and an opening 258 which are provided in the holding member 505, so that the projection 211 cannot more in a movement direction of the holding member 205 relative to the holding member 205. For that reason, engagement of the projection 211 with the holding member 205 constitutes an obstruction to movement of the projection 210 toward the drum unit 518 side, so that the projection 210 cannot deform the coil spring 147. For that reason, the moving mechanism 240 shown in FIG. 24 cannot sufficiently impart the urging force to the holding member 205.

Means for Solving the Problem

In order to solve the above-described problem, an image forming apparatus of the present invention comprises: a drum unit including a photosensitive drum rotatable relative to an apparatus main assembly; an optical print head for exposing the photosensitive drum to light; and a moving unit for urging the optical print head toward the drum unit by moving the optical print head from a position retracted from the drum unit, toward the drum unit, wherein the moving unit comprises, a slidable portion slidable relative to the apparatus main assembly in a rotational axis direction of the photosensitive drum, a first spring, provided at one end side of the optical print head with respect to the rotational axis direction, for imparting, to the optical print head, an urging force for urging the optical print head toward the drum unit, a second spring, provided at the other end side of the optical print head with respect to the rotational axis direction, for imparting, to the optical print head, an urging force for urging the optical print head toward the drum unit, a first link portion which forms a first connecting portion by being rotatably connected to the slidable portion at one end side and on which a first moving portion, connected to the optical print head, for deforming the first spring in contact with the first spring is formed at the other end side, a second link portion which forms a second connecting portion by being rotatably connected to the slidable portion at one end side and on which a second moving portion, connected to the optical print head, for deforming the second spring in contact with the second spring is formed at the other end side, and a third link portion which is rotatably connected to the first link portion at a position between the first connecting portion and the first moving portion so that the first moving portion and the second moving portion are moved toward the drum unit by rotation of the first link portion about the first connecting portion as a rotation shaft and rotation of the second link portion about the second connecting portion as a rotation shaft in interrelation with slide of the slidable portion, and third link portion being rotatable relative to the apparatus main assembly, wherein the third link portion includes a portion which corresponds to an end portion on the optical print head side and which is out of contact with the optical print head.

Further, an image forming apparatus of the present invention comprises: a drum unit including a photosensitive drum rotatable relative to an apparatus main assembly; an optical print head for exposing the photosensitive drum to light; and a moving unit for urging the optical print head toward the drum unit by moving the optical print head from a position retracted from the drum unit, toward the drum unit, wherein the moving unit comprises, a slidable portion slidable relative to the apparatus main assembly in a rotational axis direction of the photosensitive drum, a first spring, provided at one end side of the optical print head with respect to the rotational axis direction, for imparting, to the optical print head, an urging force for urging the optical print head toward the drum unit, a second spring, provided at the other end side of the optical print head with respect to the rotational axis direction, for imparting, to the optical print head, an urging force for urging the optical print head toward the drum unit, a first link portion which forms a first connecting portion by being rotatably connected to the slidable portion at one end side and on which a first moving portion, connected to the optical print head, for deforming the first spring in contact with the first spring is formed at the other end side, a second link portion which forms a second connecting portion by being rotatably connected to the slidable portion at one end side and on which a second moving portion, connected to the optical print head, for deforming the second spring in contact with the second spring is formed at the other end side, and a third link portion which is rotatably connected to the first link portion at a position between the first connecting portion and the first moving portion so that the first moving portion and the second moving portion are moved toward the drum unit by rotation of the first link portion about the first connecting portion as a rotation shaft and by rotation of the second link portion about the second connecting portion as a rotation shaft in interrelation with slide of the slidable portion, and which is rotatable relative to the apparatus main assembly, wherein a length of the third link portion in a direction connecting a third connecting portion which is a connecting portion between the third link portion and the apparatus main assembly and a fourth connecting portion which is a connecting portion between the third link portion and the first link portion is shorter than a length of the first link portion in a direction connecting the first connecting portion and the first moving portion, and a portion, of the third link portion which is rotatable, corresponding to an end portion on the optical print head side is positioned between the optical print head and the fourth connecting portion.

Further, an image forming apparatus of the present invention comprises: a drum unit including a photosensitive drum rotatable relative to an apparatus main assembly; an optical print head for exposing the photosensitive drum to light; and a moving unit for urging the optical print head toward the drum unit by moving the optical print head from a position retracted from the drum unit, toward the drum unit, wherein the moving unit comprises, a slidable portion slidable relative to the apparatus main assembly in a rotational axis direction of the photosensitive drum, a first spring, provided at one end side of the optical print head with respect to the rotational axis direction, for imparting, to the optical print head, an urging force for urging the optical print head toward the drum unit, a second spring, provided at the other end side of the optical print head with respect to the rotational axis direction, for imparting, to the optical print head, an urging force for urging the optical print head toward the drum unit, a first link portion which forms a first connecting portion by being rotatably connected to the slidable portion at one end side and on which a first moving portion, connected to the optical print head, for deforming the first spring in contact with the first spring is formed at the other end side, a second link portion which forms a second connecting portion by being rotatably connected to the slidable portion at one end side and on which a second moving portion, connected to the optical print head, for deforming the second spring in contact with the second spring is formed at the other end side, and a third link portion which is rotatably connected to the first link portion at a position between the first connecting portion and the first moving portion so that the first moving portion and the second moving portion are moved toward the drum unit by rotation of the first link portion about the first connecting portion as a rotation shaft and by rotation of the second link portion about the second connecting portion as a rotation shaft in interrelation with slide of the slidable portion, and the third portion being rotatable relative to the apparatus main assembly; and an elastic member provided at a portion corresponding to an end portion of the third link portion, which is rotatable, on the optical print head side and elastically deformable by being sandwiched by the optical print head and the third link portion in a state in which the urging forces are imparted to the optical print head.

Further, an image forming apparatus of the present invention comprises: a drum unit including a photosensitive drum rotatable relative to an apparatus main assembly; an optical print head for exposing the photosensitive drum to light; and a moving unit for urging the optical print head toward the drum unit by moving the optical print head from a position retracted from the drum unit, toward the drum unit, wherein the moving unit comprises, a slidable portion slidable relative to the apparatus main assembly in a rotational axis direction of the photosensitive drum, a first spring, provided at one end side of the optical print head with respect to the rotational axis direction, for imparting, to the optical print head, an urging force for urging the optical print head toward the drum unit, a second spring, provided at the other end side of the optical print head with respect to the rotational axis direction, for imparting, to the optical print head, an urging force for urging the optical print head toward the drum unit, a first link portion which forms a first connecting portion by being rotatably connected to the slidable portion at one end side and on which a first moving portion, connected to the optical print head, for deforming the first spring in contact with the first spring is formed at the other end side, a second link portion which forms a second connecting portion by being rotatably connected to the slidable portion at one end side and on which a second moving portion, connected to the optical print head, for deforming the second spring in contact with the second spring is formed at the other end side, and a third link portion which is rotatably connected to the first link portion at a position between the first connecting portion and the first moving portion so that the first moving portion and the second moving portion are moved toward the drum unit by rotation of the first link portion about the first connecting portion as a rotation shaft and by rotation of the second link portion about the second connecting portion as a rotation shaft in interrelation with slide of the slidable portion, and the third portion being rotatable relative to an image forming apparatus main assembly; and an elastic member which is provided on an opposite side from a side where the drum unit is disposed on the one end side of the optical print head with respect to the rotational axis direction and which is elastically deformable by being sandwiched by the optical print head and a portion corresponding to an end portion of the third link portion on the optical print head side in a state in which the urging forces are imparted to the optical print head.

Effect of the Invention

According to the present invention, prevention of rotation (movement) of the third link portion is suppressed, and the first spring and the second spring can be deformed by the first link portion and the second link portion, respectively, and therefore, an urging force in a direction toward an exchange unit can be imparted to the holding member.

EMBODIMENTS FOR CARRYING OUT THE INVENTION

Embodiment 1

(Image Forming Apparatus)

Figure 1:
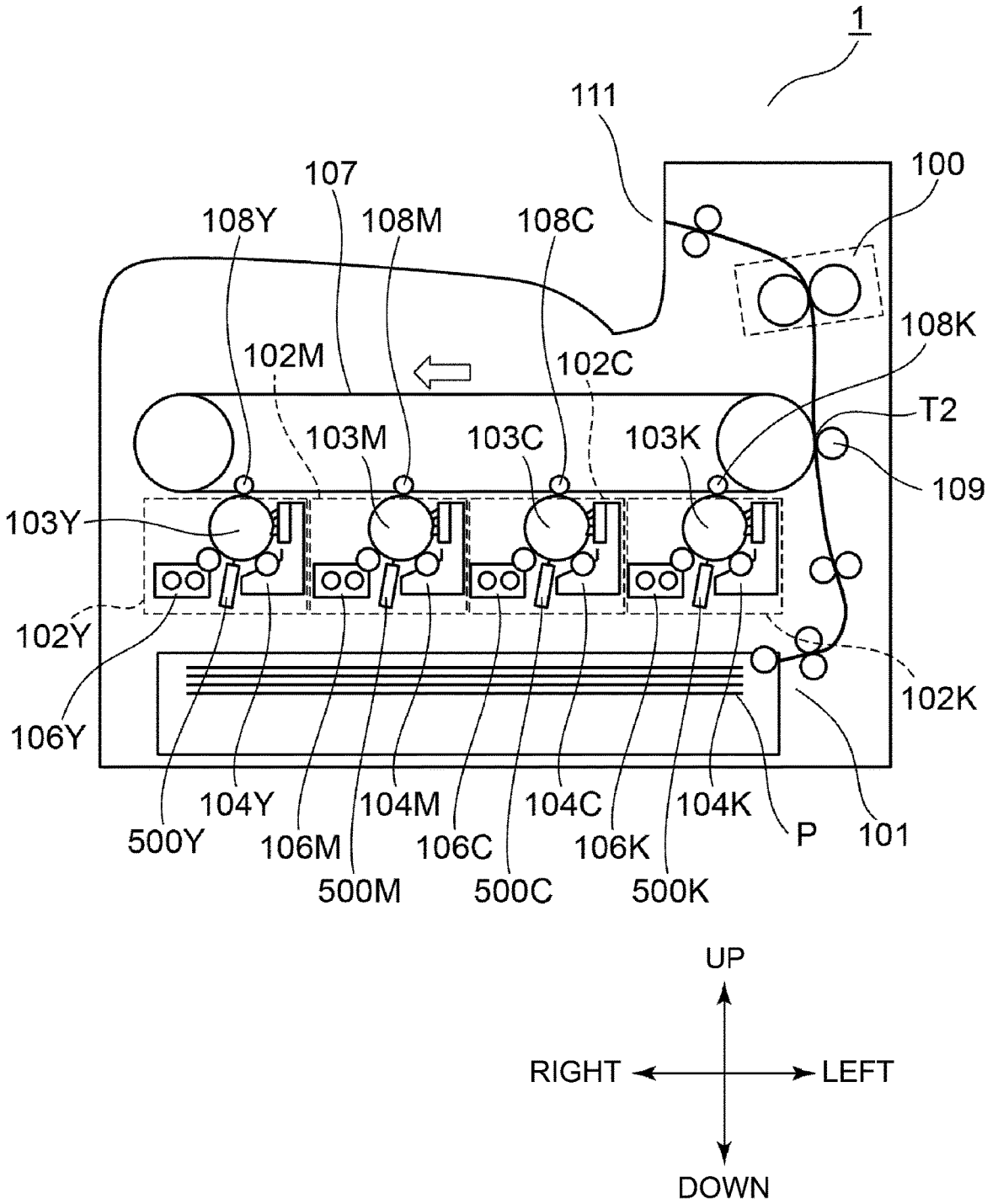
FIG. 1 is a schematic sectional view of an image forming apparatus.

First, a schematic structure of an image forming apparatus 1 will be described. FIG. 1 is a schematic sectional view of the image forming apparatus 1. The image forming apparatus 1 shown in FIG. 1 is a color printer (SFP: small function printer) including no reading device but may also be a copying machine including a reading device. Further, the embodiment is not limited to a color image forming apparatus including a plurality of photosensitive drums 103. The embodiment may also be a color image forming apparatus including a single photosensitive drum 103 or an image forming apparatus for forming a monochromatic image.

The image forming apparatus 1 shown in FIG. 1 includes four image forming portions 102Y, 102M, 102C and 102K (hereinafter collectively referred simply to as also an "image forming portion 102") for forming toner images of yellow, magenta, cyan and black. The image forming portions 102Y, 102M, 102C and 102K include photosensitive drum 103Y, 103M, 103C and 103K (hereinafter collectively referred simply to as also a "photosensitive drum 103"). Further, the image forming portions 102Y, 102M, 102C and 102K include charging devices 104Y, 104M, 104C and 104K (hereinafter collectively referred simply to as also a "charging device 104") for electrically charging the photosensitive drums 103Y, 103M, 103C and 103K. The image forming portions 102Y, 102M, 102C and 102K further include LED (light emitting diode, hereinafter described as LED) exposure units 500Y, 500M, 500C and 500K (hereinafter collectively referred simply to as also a "exposure unit 500") as light sources for emitting light (beams) to which the photosensitive drums 103Y, 103M, 103C and 103K are exposed. Further, the image forming portions 102Y, 102M, 102C and 102K include developing devices 106Y, 106M, 106C and 106K (hereinafter collectively referred simply to as also a "developing device 106") each for developing an electrostatic latent image on the photosensitive drum 103 with toner into a toner image of an associated color on the photosensitive drum 103. Y, M, C and K added to symbols represent colors of the toners.

The image forming apparatus 1 includes an intermediary transfer belt 7 onto which the toner images formed on the photosensitive drums 103 are to be transferred and primary transfer rollers 108 (Y, M, C, K) for successively transferring the toner images, formed on the photosensitive drums 103 of the respective image forming portions 102, onto the intermediary transfer belt 107. The image forming apparatus 1 further includes a secondary transfer roller 109 for transferring the toner images from the intermediary transfer belt 107 onto recording paper P fed from a sheet (paper) feeding portion 101 and includes a fixing device 100 for fixing the secondary-transferred toner images on the recording paper P.

(Drum Unit)

Figure 2:
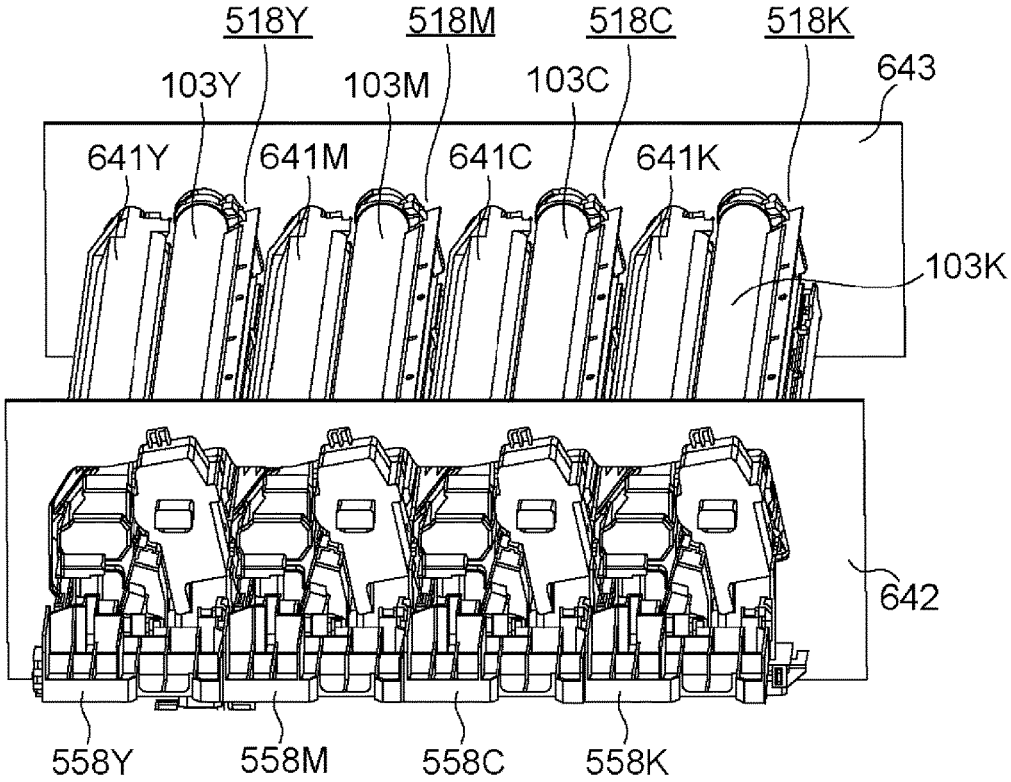
FIG. 2 includes perspective views showing a drum unit and a periphery thereof in the image forming apparatus.
Figure 2:
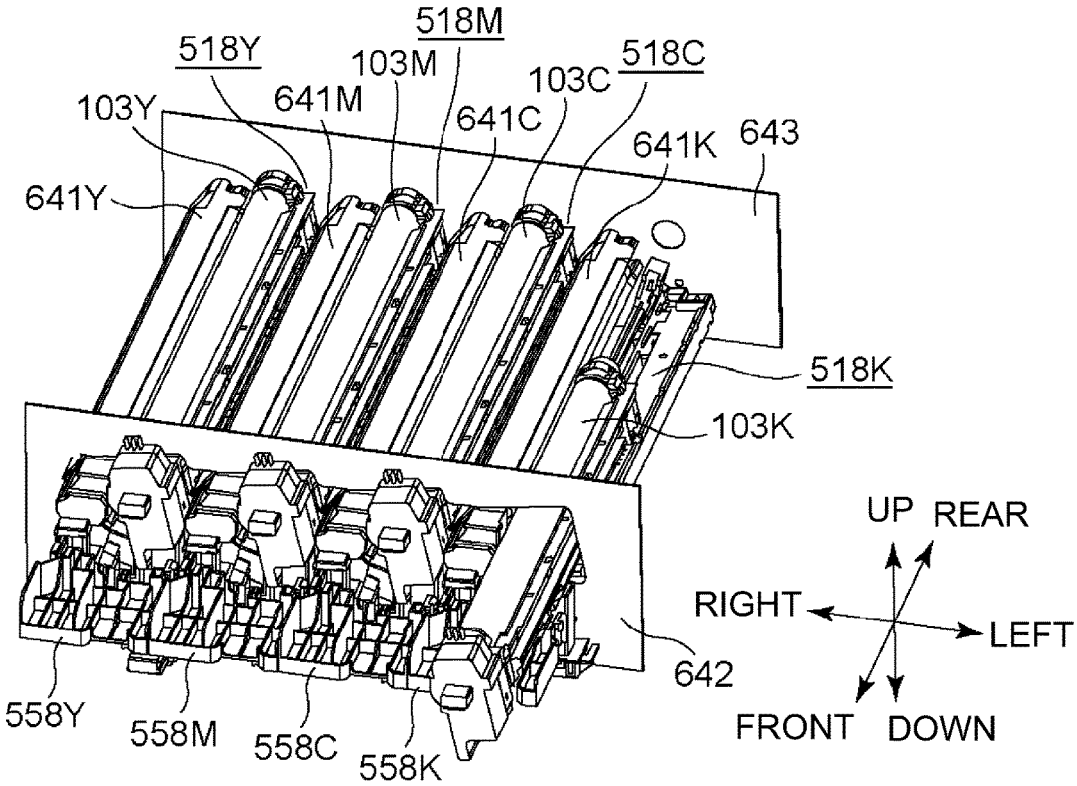

Then, drum units 518 (Y, M, C, K) and developing units 641 (Y, M, C, K) which are an example of an exchange unit mountable in and dismountable from the image forming apparatus 1 according to this embodiment will be described. Part (a) of FIG. 2 is a schematic perspective view of a periphery of the drum units 518 and the developing units 641. Part (b) of FIG. 2 is a view showing a state in which the drum unit 518 is being inserted from an outside of the apparatus main assembly into the image forming apparatus 1.

As shown in part (a) of FIG. 2, the image forming apparatus 1 includes a front side plate 642 and a rear side plate 643 which are formed with a metal plate. The front side plate 642 is a side wall provided on a front (surface) side of the image forming apparatus 1. On the other hand, the rear side plate 643 is a side wall provided on a rear (surface) side of the image forming apparatus 1. As shown in part (a) of FIG. 2, the front side plate 642 and the rear side plate 643 are disposed opposed to each other, and an unshown metal plate as a beam is bridged between these plates. Each of the front side plate 642, the rear side plate 643 and the unshown beam constitutes a part of a frame of the image forming apparatus 1.

The front side plate 642 is provided with an opening through which the drum unit 518 and the developing unit 641 can be inserted and extracted. The drum unit 518 and the developing unit 641 are mounted at a predetermined position (mounting position) of the main assembly of the image forming apparatus 1 through the opening. Further, the image forming apparatus 1 includes covers 558 (Y, M, C, K) for covering a front side of the drum unit 518 and the developing unit 641 which are mounted in the mounting position. The cover 558 is fixed at one end thereof to the main assembly of the image forming apparatus 1 by a hinge, whereby the cover 518 is rotatable relative to the main assembly of the image forming apparatus 1. The operator, when performing maintenance, opens the cover 558 and takes the drum unit 518 or the developing unit 641 out of the image forming apparatus 1, and then inserts a new drum unit 518 or a new developing unit 641 into the image forming apparatus 1 and closes the cover 558, whereby an exchanging operation of the unit is completed. The cover 558 will be further specifically described later.

As shown in parts (a) and (b) of FIG. 2, in the following description, the front side plate 642 side and the rear side plate 643 side are defined as a front side and a rear side, respectively. Further, when a position of the photosensitive drum 103K on which the electrostatic latent image relating to the black toner image is formed is taken as a reference (position), a side where the photosensitive drum 103Y on which the electrostatic latent image relating to the yellow toner image is formed is disposed is defined as a right side. Further, when a position of the photosensitive drum 103Y is taken as a reference (position), a side where the photosensitive drum 103K is disposed is defined as a left side. Further, with respect to a direction perpendicular to a front-rear direction and a left-right direction, an upward direction in a vertical direction is defined as an up direction and a downward direction in the vertical direction is defined as a down direction. The front direction, the rear direction, the right direction, the left direction, the up direction and the down direction defined above are shown in part (b) of FIG. 2. Further, in the following description, with respect to a rotational axis direction of the photosensitive drum 103, one end side means the front side and the other end side means the rear side. Further, one end side and the other end side with respect to the front-rear direction also correspond to the front side and the rear side, respectively. Further, with respect to the left-right direction, one end side means the right side defined herein and the other end side means the left side defined herein.

In the image forming apparatus 1 of this embodiment, the drum unit 518 is mounted. The drum unit 518 is a cartridge to be exchanged. The drum unit 518 of this embodiment includes the photosensitive drum 103 rotatably supported by the casing of the drum unit 518. The drum unit 518 includes the photosensitive drum 103, the charging device 104 and an unshown cleaning device. When the photosensitive drum 103 reaches an end of a lifetime thereof, for example, due to abrasion through cleaning by the cleaning device, the operator, when performing maintenance, takes the drum unit 518 out of the apparatus main assembly and exchanges the photosensitive drum 103 as shown in part (b) of FIG. 2. The drum unit 518 may also have a constitution in which the charging device 104 and the cleaning device are not provided and the photosensitive drum 103 is provided.

In the image forming apparatus 1 of this embodiment, the developing unit 641, which is a separate member from the drum unit 518, is mounted. The developing unit 641 includes the developing device 106 shown in FIG. 1. The developing device 106 includes a developing sleeve which is a developer carrying member for carrying the developer. The developing unit 641 is provided with a plurality of gears for rotating a screw for stirring toner and a carrier. When these gears are deteriorated because of ageing, the operator, when performing maintenance, takes the developing unit 641 out of the apparatus main assembly of the image forming apparatus 1. The developing unit 641 of this embodiment is a cartridge which is an integrally assembled unit of the developing device 106 including the developing sleeve and a toner accommodating portion provided with the screw. Incidentally, an embodiment of the drum unit 518 and the developing unit 641 may also be a process cartridge which is an integrally assembled unit of the above-described drum unit 518 and developing unit 641.

(Image Forming Process)

Next, an image forming process will be described. An optical print head 105Y described later exposes the surface of the photosensitive drum 103, charged by the charging device 104Y, to light. By this, an electrostatic latent image is formed on the photosensitive drum 103Y. Then, the developing device 106Y develops the electrostatic latent image, formed on the photosensitive drum 103Y, with yellow toner. A yellow toner image into which the electrostatic latent image is developed on the photosensitive drum 103Y is transferred onto the intermediary transfer belt 107 by the primary transfer roller 108Y at the primary transfer portion Ty. Magenta, cyan and black toner images are also transferred onto the intermediary transfer belt 107 by a similar image forming process.

The respective color toner images transferred on the intermediary transfer belt 107 are conveyed to a secondary transfer portion T2 by the intermediary transfer belt 107. T A transfer bias, for transferring the toner images onto the recording paper P, is applied to a secondary transfer roller 109 provided at the secondary transfer portion T2. The toner images conveyed to the secondary transfer portion T2 are transferred onto the recording paper P, fed from the sheet (paper) feeding portion 101, by the transfer bias applied to the secondary transfer roller 109. The recording paper P on which the toner images are transferred is conveyed to the fixing device 100. The fixing device 100 fixes the toner images on the recording paper P by heat and pressure. The recording paper P subjected to a fixing process by the fixing device 100 is discharged onto a sheet (paper) discharge portion 111.

(Exposure Unit)

Figure 3:
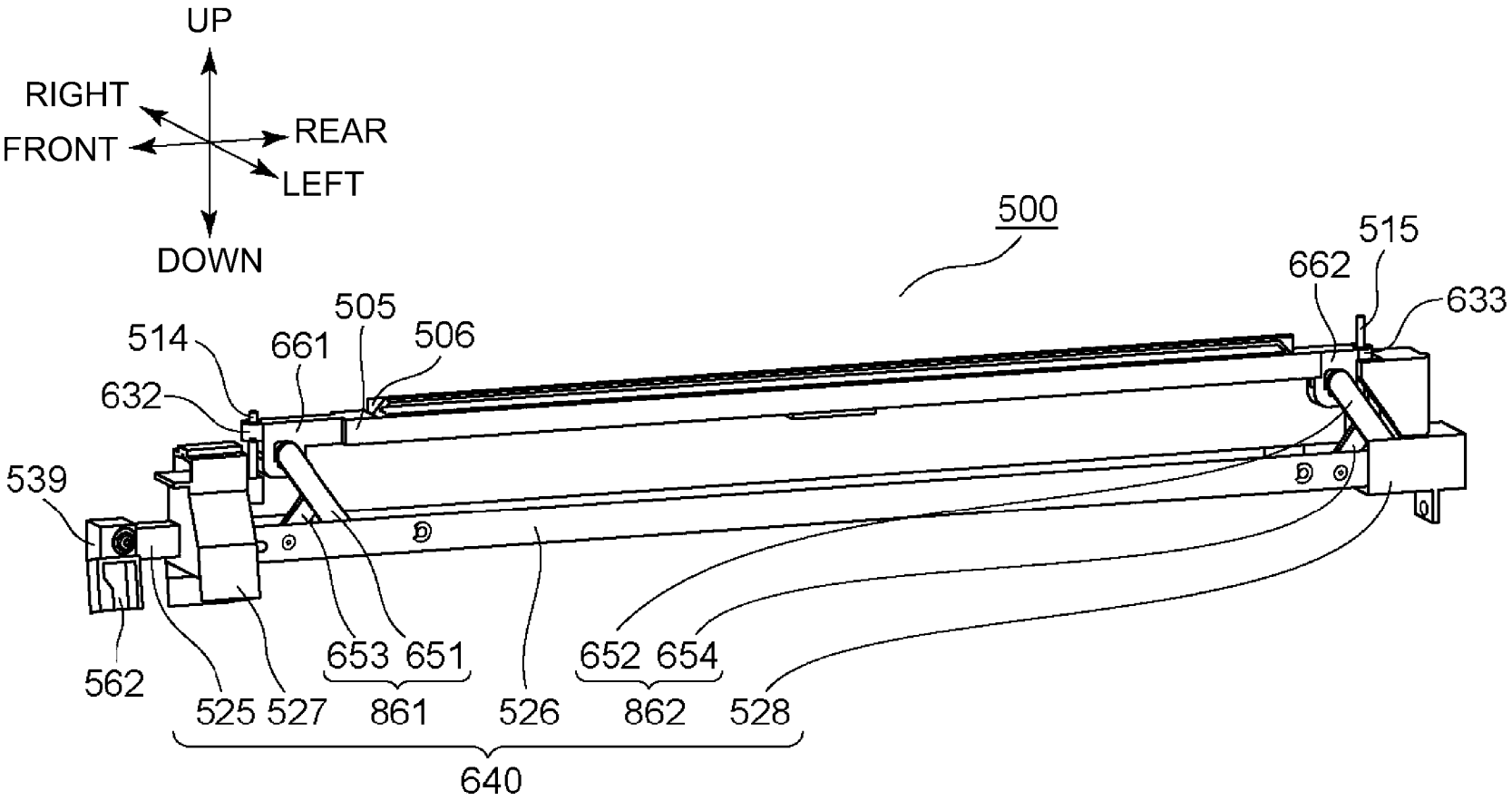
FIG. 3 is a schematic perspective view of an exposure unit.
Figure 4:
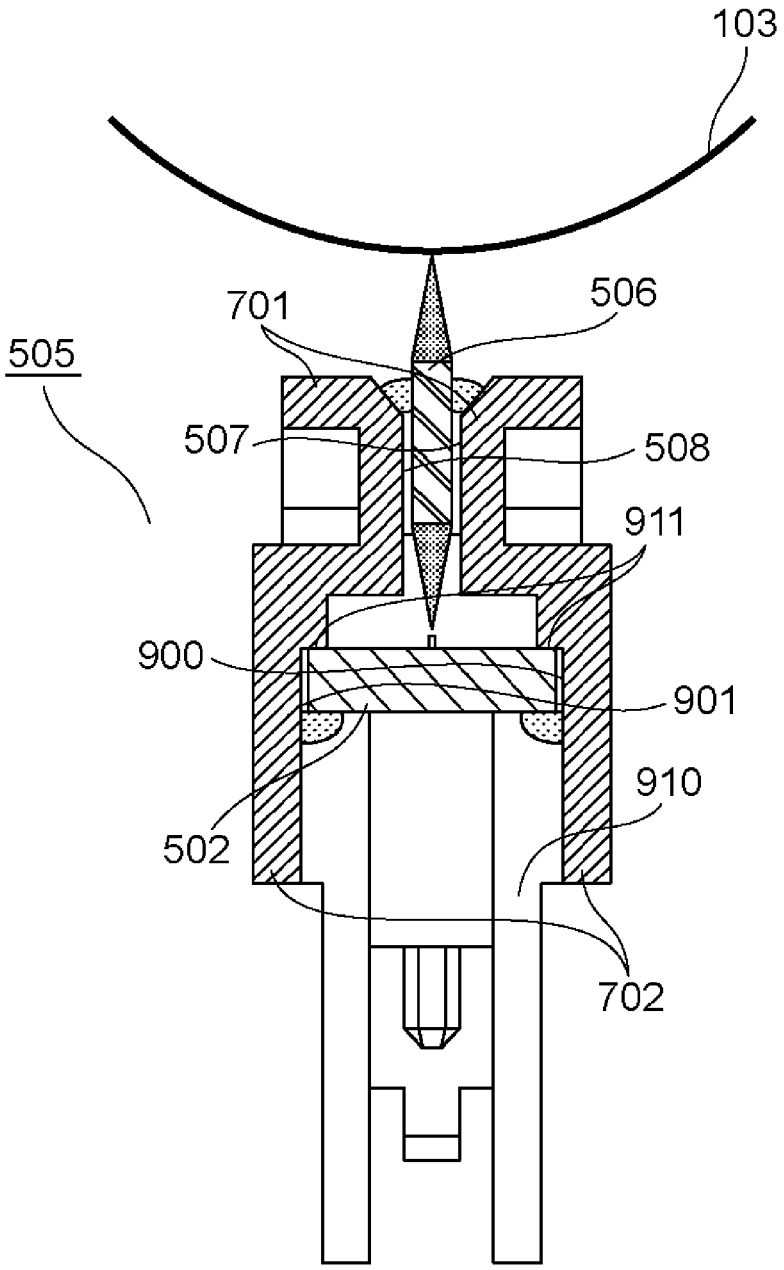
FIG. 4 is a sectional view of an optical print head with respect to a direction perpendicular to a rotational axis direction of a photosensitive drum.

Next, the exposure unit 500 including an optical print head 105 will be described. Here, as an example of an exposure type employed in an image forming apparatus of an electrophotographic type, there is a laser beam scanning exposure type in which the photosensitive drum is scanned with a beam emitted from a semiconductor laser by a rotating polygon mirror or the like and the photosensitive drum is exposed to the beam through of f-O lens or the like. The "optical print head 105" described in this embodiment is used in an LED exposure type in which the photosensitive drum 103 is exposed to light by using light emitting elements such as LEDs or the like arranged along the rotational axis direction of the photosensitive drum 103 and thus is not used in the laser beam scanning exposure type described above. FIG. 3 is a schematic perspective view of the exposure unit 500 provided in the image forming apparatus 1 of this embodiment. FIG. 4 includes schematic sectional views in which the exposure unit 500 shown in FIG. 3 and the photosensitive drum 103 in a plane perpendicular to the rotational axis direction of the photosensitive drum 103. The exposure unit 500 includes the optical print head 105 and a moving mechanism 640. The optical print head 105 includes a holding member 505 for holding a lens array 506 (lenses) and a substrate 502, a contact pin 514, and a contact pin 515. The moving mechanism 640 includes a first link mechanism 861, a second link mechanism 862, a slidable portion 525, a third supporting portion 526, a first supporting portion 527, and a second supporting portion 528. Here, in this embodiment, the contact pin 514 and the contact pin 515 are cylindrical pins, but a shape thereof is not limited to a cylinder and may also be shapes such as a prism and a cone having a diameter narrower toward an end portion thereof.

First, the holding member 505 will be described. The holding member 505 is a holder holding the substrate 502 described later, the lens array 506, the contact pin 514 and the contact pin 515. In this embodiment, as an example, a length of the contact pin 514 projecting from an upper surface of the holding member 505 is 7 mm, a length of the contact pin 515 projecting from the upper surface of the holding member 505 is 11 mm, a length of the contact pin 514 projecting from a lower surface of the holding member 505 is 22 mm, and a length of the contact pin 515 projecting from the lower surface of the holding member 505 is 22 mm. As shown in FIG. 4, the holding member 505 includes a lens mounting portion 701 where the lens array 506 is mounted and a substrate mounting portion 702 where the substrate 502 is mounted. Further, although described later specifically the holding member 505 includes a spring mounting portion 661 (662) and a pin mounting portion 632 (633). The holding member 505 in this embodiment is an integral mold the lens mounting portion 701, the substrate mounting portion 702, the spring mounting portion 661, the spring mounting portion 662, the pin mounting portion 632 and the pin mounting portion 633. The holding member 505 is the mold made of a resin through integral injection molding.

As shown in FIG. 3, the spring mounting portion 661 where the link member 651 is mounted is provided between the lens array 506 and the pin mounting portion 632 with respect to a front-rear direction. Further, the spring mounting portion 662 where the link member 652 is mounted is provided between the lens array 506 and the pin mounting portion 633 with respect to the front-rear direction. That is, when the optical print head 105 moves between the exposure position and the retracted position, the holding member 505 is supported by the link member 651 between the lens array 506 and the contact pin 514 in the front-rear direction, and is supported by the link member 652 between the lens array 506 and the contact pin 515 in the front-rear direction. Portions where an urging force is imparted to the holding member 505 by the link member 651 and the link member 652 do not overlap with the lens array 506 with respect to an up-down direction, and therefore, flexure of the lens array 506 by the urging force is reduced.

The lens mounting portion 701 includes a first inner wall surface 507 extending in a longitudinal direction of the holding member 505, and a second inner wall surface 508 which opposes the first inner wall surface 507 and which similarly extends in the longitudinal direction of the holding member 505. During assembling of the optical print head 105, the lens array 506 is inserted between the first inner wall surface 507 and the second inner wall surface 508. Then, an adhesive is applied between side surface of the lens array 506 and the lens mounting portion 701, whereby the lens array 506 is fixed to the holding member 505.

As shown in FIG. 4, the substrate mounting portion 702 has a substantially U-character-like shape in cross-section and includes a third inner wall surface 900 extending in the longitudinal direction of the holding member 505 and a fourth inner wall surface 901 which opposes the third inner wall surface 900 and which extends in the longitudinal direction of the holding member 505. A gap 910 for permitting insertion of the substrate 502 is formed between the third inner wall surface 900 and the fourth inner wall surface 901. Further, the substrate mounting portion 702 includes a substrate contact portion 911 to which the substrate 502 is contacted. During the assembling of the optical print head 105, the substrate 502 is inserted from the gap 910 and is pushed to the substrate contact portion 911. Then, in a state in which the substrate 502 contacts the substrate contact portion 911, the adhesive is applied onto boundary portions between the substrate 502 and the third inner wall surface 900 and between the substrate 502 and the fourth inner wall surface 901 on the gap 910 side, whereby the substrate 502 is fixed to the holding member 505.

The exposure unit 500 is provided on a side below a rotational axis of the photosensitive drum 103 with respect to a vertical direction, and LEDs 503 of the optical print head 105 expose the photosensitive drum 103 to light from below. Incidentally, the exposure unit 500 may also have a constitution in which the exposure unit 500 is provided on a side above the rotational axis of the photosensitive drum 103 with respect to the vertical direction, and the LEDs 503 of the optical print head 105 expose the photosensitive drum 103 to light from above.

Figure 5:
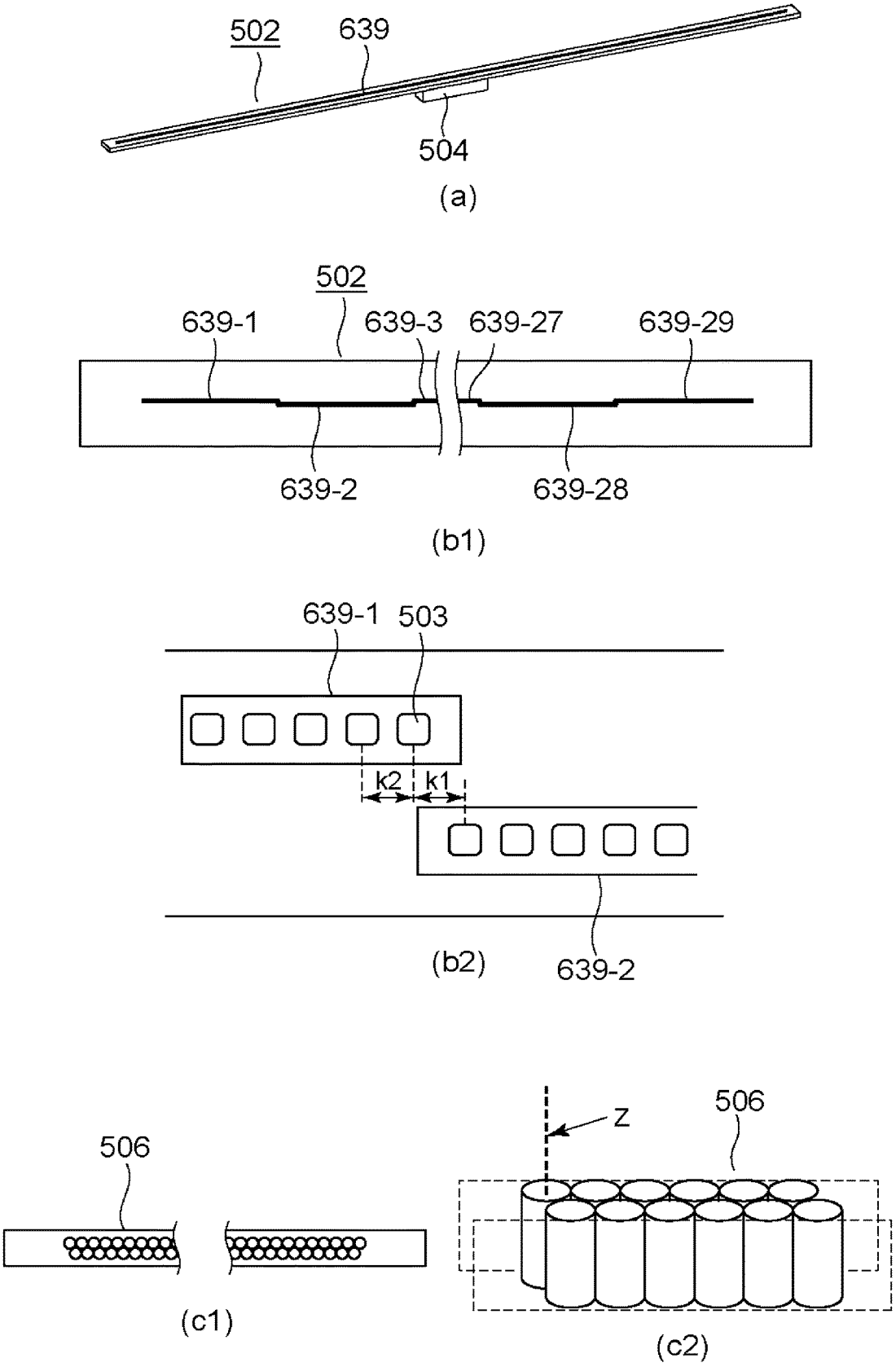
FIG. 5 includes schematic views for illustrating a substrate, an LED chip or a lens array of an optical print head.

Next, the substrate 502 held by the holding member 505 will be described. Part (a) of FIG. 5 is a schematic perspective view of the substrate 502. Part (b1) of FIG. 5 is a schematic view showing an arrangement of a plurality of LEDs 503 provided on the substrate 502, and Part (b2) of FIG. 5 is an enlarged view of part (b1) of FIG. 5.

On the substrate 502, LED chips 539 are mounted. As shown in part (a) of FIG. 5, on one surface of the substrate 502, the LED chips 639 are provided, and on the back surface side of the substrate 502, a connector 504 is provided. On the substrate 502, electrical wiring for supplying signals to the respective LED chips 639. To the connector 504, one end of an unshown flexible flat cable (FFC) is connected. In the image forming apparatus 1 main assembly, a substrate is provided. The substrate includes a controller and a connector. The other end of the FFC is connected to the connector. To the substrate 502, a control signal is inputted from the controller of the image forming apparatus 1 main assembly through the FFC and the connector 504. The LED chips 639 are driven by the control signal inputted to the substrate 502.

The LED chips 639 mounted on the substrate 502 will be described further specifically. As shown in parts (b1) and (b2) of FIG. 5, on one surface of the substrate 502, a plurality of LED chips 639-1 to 639-29 (29 LED chips) where a plurality of LEDs 503 are disposed. On each of the LED chips 639-1 to 639-29, 516 LEDs (light emitting elements) are arranged in a line along a longitudinal direction of the LED chips 639. With respect to the longitudinal direction of the LED chips 639, a center distance k2 between adjacent LEDs corresponds to resolution of the image forming apparatus 1. The resolution of the image forming apparatus 1 is 1200 dpi, and therefore, in the longitudinal direction of the LED chips 639-1 to 639-29, the LEDs arranged in a line so that the center distance of the LEDs is 21.16 μm. For that reason, an exposure range of the optical print head 105 in this embodiment is about 316 mm. A photosensitive layer on the photosensitive drum 103 is formed with a width of 316 mm or more. A long-side length of A4-size recording paper and a short-side length of A3-size recording paper are 297 mm, and therefore, the optical print head 105 in this embodiment has the exposure range in which the image can be formed on the A4-size recording paper and the A3-size recording paper.

The LED chips 639-1 to 639-29 are alternately disposed in two lines along the rotational axis direction of the photosensitive drum 103. That is, as shown in part (b1) of FIG. 5, odd-numbered LED chips 639-1, 639-3, . . . 639-29 counted from a left side are mounted on the substrate 502 in a line with respect to the longitudinal direction, and even-numbered LED chips 639-2, 639-4, . . . 639-28 counted from the left side are mounted on the substrate 502 in a line with respect to the longitudinal direction. By disposing the LED chips 639 in such a manner, as shown in part (b2) of FIG. 5, with respect to the longitudinal direction of the LED chips 639, a center distance k1 between one end of one (e.g., 639-1) of adjacent (different) LED chips 639 and the other end of the other one (e.g., 639-2) of the adjacent LED chips 639 can be made equal to the center distance k2 between the adjacent LEDs on one (e.g., 639-1) of LED chips 639.

Incidentally, in this embodiment, a constitution using the LEDs as an exposure light source is described as an example, but as the exposure light source, an organic EL (electro luminescence) device may also be used.

Next, a lens array 506 will be described. Part (c1) of FIG. 5 is a schematic view of the lens array 506 as seen from the photosensitive drum 103 side. Further, part (c2) of FIG. 5 is a schematic perspective view of the lens array 506. As shown in part (c1) of FIG. 5, a plurality of lenses are arranged in two lines along an arrangement direction of the plurality of LEDs 503. The respective lenses are alternately disposed so that with respect to an arrangement direction of the lenses arranged in one line, one of lenses arranged in the other line contacts both of adjacent lenses arranged in the arrangement direction of the lenses arranged in the above-described one line. Each of the lenses is a cylindrical rod lens made of glass. Incidentally, a material of the lens is not limited to glass but may also be plastics. Also a shape of the lens is not limited to the cylindrical shape but may also be a polygonal prism shape such as a hexagonal prism shape.

A broken line Z shown in part (c2) of FIG. 5 represents an optical axis of the lens. The optical print head 105 is moved by the above-described moving mechanism 640 in a direction along the optical axis of the lens indicated by the broken line Z. The optical axis of the lens referred to herein means a line connecting a center of a light emitting (emergent) surface of the lens and a focus of the lens. As shown in FIG. 4, emitted light emitted from the LED enters the lens included in the lens array 506. The light entering the lens is concentrated on the surface of the photosensitive drum 103. A mounting position of the lens array 506 relative to the lens mounting portion 701 during assembling of the optical print head 105 is adjusted so that a distance between a light emitting surface of the LED and a light incident surface of the lens and a distance between a light emitting surface of the lens and the surface of the photosensitive drum 103 are substantially equal to each other.

Figure 6:
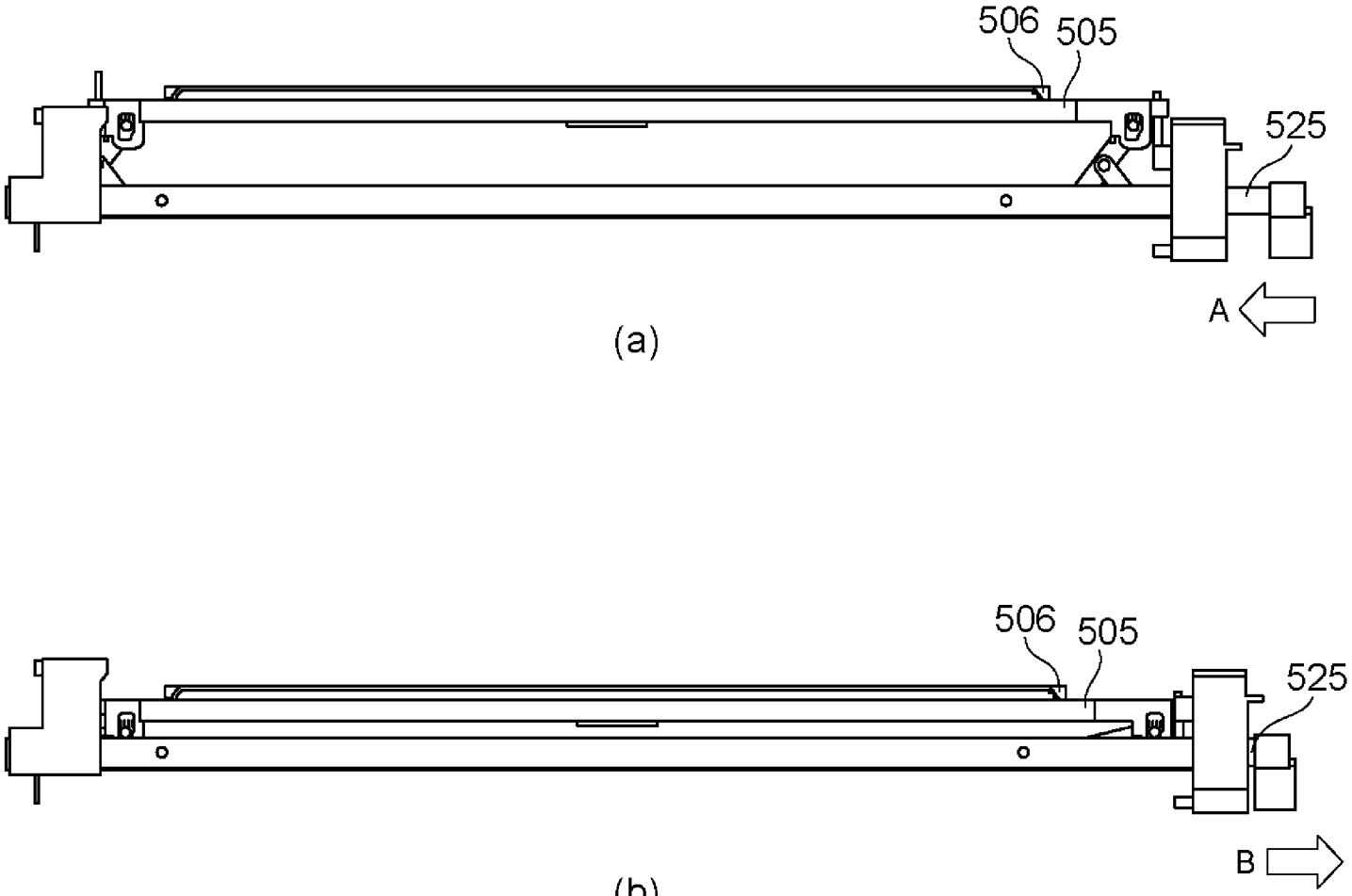
FIG. 6 includes side views of the optical print head.

Here, necessity of movement of the optical print head 105 will be described. The image forming apparatus 1 of this embodiment slides (moves) the drum unit 518 in the rotational axis direction of the photosensitive drum 103 toward the front side of the apparatus main assembly when the drum unit 518 is exchanged, as described with reference to FIG. 2. When the drum unit 518 is moved in a state in which the optical print head 105 is positioned in the neighborhood of the surface of the photosensitive drum 103, the optical print head 105 contacts the sliding (moving) photosensitive drum 103, so that the surface of the photosensitive drum 103 to be mounted is damaged. Further, the lens array 506 contacts the frame of the drum unit 518, so that the lens array 506 is damaged. For that reason, a structure in which the optical print head 105 is reciprocated between an exposure position (part (a) of FIG. 6) where the photosensitive drum 103 is exposed to light and a retracted position (part (b) of FIG. 6) where the photosensitive drum 103 is retracted from the exchange unit than the exposure position is. When the slidable portion 525 slides (moves) in an arrow A direction in a state in which the optical print head 105 is in the exposure position (part 8*a*) of FIG. 6), the optical print head 105 moves in a direction toward the retracted position (part (b) of FIG. 6). On the other hand, when the slidable portion 525 slides (moves) in an arrow B direction in a state in which the optical print head 105 is in the retracted position (part (b) of FIG. 6), the optical print head 105 moves in a direction toward the exposure position (part (a) of FIG. 6). Details will be described later.

Figure 7:
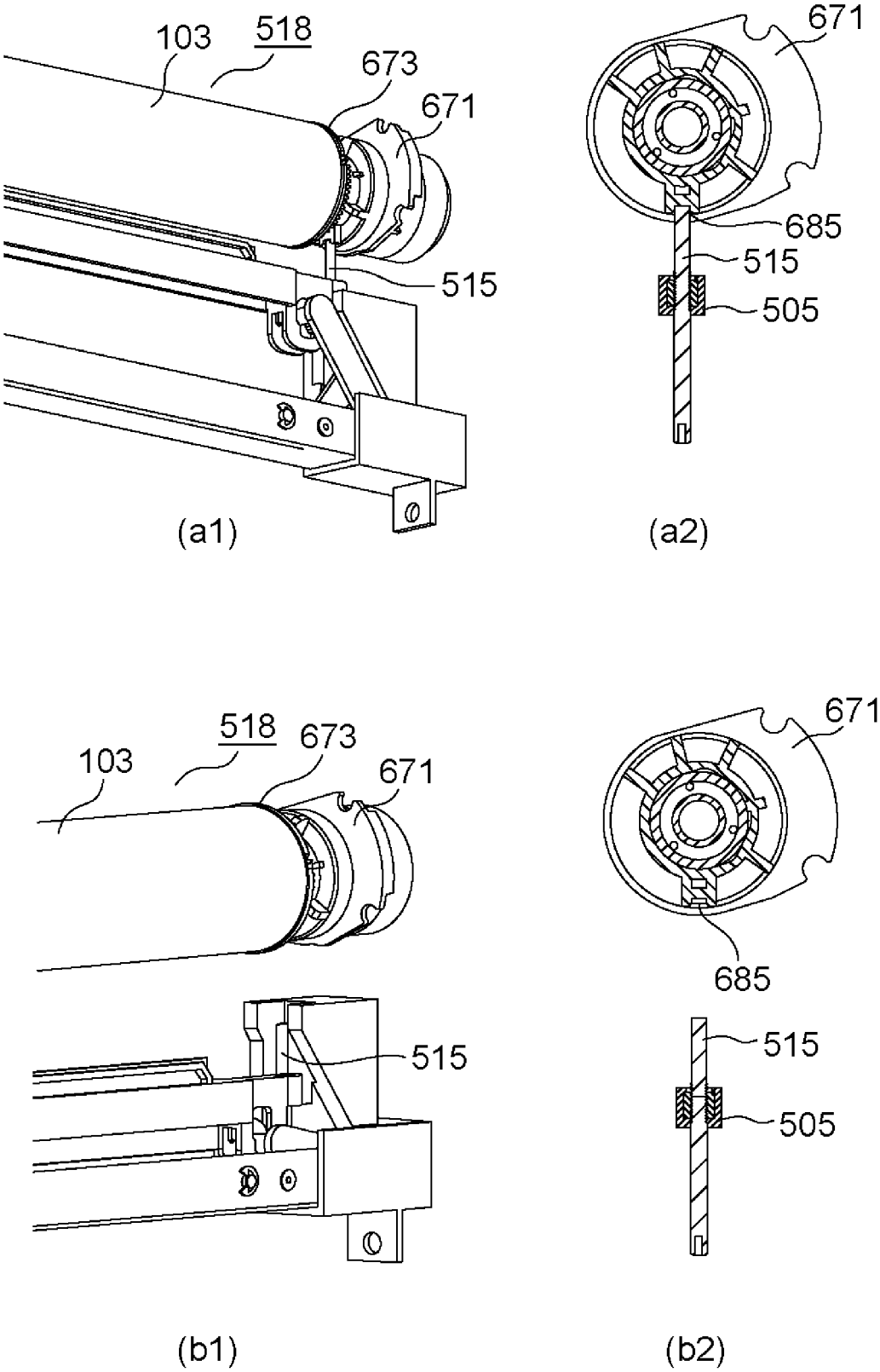
FIG. 7 includes views each showing a state in which the optical print head is contacted to or retracted from a drum unit.

Part (a1) of FIG. 7 is a perspective view showing the rear side of the optical print head 105 positioned at the exposure position and a bush 671 provided on the rear side of the drum unit 518. Part (a2) of FIG. 7 is a sectional view showing the rear side of the optical print head 105 positioned at the exposure position and the bush 671 provided on the rear side of the drum unit 518. Part (b1) of FIG. 7 is a perspective view showing the rear side of the optical print head 105 positioned at the retracted position and a bush 671 provided on the rear side of the drum unit 518. Part (b2) of FIG. 7 is a sectional view showing the rear side of the optical print head 105 positioned at the retracted position and the bush 671 provided on the rear side of the drum unit 518.

Using FIG. 7, a state in which the contact pin 515 provided on the rear side of the optical print head 105 contacts the bush 671 provided on the drum unit 518 side will be described. Also on the front side of the drum unit 518, a component part corresponding to the bush 671 to which the contact pin is contacted is provided, and a structure thereof is similar to a structure of the bush 671. Here, only a state in which the contact pin 515 openings the bush 671 provided on the drum unit 518 side will be described.

Figure 11:
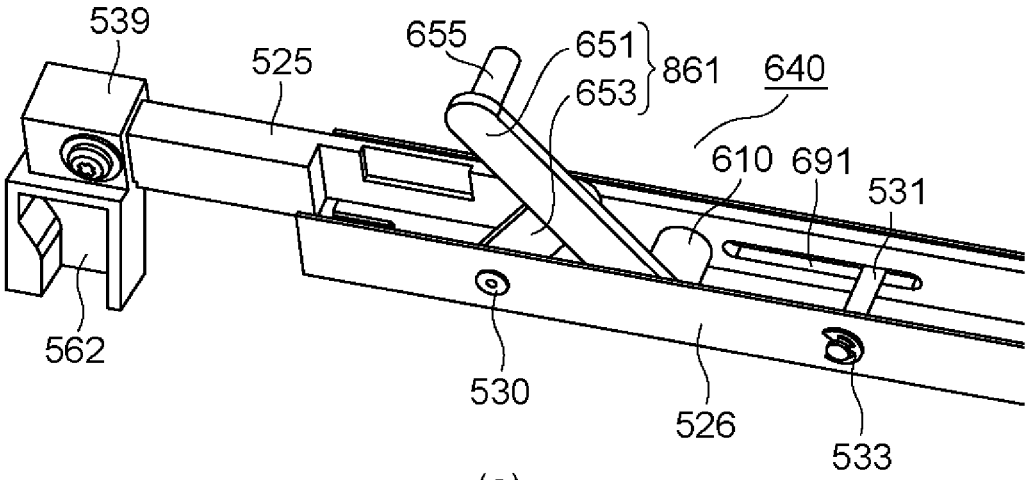
FIG. 11 includes perspective views of a moving mechanism for which the first supporting portion is not shown.
Figure 11:
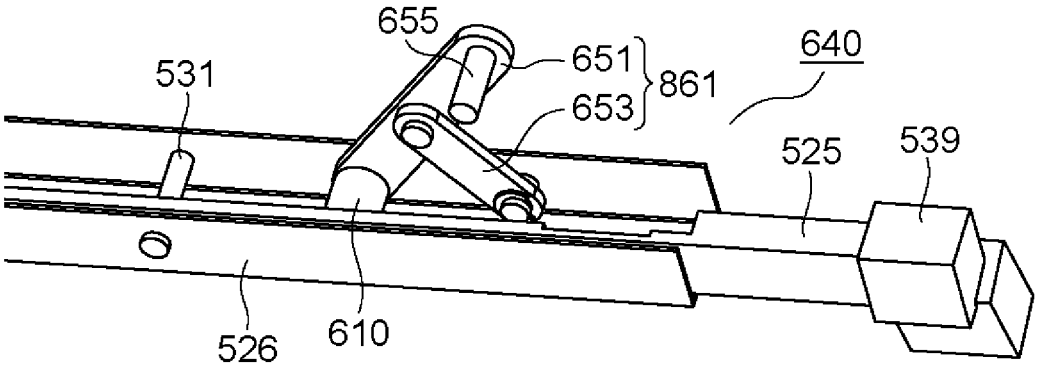

As shown in part (a1) of FIG. 7 and part (a2) of FIG. 11, positions where the opposing portion 515 contacts the bush 671 provided on the rear side of the drum unit 518 and where the contact pin 514 (not shown) contacts the component parts, corresponding to the bush 671, provided on the front side of the drum unit 518 are the exposure position of the optical print head 105. By contact of the contact pin 514 and the contact pin 515 with the bush 671 and the component part corresponding to the bush 671, respectively, a distance between the lens array 506 and the photosensitive drum 103 is a design nominal.

On the other hand, as shown in part (a1) of FIG. 7 and part (a2) of FIG. 7, a position where the contact pin 515 is retracted from the bush 671 provided on the rear side of the drum unit 518 corresponds to the retracted position of the optical print head 105. By positioning of the optical print head 105 in the retracted position shown in part (b1) of FIG. 7 and part (b2) of FIG. 7, the drum unit 518 sliding (moving) for exchange and the optical print head 105 are in an out-of-contact state.

Figure 8:
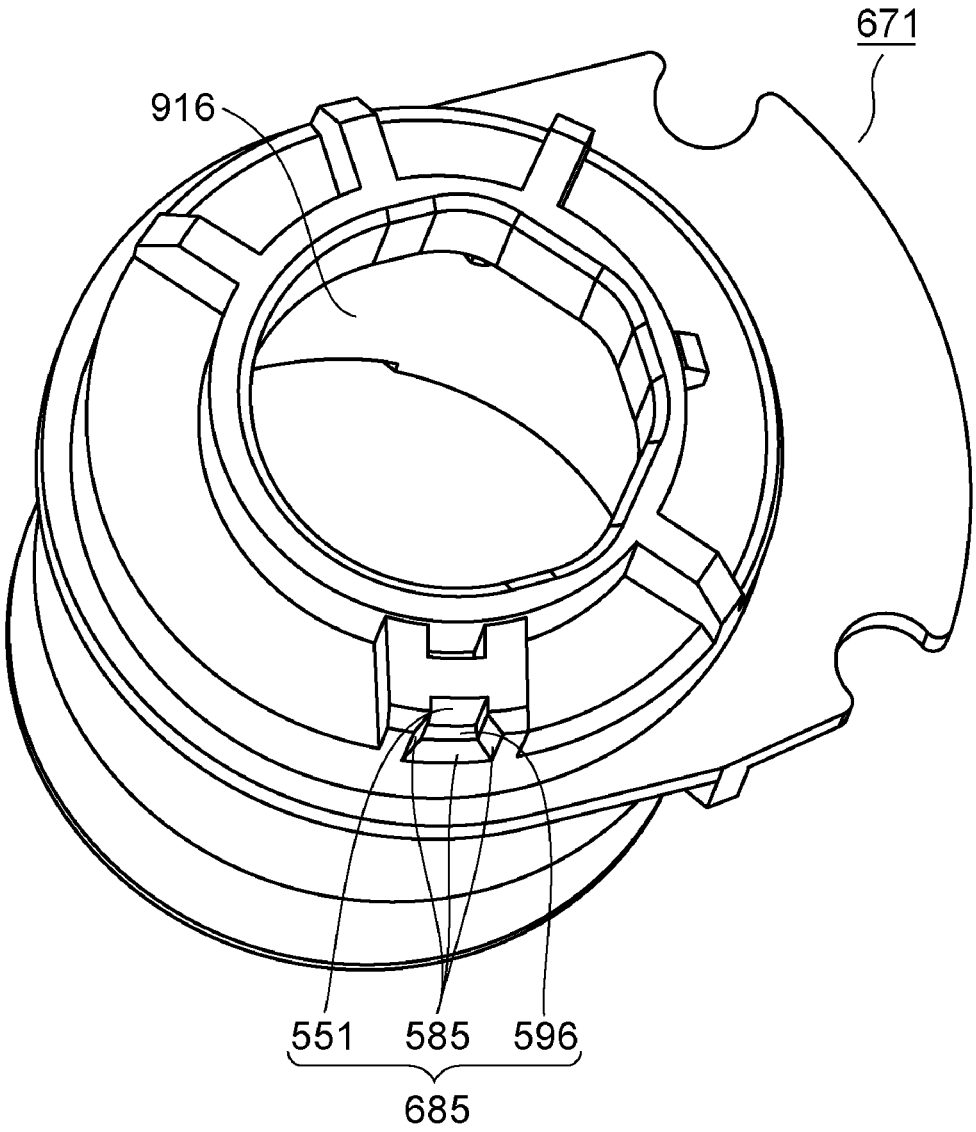
FIG. 8 is a perspective view of a bush mounted to the drum unit on a rear side.

Here, the bush 671 provided to the drum unit 518 will be described. In FIG. 8, a perspective view of the bush 671 is shown. The bush 671 is a member fixed to a casing of the drum unit 518 with a screw or an adhesive. As shown in FIG. 8, the bush 671 is provided with an opening 916. Into the opening 916, a shaft member of the photosensitive drum 103 at the other end side is rotatably inserted. That is, the bush 671 rotatably shaft-supports the photosensitive drum 103.

In the photosensitive drum 103, a photosensitive layer is formed on an outer wall surface of a hollow cylindrical aluminum tube. At both ends of the aluminum tube, flanges 673 are press-fitted. In the opening 916 formed in the bush 671, the flange 673 at the other end side of the photosensitive drum 103 is rotatably inserted. The flange 673 rotates while sliding with an inner wall surface of the opening 916 formed in the bush 671. That is, the bush 671 rotatably shaft-supports the photosensitive drum 103. Further, also at a central portion, of the component part, corresponding to the bush 671 to which the contact pin 514 is contacted and which is provided on the front side of the drum unit 518, an opening is formed similarly as in the bush 671. In the opening formed in the component part corresponding to the bush 671, the flange 673 at one end side (front side) of the photosensitive drum 103 is rotatably inserted. The flange 673 rotates while sliding with an inner wall surface of the opening. That is, similarly as the rear side of the drum unit 518, also on the front side, the bush 671 rotatably shaft-surfaces the photosensitive drum 103.

The bush 671 includes an engaging portion 685 in which the contact pin 515 is engaged. The engaging portion 685 includes a contact surface 551, a rear side wall surface 596 and a tapered portion 585. To the contact surface 551, the contact pin 515 moving in the direction from the retracted position toward the exposure position is contacted. At a lower end edge of the engaging portion 685, the tapered portion 585 having a tapered shape is formed. The tapered portion 585 guides movement of the contact pin 515 moving in the direction from the retracted position toward the exposure position so that the contact pin 515 contacts the contact surface 551. Contact between the rear side wall surface 596 and the contact pin 515 will be described later.

(Moving Mechanism)

In the following, the moving mechanism 640 for moving the optical print head 105 will be described.

Figure 9:
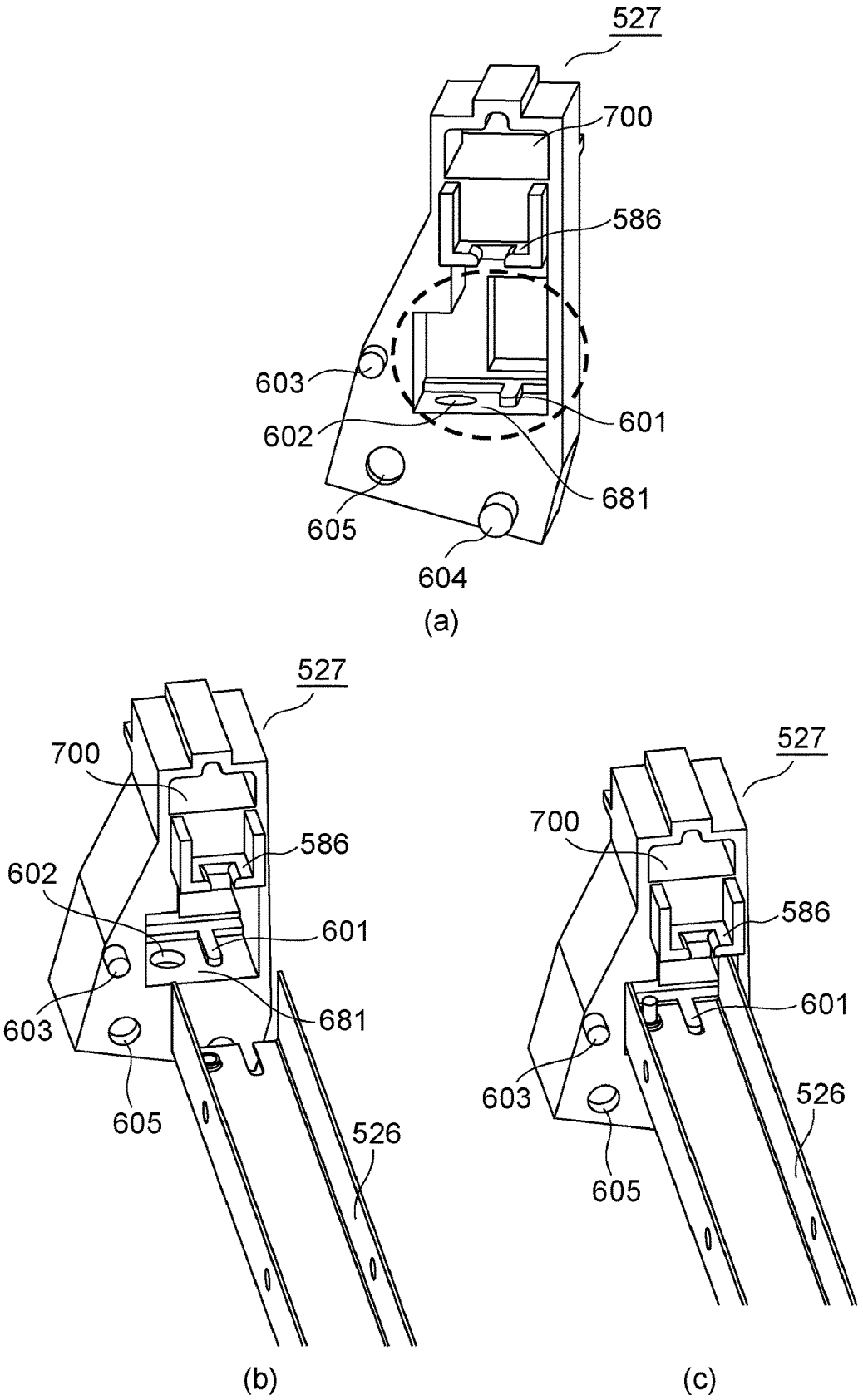
FIG. 9 includes perspective views of a first supporting portion and a third supporting portion.

First, the first supporting portion 527 will be described. Part (a) of FIG. 9 is a schematic perspective view of the first supporting portion 527. The first supporting portion 527 includes contact surface 586, an opening 700, a projection 601, a screw hole 602, a positioning boss 603, a positioning boss 604 and a screw hole 605.

The contact surface 586 is a portion contacting the lower side of the holding member 505 moving from the exposure position toward the retracted position. The lower side of the holding member 505 contacts the contact surface 586, so that the optical print head 105 is in the retracted position.

The first supporting portion 527 is fixed to the front side surface of the front side plate 642. The front side plate 642 is provided with a positioning boss 603, a positioning boss 604 and a plurality of holes corresponding to fixing screws, respectively (not shown). The positioning boss 603 and the positioning boss 604 are inserted in a plurality of holes provided, and in that state, the first supporting portion 527 is fixed to the front side plate 642 by screws passed through the screw holes of the first supporting portion 527.

The third supporting portion 526 described later is a metal plate bent in a U-shape. Part (b) of FIG. 9 shows a view for illustrating a state in which one end portion of the third supporting portion 526 with respect to the longitudinal direction is to be inserted into a portion enclosed by a dotted line shown in part (a) of FIG. 9, and part (c) of FIG. 9 is a view in which the one end portion of the third supporting portion 526 with respect to the longitudinal direction in the portion enclosed by the dotted line shown in part (a) of FIG. 9. As shown in parts (b) and (c) of FIG. 9, the one end portion of the third supporting portion 526 is provided with a cut-away portion, and the projection 601 on the first supporting portion 527 side engages with the cut-away portion of the third supporting portion 526. By engagement of the projection 601 with the cut-away portion of the third supporting portion 526, a position of the third supporting portion 526 with respect to the left-right direction is determined relative to the first supporting portion 527. The third supporting portion 526 is pressed from a lower side of part (c) of FIG. 9 by a screw inserted through the screw hole 602 and is fixed to the first supporting portion 527 by contact thereof with a contact surface 681 of the first supporting portion 527. Through the opening 700 of the first supporting portion 527, a rod-like cleaning member for cleaning the light emitting surface of the lens array 506 contaminated with the toner or the like is inserted from an outside of the image forming apparatus 1 main assembly.

Figure 10:
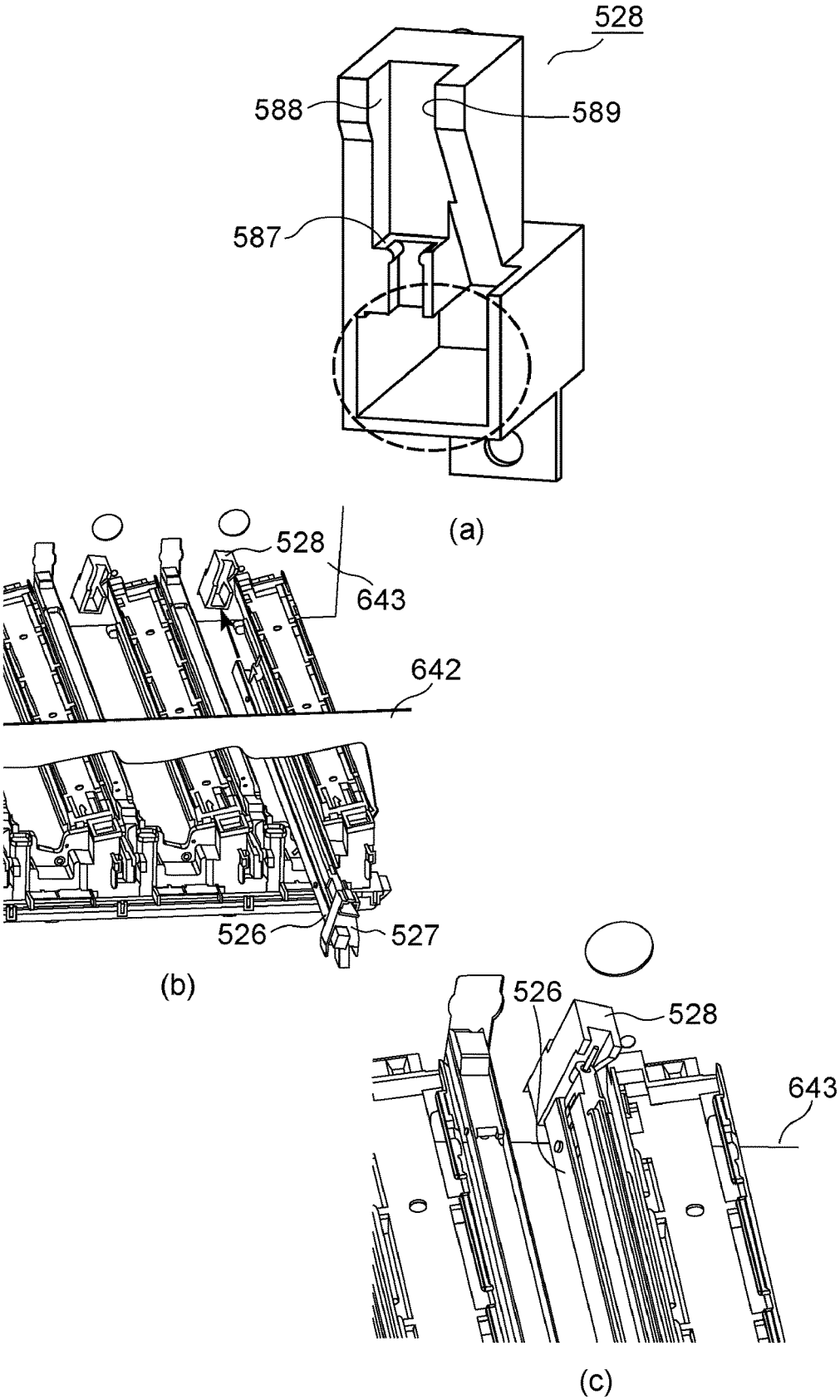
FIG. 10 includes perspective views of a second supporting portion, a rear side plate, and to the second supporting portion.

Next, the second supporting portion 528 will be described. Part (a) of FIG. 10 is a schematic perspective view of the second supporting portion 528. At the second supporting portion 528 includes the contact surface 587, a first wall surface 588 and a second wall surface 589.

The contact surface 587 is, as described above, a portion contacting the lower side of the holding member 505 moving from the exposure position toward the retracted position. The lower side of the holding member 505 contacts the contact surface 587, so that the optical print head 105 is in the retracted position.

As shown in part (b) of FIG. 10, the second supporting portion 528 is fixed to the front side surface of the rear side plate 643. The second supporting portion 528 is fixed to the rear side plate 643 by positioning bosses and screws similarly as the method in which the first supporting portion 527 is fixed to the front side plate 642. Part (c) of FIG. 10 shows a state in which the other end side (rear side) of the third supporting portion 526 with respect to the longitudinal direction of the third supporting portion 526 is inserted in a portion enclosed by a dotted line shown in part (a) of FIG. 10. That is, the third supporting portion 526 is supported by the first supporting portion 527 at one end portion and is supported by the second supporting portion 528 at the other end portion, and the first supporting portion 527 and the second supporting portion 528 are fixed to the front side plate 642 and the rear side plate 643, respectively. For that reason, the third supporting portion 526 is fixed to the image forming apparatus 1 main assembly.

Incidentally, the second supporting portion 528 may also have a constitution in which the second supporting portion 526 is fixed to the third supporting portion 526 by the screws or the like and is not screwed with the rear side plate 643. In that case, for example, the second supporting portion 526 has a structure such that a recessed portion is formed and is engaged with a projection formed on the rear side plate 643, and a position of the second supporting portion 528 relative to the rear side plate 643 is determined. The first wall surface 588 and the second wall surface 589 of the second supporting portion 528 will be described later.

Next, the third supporting portion 526 and the slidable portion 525 will be described using FIG. 11.

Part (a) of FIG. 11 is a schematic perspective view of the moving mechanism 640, in which the first supporting portion 527 is not shown. Further, part (b) of FIG. 11 is a schematic perspective view of the front side of the moving mechanism 640, in which the first supporting portion 527 is not shown, as seen from a right side. The moving mechanism 640 includes the slidable portion 525, the second supporting portion 526 and a first link mechanism 861. The third supporting portion 526 includes a supporting shaft 531 and an E-type stopper ring 533. As shown in FIG. 11, the supporting shaft 531 is inserted into openings provided in opposing surfaces (left side surface and right side surface) of the third supporting portion 526 processed in the U-character shape. The supporting shaft 531 penetrates through the right side surface and the left side surface of the third supporting portion 526. The supporting shaft 531 is retained by the E-type stopper ring 533 on an outside of the left side surface so as not to fall off the opening of the third supporting portion 526. On the other hand, as shown in part (a) of FIG. 11, the slidable portion 525 is provided with an elongated hole 691 extending in the front-rear direction. The supporting shaft 531 is inserted into the elongated hole 691. For that reason, the slidable portion 525 is restricted in movement in the up-down direction relative to the third supporting portion 526 and is slidable (movable) relative to the third supporting portion 526 by a length of the elongated hole 691 with respect to the front-rear direction.

Further, at one end side of the slidable portion 525, a slide assisting member 539 including an accommodating space 562 ranging from a left side toward a lower side is mounted. The slide assisting member 539 is fixed to the slidable portion 525 by being fastened with a screw from the left side. In the accommodating space 562, a pressing portion 561 of the cover 558 is accommodated. A relationship between the accommodating space 562 and the pressing portion 561 and structural features of the space 562 and the portion 561 will be described together with description of the cover 558 later.

Figure 12:
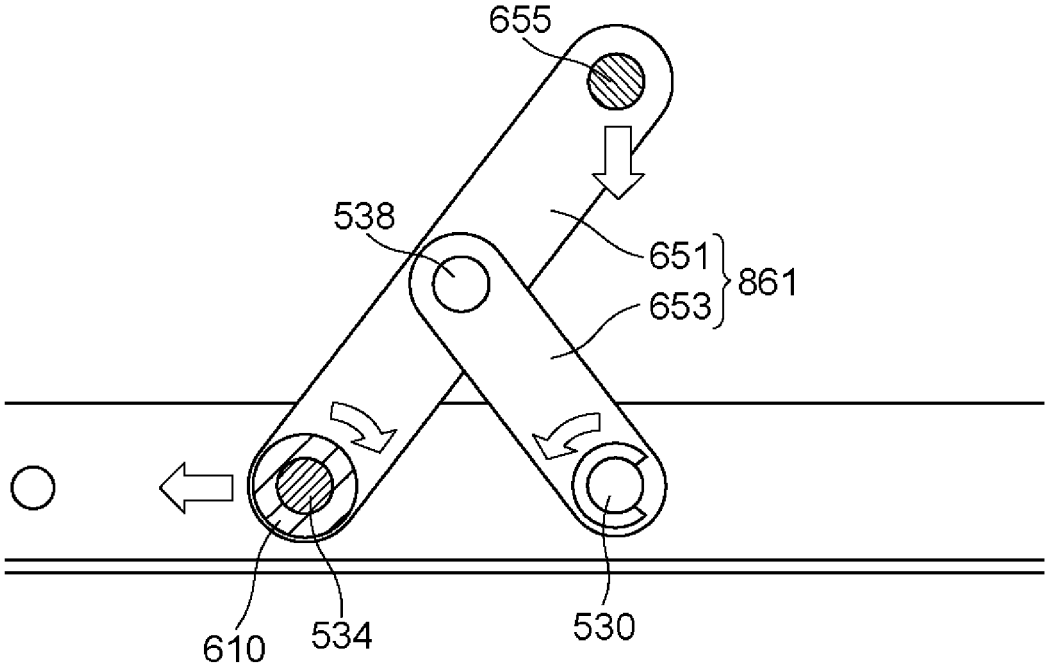
FIG. 12 includes side views of a first link mechanism.
Figure 12:
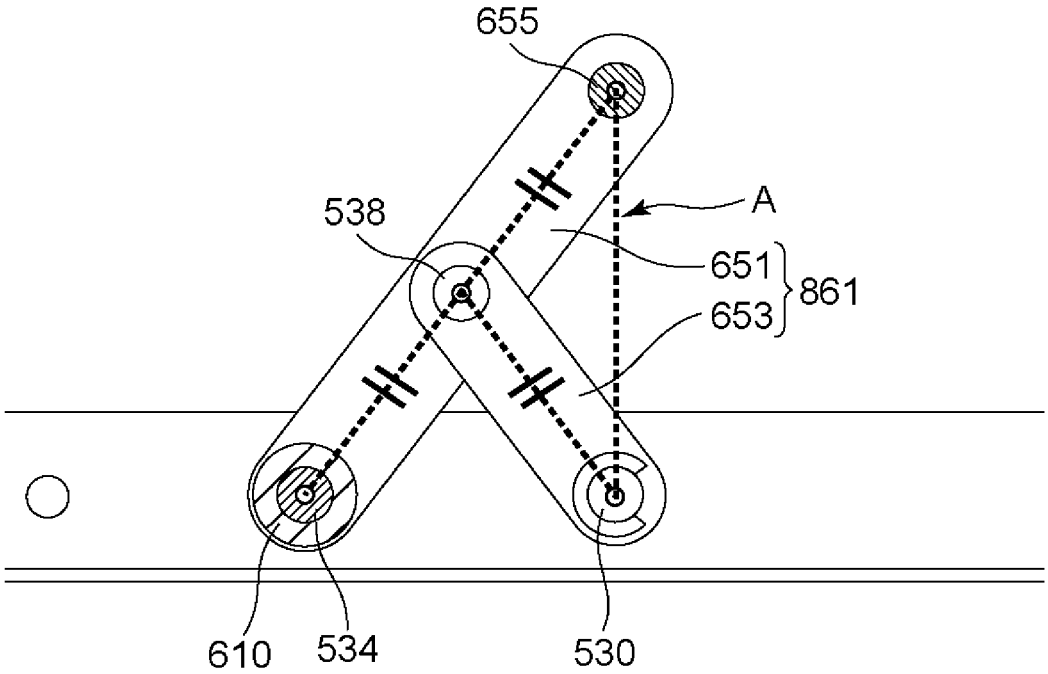

In the following, the first link mechanism 861 will be described using part (a) of FIG. 11, part (b) of FIG. 11, and FIG. 12. Part (a) of FIG. 12 is a schematic view of a cross-sectional view of the first link mechanism 861 cut along the rotational axis direction. The first link mechanism 861 includes the link member 651 as a first link member and the link member 653 as a third link member. Each of the link member 651 and the link member 653 in this embodiment is a single link member, but may also be constituted by combining a plurality of link members.

As shown in parts (a) and (b) of FIG. 12, a length of the link member 653 with respect to the longitudinal direction is shorter than a length of the link member 651 with respect to the longitudinal direction. The first link mechanism 861 and the second link mechanism 862 constitute a link mechanism of a 6 type.

The link member 651 includes a bearing portion 610, a projection 655 as an example of a first moving portion and a connecting shaft portion 538. The bearing portion 610 is provided at one end side of the link member 651 with respect to the longitudinal direction. The projection 655 is a cylindrical projection provided at the other end side of the link member 651 with respect to the longitudinal direction and extending in the rotational axis direction of the link member 651. The connecting shaft portion 538 is provided between the bearing portion 610 and the projection 655 with respect to the longitudinal direction of the link member 651. Incidentally, the first moving portion is not limited to the projection 655, but may also be a structure in which the link member 651 is bent with respect to the rotational axis direction at one end side with respect to the longitudinal direction.

The bearing portion 610 is provided with a hollow hole extending in the left-right direction of part (a) of FIG. 12. The slidable portion 525 is provided with an engaging shaft portion 534. The engaging shaft portion 534 is a cylindrical projection standing from the slidable portion 525 in the left direction of part (a) of FIG. 12. The engaging shaft portion 534 forms a first connecting portion by being engaged rotatably in the hole of the bearing portion 610. That is, the link member 651 is rotatable about the first connecting portion relative to the slidable portion 525. Here, a constitution in which the engaging shaft portion 534 is formed on the link member 651 side and in which the bearing portion 610 is formed on the slidable portion 525 side may also be employed.

The projection 655 is a cylinder-shaped projection standing from the slidable portion 525 in part (a) of FIG. 12. The projection 655 is a projection for deforming a spring provided on the holding member 505 side of the optical print head 105.

The link member 653 includes a connecting shaft portion 530. The connecting shaft portion 530 is provided at one end side of the link member 653 with respect to the longitudinal direction of the link member 653. The connecting shaft portion 530 is a cylindrical project standing from the link member 653 toward the left side of part (a) of FIG. 12. The connecting shaft portion 530 is inserted rotatably in a hole formed in the third supporting portion 526 and forms a second connecting portion. Here, the connecting shaft portion 530 may also be formed on the third supporting portion 526, not the link member 653. That is, in the hole provided in the link member 653, the connecting shaft portion 530 formed on the third supporting portion 526 may also be inserted. The link member 653 is provided with a circular hole, extending in the left-right direction of part (a) of FIG. 12, formed at the other end side thereof with respect to the longitudinal direction. In the hole, the connecting shaft portion 538 of the link member 651 is rotatably inserted, so that the connecting shaft portion 538 and the hole of the link member 653 form a fourth connecting portion. That is, the link member 653 is rotatable about the third connecting portion relative to the third supporting portion 526 and is rotatable about the fourth connecting portion relative to the link member 651. Here, the connecting shaft portion 538 may also be formed on the link member 653, not the link member 651. That is, the connecting shaft portion 538 formed on the link member 653 may also be rotatably inserted in a hole formed in the link member 651.

Incidentally, on the rear side of the third supporting portion 526, a shaft similar to the supporting shaft 531 is provided, and a hole similar to the elongated hole 691 is formed on the rear side of the slidable portion 525, and the rear side of the moving mechanism 640 is provided with a structure similar to the structure of the front side. Further, a structure of the second link mechanism 862 is also similar to the above-described structure of the first link mechanism 861. The link members 652 and 654 of the second link mechanism 652 correspond to the link members 651 and 653, respectively, of the first link mechanism 862. Correspondingly to the first connecting portion, connecting portion between one end side portion of the link member 652 with respect to the longitudinal direction and the slidable portion 525 constitutes a second connecting portion. Incidentally, in the moving mechanism 640, either one of the link members 653 and 654 may also be omitted.

By the above constitution, when the slidable portion 525 is slid from the front side toward the rear side relative to the third supporting portion 526, the bearing portion 610 engaged with the engaging shaft portion 534 is slid together with the slidable portion 525 from the front side toward the rear side relative to the third supporting portion 526. By this, as shown in part (a) of FIG. 12, when the first link mechanism 861 is seen from the right side, the link member 651 is rotated about the engaging shaft portion 534 in the clockwise direction, and the link member 653 is rotated about the connecting shaft portion 530 in the counterclockwise direction. Therefore, the projection 655 is moved from the exposure position toward a retracted position.

On the other hand, when the slidable portion 525 is slid from the rear side toward the front side relative to the third supporting portion 526, the bearing portion 610 engaged with the engaging shaft portion 534 is slid together with the slidable portion 525 from the rear side toward the front side relative to the third supporting portion 526. As a result, as shown in part (a) of FIG. 12, when the first link mechanism 861 is seen from the right side, the link member 651 is rotated about the engaging shaft portion 534 in the counterclockwise direction, and the link member 653 is rotated about the connecting shaft portion 530 in the clockwise direction. Therefore, the projection 655 is moved from the retracted position toward the exposure position.

Here, a constitution in which a structure in which the first link mechanism 861 and the second link mechanism 862 are reversed with respect to the front-rear direction, is used and when the slidable portion 525 is slid from the front side toward the rear side, the optical print head 105 is moved from the retracted position toward the exposure position, and when the slidable portion 525 is slid from the rear side toward the front side, the optical print head 105 is moved from the exposure position toward the retracted position may also be employed. In this case, the cover 558 described later pushes the slidable portion 525 from the front side toward the rear side during movement of the cover 558 from an open state toward a closed state and pulled the slidable portion 525 from the rear side toward the front side during movement of the cover 558 from the closed state toward the open state.

Incidentally, (1) a distance between a rotation center axis of the connecting shaft portion 538 and a rotation center axis of the bearing portion 610 is L1, (2) a distance between the rotation center axis of the connecting shaft portion 538 and a rotation center axis of the connecting shaft portion 530 is L2, and (3) a distance between the rotation center axis of the connecting shaft portion 538 and a rotation center axis of the projection 655 is L3. In this embodiment, the first link member 861 forms Scott-Russel's mechanism in which L1, L2 and L3 are equal to each other (part (b) of FIG. 12). The distances L1, L2 and L3 are made equal to each other, whereby the projection 655 is vertically moved (along a dotted line A in part (b) of FIG. 12) with respect to a slide (movement) direction of the engaging shaft portion 534, and therefore, in the above-described link mechanism, the optical print head 105 can be moved substantially in an optical axis direction of the lens. When the optical print head 105 moves in substantially the optical axis direction of the lenses, the rear side of the holding member 505 moves in the gap formed by the first wall surface 588 and the second wall surface 589 provided in the above-described second supporting portion 528. By this, inclination of the holding member 505 with respect to the left-right direction is prevented.

Next, the cover 558 will be described using FIG. 13. The cover 558 is a member for sliding (moving) the slidable portion 525 as described above. Incidentally, a constitution for sliding (moving) the slidable portion 525 is not limited to the cover 558. For example, a constitution in which the slidable portion 525 is slid (moved) in interrelation with opening and closing of an unshown front door may also be employed. Further, a constitution in which the slidable portion 525 is slid (moved) in interrelation with rotation of a rotatable member such as a lever, not a covering member such as the cover 558 or a door may also be employed.

Figure 13:
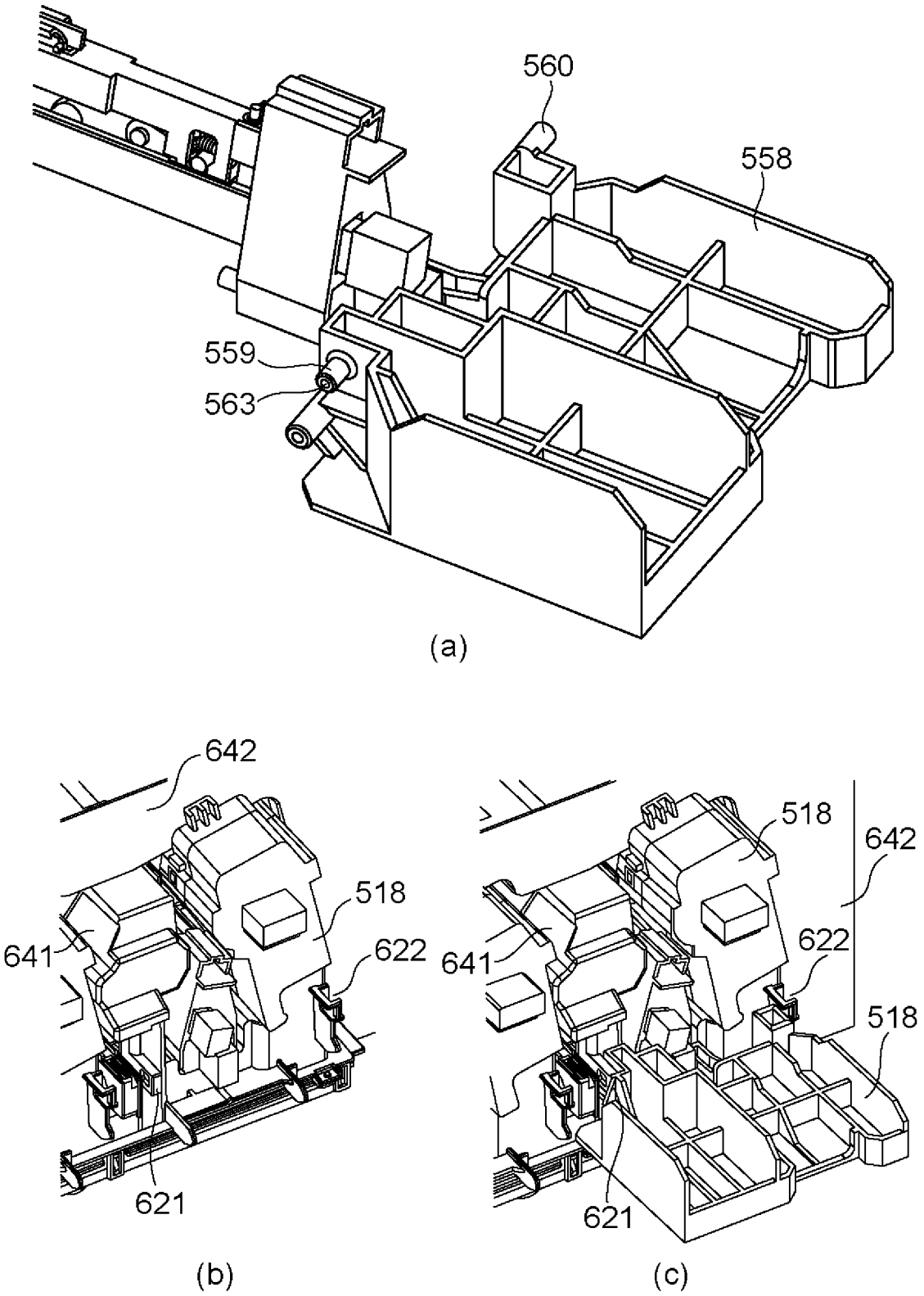
FIG. 13 includes perspective views of a cover.

Part (a) of FIG. 13 is a perspective view of the cover 558. As shown in part (a) of FIG. 13, the cover 558 includes a rotation shaft portion 559 and a rotation shaft portion 560. The rotation shaft portion 559 is a cylindrical projection projecting in the right side direction of the cover 558. On the other hand, the rotation shaft portion 560 is a cylindrical projection projecting in the left side direction of the cover 558.

An enlarged view of a portion where the cover 558 is mounted on the front side plate 642 is shown in part (b) of FIG. 13. Further, part (c) of FIG. 13 is a perspective view of the cover 558 mounted on the front side plate 642. As shown in part (b) of FIG. 13, the front side plate 642 includes a bearing member 621 engageable with the rotation shaft portion 559 of the cover 558 and includes a bearing member 622 engageable with the rotation shaft portion 560 of the cover 558. As shown in part (c) of FIG. 13, the rotation shaft portion 559 of the cover 558 rotatably engages with the bearing member 621 of the front side plate 642, and the rotation shaft portion 560 of the cover 558 rotatably engages with the bearing member 622 of the front side plate 642. As shown in part (a) of FIG. 13, a rotational axis of the rotation shaft portion 559 and a rotational axis of the rotation shaft portion 560 are on a rotational axis 563. The cover 558 opens and closes about the rotational axis 563 as a rotation center relative to the image forming apparatus 1 main assembly. The closed cover 558 positions on an insertion and extraction passage of the developing unit 641. For that reason, when the cover 558 is in a closed state, the operator cannot perform the exchange operation of the drum unit 518 and the developing unit 641. The operator is capable of exchanging the drum unit 518 by opening the cover 558, and closes the cover 558 after the operation.

Next, using FIG. 14-FIG. 17, a constitution in which the slidable portion 525 slides (moves) in the rotational axis direction of the photosensitive drum 103 in interrelation with the opening and closing operation of the cover 558 will be specifically described.

Figure 14:
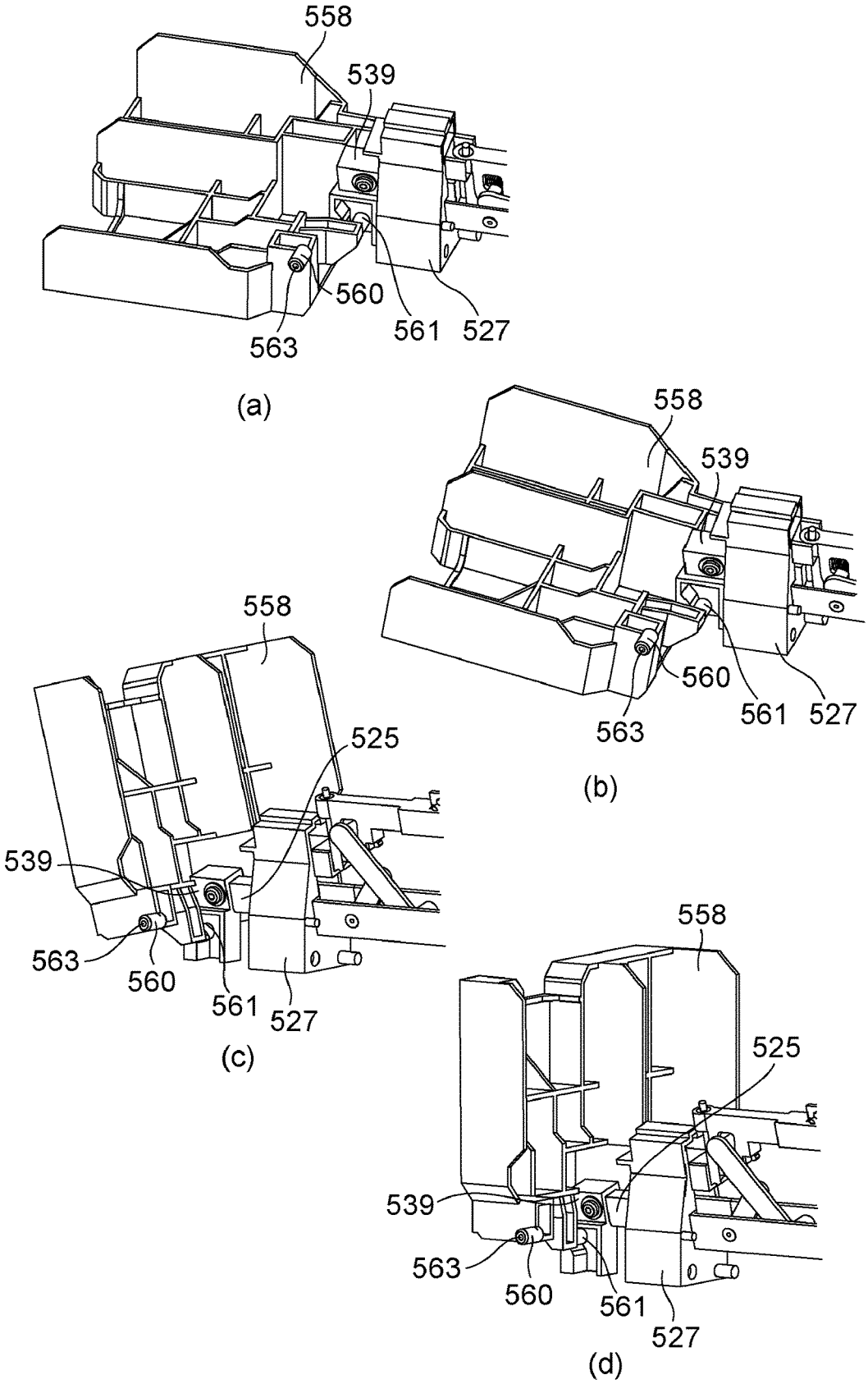
FIG. 14 includes perspective views of the cover for illustrating an operation when the cover is closed.
Figure 15:
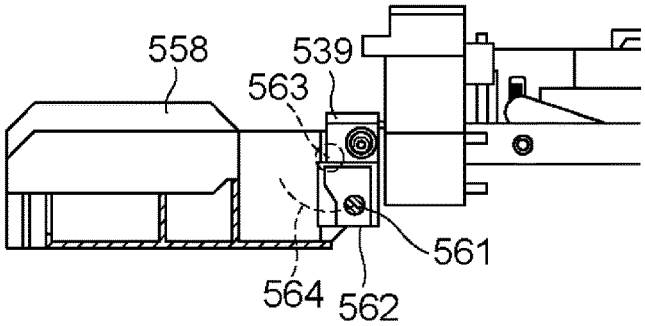
FIG. 15 includes perspective views of the cover for illustrating the operation when the cover is closed.
Figure 15:
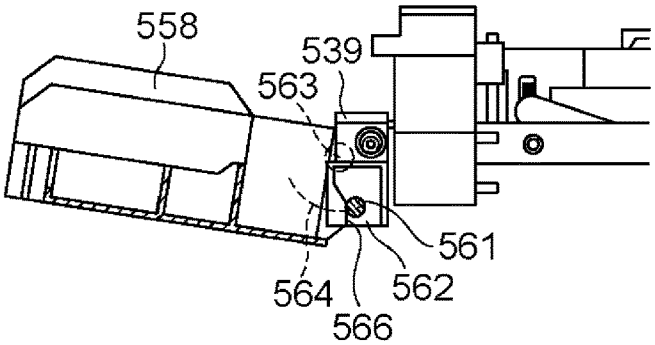
Figure 15:
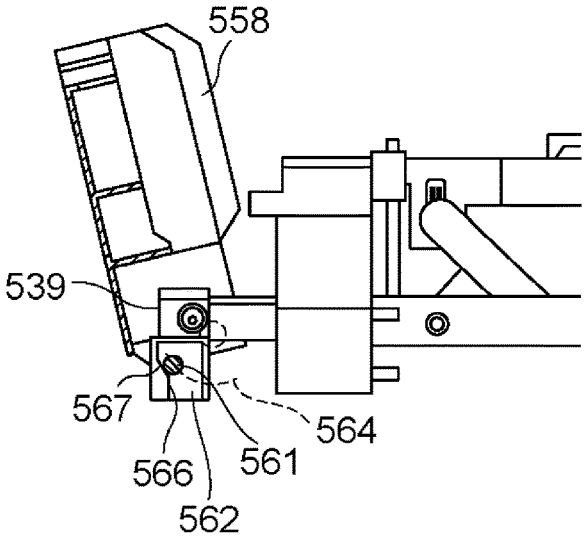
Figure 15:
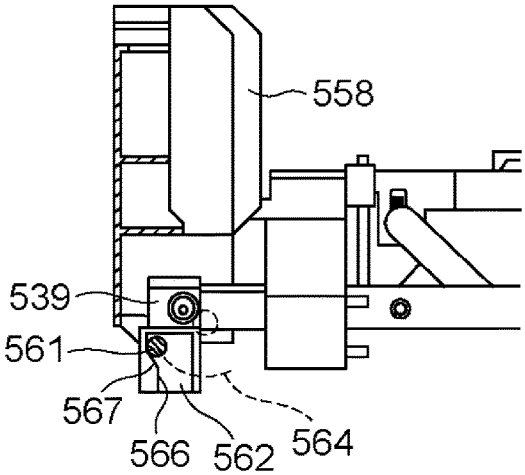

Parts (a)-(d) of FIG. 14 are perspective views showing the cover 558 rotating from the open state toward the closed state. Parts (a)-(d) of FIG. 15 are sectional views showing the cover 558 rotating from the closed state toward the open state. Part (a) of FIG. 14 and part (a) of FIG. 15 show the open state of the cover 558. Part (d) of FIG. 14 and part (d) of FIG. 15 show the closed state of the cover 558. Part (b) of FIG. 14 and part (b) of FIG. 15, and part (c) of FIG. 14 and part (c) of FIG. 15 are the views showing the cover 558 shifting from the open state to the closed state. Incidentally, the cover 558 in the closed state shown in part (d) of FIG. 14 and part (d) of FIG. 15 maintains the closed state by a snap-fit mechanism, a stopper for preventing rotation, or the like.

Figure 22:
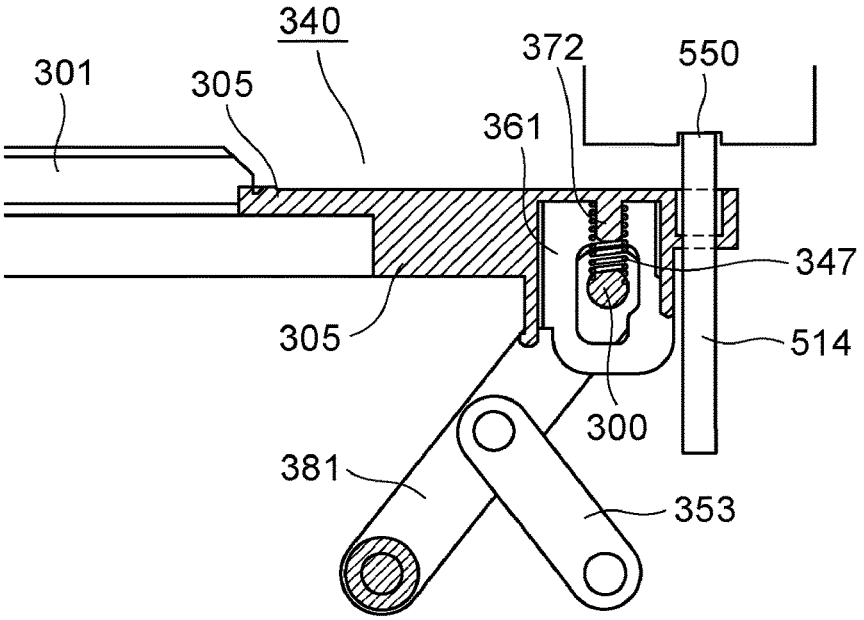
FIG. 22 includes views for illustrating a moving mechanism according to a modified embodiment 1.
Figure 22:
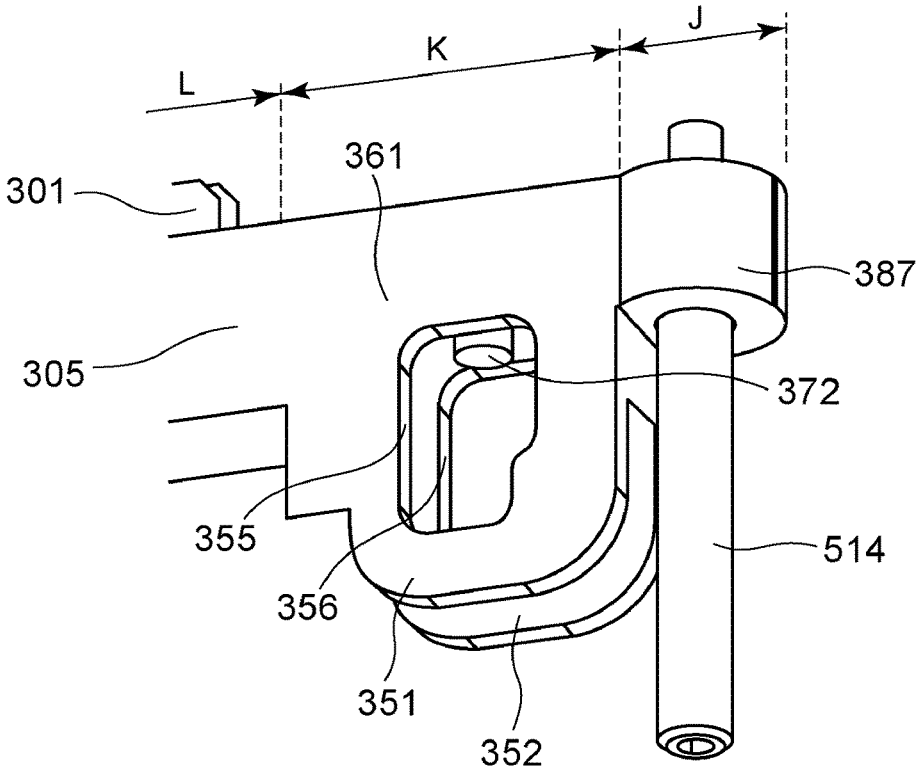

As shown in parts (a)-(d) of FIG. 22, the cover 558 rotates about the rotational axis 563 as a center relative to the image forming apparatus 1 main assembly. The cover 558 includes the cylindrical pressing portion 561 projecting from the left side toward the right side. As shown in FIG. 22, the pressing portion 561 is positioned in the accommodating space 562 mounted at one end of the slidable portion 525. The pressing portion 561 moves on a movement locus 564 with rotation of the cover 558 as shown in parts (a)-(d) of FIG. 15.

Action of the pressing portion 561 on the slidable portion 525 will be described using parts (a)-(d) of FIG. 15. When the cover 558 rotates clockwise from the state of part (a) of FIG. 15, the pressing portion 561 is positioned on the movement locus 564 and contacts a first portion-to-be-urged 566 crossing the movement locus 564 (part (b) of FIG. 15). When the cover 558 further rotates clockwise from this state, the pressing portion 561 presses the first portion-to-be-urged 566 toward the front side while sliding on the first portion-to-be-urged 566. By that, the slide assisting member 539 moves toward the front side. The slide assisting member 539 is fixed to the slidable portion 525, and therefore, the slidable portion 525 also slides (moves) toward the front side in interrelation with movement of the slide assisting member 539.

Further, when the cover 558 rotates clockwise, the pressing portion 561 moves from on the first portion-to-be-urged 566 to on a second portion-to-be-urged 567 (part (c) of FIG. 15). The second portion-to-be-urged 567 forms a curved surface having a shape roughly following the movement locus 564 of the pressing portion 561. For that reason, in the case where the cover 558 further rotates clockwise from the state of part (c) of FIG. 15, the pressing portion 561 moves toward the upper side in contact with the second portion-to-be-urged 567, but a force for sliding (moving) the slide assisting member 539 toward further front side is not imparted from the pressing portion 561.

From part (c) of FIG. 14 and part (c) of FIG. 15, the pressing portion 561 contacts the front side second portion-to-be-urged 567 of the accommodating space 562 immediately after the holding member 505 is in the exposure position by rotating the cover 558 from the open state to the closed state. The second portion-to-be-urged 567 has a shape roughly following the movement locus 564 of the pressing portion 561, i.e., has an arcuate shape about the rotational axis 563 as a center. For that reason, in the case where the cover 558 further rotates clockwise from the state of part (c) of FIG. 15, the pressing portion 561 moves while sliding in a state in which the pressing portion 561 contacted the second portion-to-be-urged 567. However, the force for sliding (moving) the slide assisting member 539 toward further front side is not imparted from the pressing portion 561. For that reason, during movement of the pressing portion 561 on the second portion-to-be-urged 567, the slide assisting member 539 is prevented from moving from the rear side toward the front side. That is, the moving mechanism 640 of this embodiment is constituted so that when the cover 558 is rotated in the state in which the pressing portion 561 contacted the first portion-to-be-urged 566, the slidable portion 525 slides (moves) in interrelation with movement of the pressing portion 561, but so that even when the cover 558 is rotated in the state in which the pressing portion 561 contacted the second portion-to-be-urged 567, the slidable portion 525 does not slide (move). When the cover 558 further rotate clockwise from the state of part (c) of FIG. 15, the cover 558 is in the closed state shown in part (d) of FIG. 15.

Figure 16:
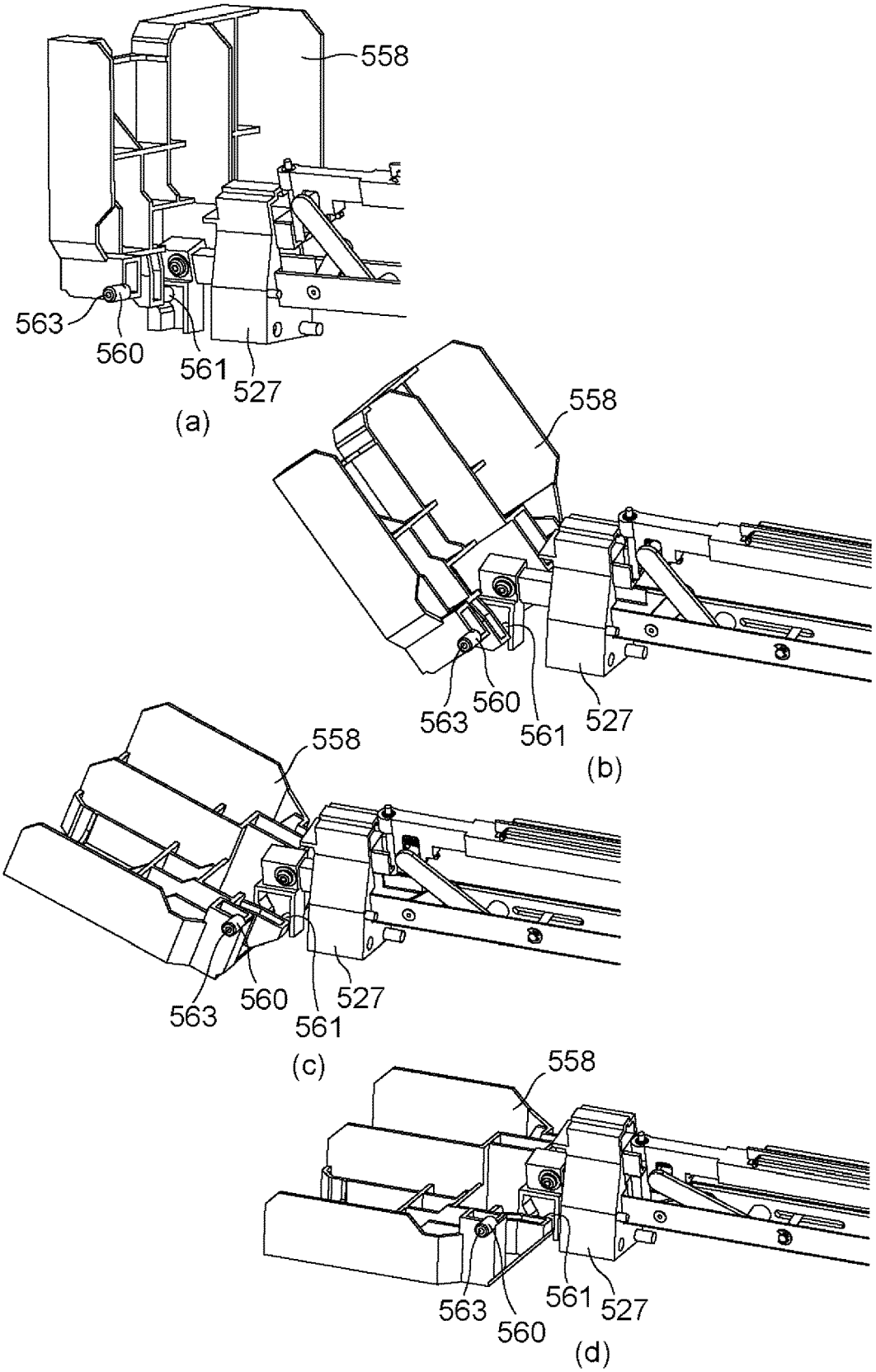
FIG. 16 includes perspective views of the cover for illustrating an operation when the cover is opened.
Figure 17:
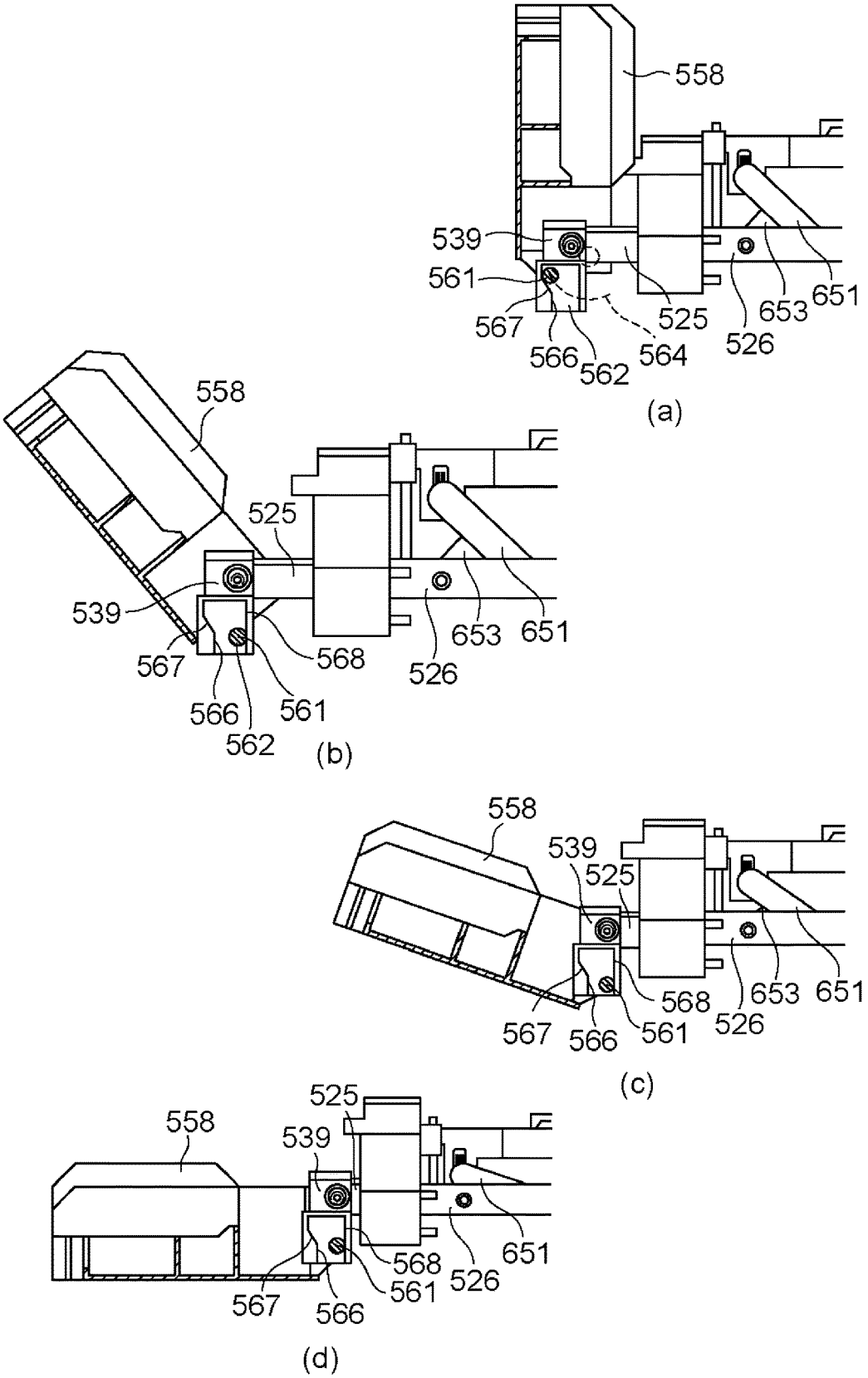
FIG. 17 includes perspective views of the cover for illustrating the operation when the cover is opened.

Parts (a)-(d) of FIG. 16 are perspective views showing the cover 558 rotating from the closed state toward the open state. Parts (a)-(d) of FIG. 17 are sectional views showing the cover 558 rotating from the open state toward the closed state. Part (a) of FIG. 16 and part (a) of FIG. 17 show the closed state of the cover 558. Part (d) of FIG. 16 and part (d) of FIG. 17 show the open state of the cover 558. Part (b) of FIG. 16 and part (b) of FIG. 17, and part (c) of FIG. 16 and part (c) of FIG. 17 are the views showing the cover 558 shifting from the closed state to the open state.

In the closed state of the cover 558 shown in part (a) of FIG. 17, by a self-weight of the optical print head 105 and a restoring force of a spring described later, a force for sliding (moving) the slidable portion 525 from the front side toward the rear side via the first link mechanism 861 and the second link mechanism 862 acts on the slidable portion 525. However, the cover 558 in the closed state is fixed to the image forming apparatus 1 main assembly so as not to rotate, and the pressing portion 561 restricts movement of the slide assisting member 539 toward the rear side, and therefore, the slidable portion 525 does not slide (move) toward the rear side.

When the cover 558 rotates counterclockwise from (a state of) part (a) of FIG. 17, the pressing portion 561 contacts a third portion-to-be-urged 568 as shown in part (b) of FIG. 17. When the cover 558 further rotate counterclockwise from a state of part (b) of FIG. 17, the pressing portion 561 presses the third portion-to-be-urged 568 from the front side toward the rear side as shown in parts (b) and (c) of FIG. 17, and therefore, the slidable portion 525 moves toward the rear side. Thereafter, when the cover 558 further rotate counterclockwise, the cover 558 is in the open state as shown in part (d) of FIG. 17.

A mechanism in which the pressing portion 561 presses the third portion-to-be-urged 568 is provided for the following reason. Even if movement restriction to the slide assisting member 539 by the pressing portion 561 is released by rotating the cover 558 counterclockwise from the state of part (a) of FIG. 16, when a frictional force between the respective link members, a frictional force between the link member 651 or the link member 653 and the slidable portion 525 and a frictional force between the link member 652 or the link member 654 and the third supporting portion 526 are large, the case where the slidable portion 525 does not slides (moves) toward the rear side would be considered. That is, the case where even when the cover 558 is opened, the slidable portion 525 does not slides (moves) would be considered. On the other hand, in order to move the slidable portion 525 toward the rear side by opening the cover 558, the moving mechanism 640 of this embodiment includes a mechanism in which the pressing portion 561 presses the third portion-to-be-urged 568.

By the above-described constitution, the operator for performing maintenance opens and closes the cover 558, so that the slidable portion 525 slides (moves) relative to the third supporting portion 526 in interrelation with movement of the cover 558.

Next, a connecting mechanism between the holding member 505 and the link member 651 will be described. Parts (a) and (c) of FIG. 26 are perspective views showing one end side of the holding member 505 with respect to the front-rear direction (rotational axis direction of the photosensitive drum 103). Parts (b) and (d) of FIG. 18 are perspective views showing the other end side of the holding member 505 with respect to the front-rear direction (rotational axis direction of the photosensitive drum 103).

Figure 18:
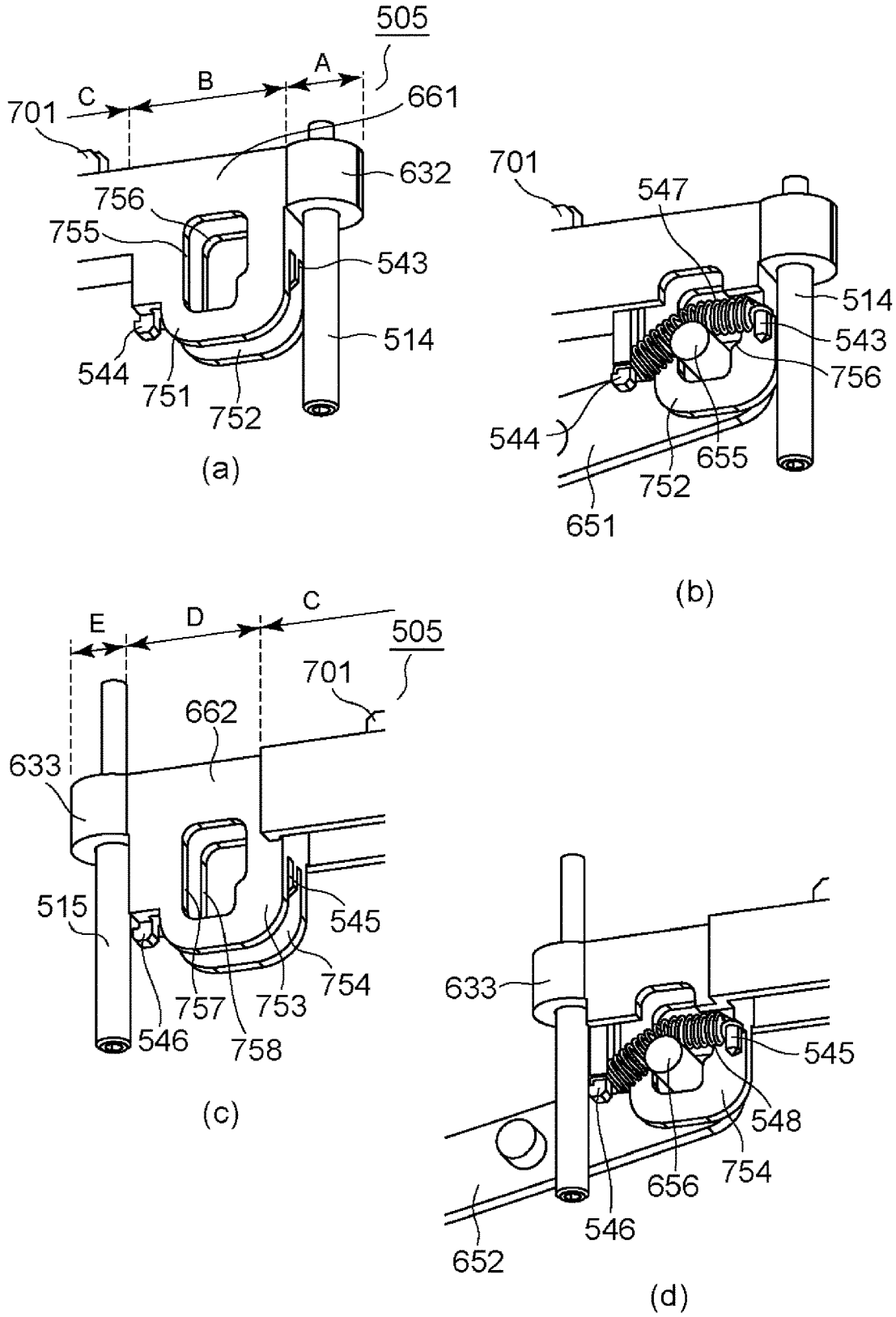
FIG. 18 includes perspective views for illustrating a structure of a holding member on both ends.

As shown in part (a) of FIG. 18, the holding member 505 includes the lens mounting portion 701 on which the lens array 506 is mounted, the spring mounting portion 661 in which the coil spring 547 as a first spring is mounted, the spring mounting portion 662 in which the coil spring 548 as a second spring is mounted, the pin mounting portion 632 in which the contact pin 514 is mounted, and the pin mounting portion 633 in which the contact pin 515 is mounted. The lens mounting portion 701, the spring mounting portion 661, the spring mounting portion 662, the pin mounting portion 632 and the pin mounting portion 633 are an integrally molded product through injection molding. With respect to the front-rear direction, the spring mounting portion 661 is disposed at one end side of the lens mounting portion 701, and the pin mounting portion 632 is disposed on a further end portion side of the holding member 505 than the spring mount portion 661 is. Further, with respect to the front-rear direction, the spring mounting portion 662 is disposed at the other end side of the lens mounting portion 701, and the pin mounting portion 632 is disposed on a further end portion side than the spring mounting portion 662 is. In the holding member 505, when portions where the lens mounting portion 701, the spring mounting portion 661 and the pin mounting portion 632 are formed are shown in the figure, in part (a) of FIG. 18, the portions are portions shown by a region of C, a region of B and a region of A. Further, using part (c) of FIG. 18, when portions where the lens mounting portion 701, the spring mounting portion 662 and the pin mounting portion 633 are formed are shown in the figure, the portions are portions shown by the region of C, a region of D and a region of E, respectively.

First, the spring mounting portion 661 will be described. The spring mounting portion 661 includes a first wall portion 751, a second wall portion 752, a first engaging portion 543 and a second engaging portion 544. The first wall portion 751 is disposed at one end side of the holding member 505 with respect to the left-right direction, and the second wall portion 752 is disposed at the other end side of the holding member 505 with respect to the left-right direction. In this embodiment, with respect to the left-right direction, the first wall portion 751 and the second wall portion 752 are disposed on both sides of the contact pin 514. As shown in part (a) of FIG. 18, the first wall portion 751 and the second wall portion 752 include inner wall surfaces opposing each other. In the first wall portion 751, an opening 755 is formed, and in the second wall portion 752, an opening 756 is formed. The opening 755 and the opening 756 are elongated holes extending in the up-down direction. In the opening 755 and the opening 756, the projection 655 is inserted. The projection 655 is not engaged with the opening 755 and the opening 756, and is inserted with a gap of about 0.5 mm at a narrowest portion with respect to the front-rear direction. For this reason, a movement direction of the projection 655 is guided with respect to the up-down direction by the opening 755 and the opening 756 without receiving a large frictional force from the inner wall surfaces of the opening 755 and the opening 756.

Part (b) of FIG. 18 is a drawing in which the first wall portion 751 is removed from part (a) of FIG. 18. With respect to the left-right direction, between the first wall portion 751 and the second wall portion 752, the first engaging portion (first mounting portion) 543 and the second engaging portion (first mounting portion) 544 are disposed (pair of first mounting portions). Further, the first engaging portion 543 and the second wall portion 544 are disposed between the opening 755 and the opening 756. In this embodiment, the first engaging portion 543 is disposed on the front side of the holding member 505 than the second engaging portion 544 is. The first engaging portion 543 and the second engaging portion 544 are projections projecting downwardly from connecting portions connecting the first wall portion 751 and the second wall portion 752 of the holding member 505. With the first wall portion 543, one end side of the coil spring 547 (with respect to the longitudinal direction of the coil spring 547) is engaged, and with the second wall portion 544, the other end side of the coil spring 547 (with respect to the longitudinal direction of the coil spring 547) is engaged. The first engaging portion 543 and the second engaging portion 544 are disposed on the spring mounting portion 661 so that the coil spring 547 engaged with the first engaging portion 543 and the second engaging portion 544 crosses the opening 755 and the opening 756.

With respect to the up-down direction, the first engaging portion 543 and the second wall portion 544 are disposed at different positions. In this embodiment, the first engaging portion 543 is disposed on the photosensitive drum 103 side than the second engaging portion 544 is. Incidentally, the first engaging portion 543 and the second engaging portion 544 may be provided at the substantially same height with respect to the up-down direction, and the second engaging portion 544 may be disposed on the photosensitive drum 103 side than the first engaging portion 543 is.

As shown in part (b) of FIG. 18, the projection 655 is inserted from an outer wall surface side of the second wall portion 752 into the opening 756 and passes under the coil spring 547 bridged between the first engaging portion 543 and the second engaging portion 544, and is inserted into the opening 755 of the first wall portion 751.

Next, the spring mounting portion 662 will be described. As shown in part (c) of FIG. 18, the spring mounting portion 662 includes a third wall portion 753, a fourth wall portion 754, a third engaging portion 545 and a fourth engaging portion 546. The third wall portion 753 is disposed at one end side of the holding member 505 with respect to the left-right direction, and the fourth wall portion 754 is disposed at the other end side of the holding member 505 with respect to the left-right direction. In this embodiment, with respect to the left-right direction, the third wall portion 753 and the fourth wall portion 754 are disposed on both sides of the contact pin 515. The first wall portion 751 and the third wall portion 753 are disposed on the same side with respect to the left-right direction, i.e., the first wall portion 751 and the third wall portion 753 are disposed on the right side of the holding member 505. The second wall portion 752 and the fourth wall portion 754 are disposed on the same side with respect to the left-right direction, i.e., the second wall portion 752 and the fourth wall portion 754 are disposed on the left side of the holding member 505.

As shown in part (c) of FIG. 18, the third wall portion 753 and the fourth wall portion 754 include inner wall surfaces opposing each other. In the third wall portion 753, an opening 757 is formed, and in the fourth wall portion 754, an opening 758 is formed. The opening 757 and the opening 758 are elongated holes extending in the up-down direction. In the opening 757 and the opening 758, the projection 656 as an example of a second moving portion is inserted. The projection 656 is not engaged with the opening 757 and the opening 758, and is inserted with a gap of about 0.5 mm at a narrowest portion with respect to the front-rear direction. For this reason, a movement direction of the projection 656 is guided with respect to the up-down direction by the opening 757 and the opening 758 without receiving a large frictional force from the inner wall surfaces of the opening 757 and the opening 758.

Part (d) of FIG. 18 is a drawing in which the third wall portion 753 is removed from part (c) of FIG. 18. With respect to the left-right direction, between the third wall portion 753 and the fourth wall portion 754, the third engaging portion 545 and the fourth engaging portion 546 are disposed. Further, this third engaging portion 545 and this fourth wall portion 546 are disposed between the opening 757 and the opening 758. In this embodiment, the fourth engaging portion 546 is disposed on the rear side of the holding member 505 than the third engaging portion 545 is. The third engaging portion 545 and the fourth engaging portion 546 are projections projecting downwardly from connecting portions connecting the third wall portion 753 and the fourth wall portion 754 of the holding member 505. With the third wall portion 545, one end side of the coil spring 548 (with respect to the longitudinal direction of the coil spring 548) is engaged, and with the fourth wall portion 546, the other end side of the coil spring 548 (with respect to the longitudinal direction of the coil spring 548) is engaged. The third engaging portion 545 and the fourth engaging portion 546 are disposed on the spring mounting portion 662 so that the coil spring 548 engaged with the third engaging portion 545 and the fourth engaging portion 546 crosses the opening 757 and the opening 758.

With respect to the up-down direction, the third engaging portion 545 and the fourth wall portion 546 are disposed at different positions. In this embodiment, the third engaging portion 545 is disposed on the photosensitive drum 103 side than the fourth engaging portion 546 is. Incidentally, the third engaging portion 545 and the fourth engaging portion 546 may be provided at the substantially same height with respect to the up-down direction, and the fourth engaging portion 546 may be disposed on the photosensitive drum 103 side than the third engaging portion 545 is.

As shown in part (d) of FIG. 18, the projection 656 is inserted from an outer wall surface side of the fourth wall portion 754 into the opening 758 and passes under the coil spring 548 bridged between the third engaging portion 545 and the fourth engaging portion 546, and is inserted into the opening 757 of the third wall portion 753.

Incidentally, in this embodiment, as an example of the coil spring 547 and the coil spring 548, a coil-shaped spring is shown, but a leaf spring may also be used.

Next, action of the projection 655 provided on the link member 651 on the coil spring 547, and action of the projection 656 provided on the link member 652 on the coil spring 548 will be described using FIG. 19. The action of the projection 656 on the coil spring 548 and the action of the projection 656 on the coil spring 548 are substantially similar to each other, so that in FIG. 19, the action of the projection 655 on the coil spring 547 will be illustrated by example.

Figure 19:
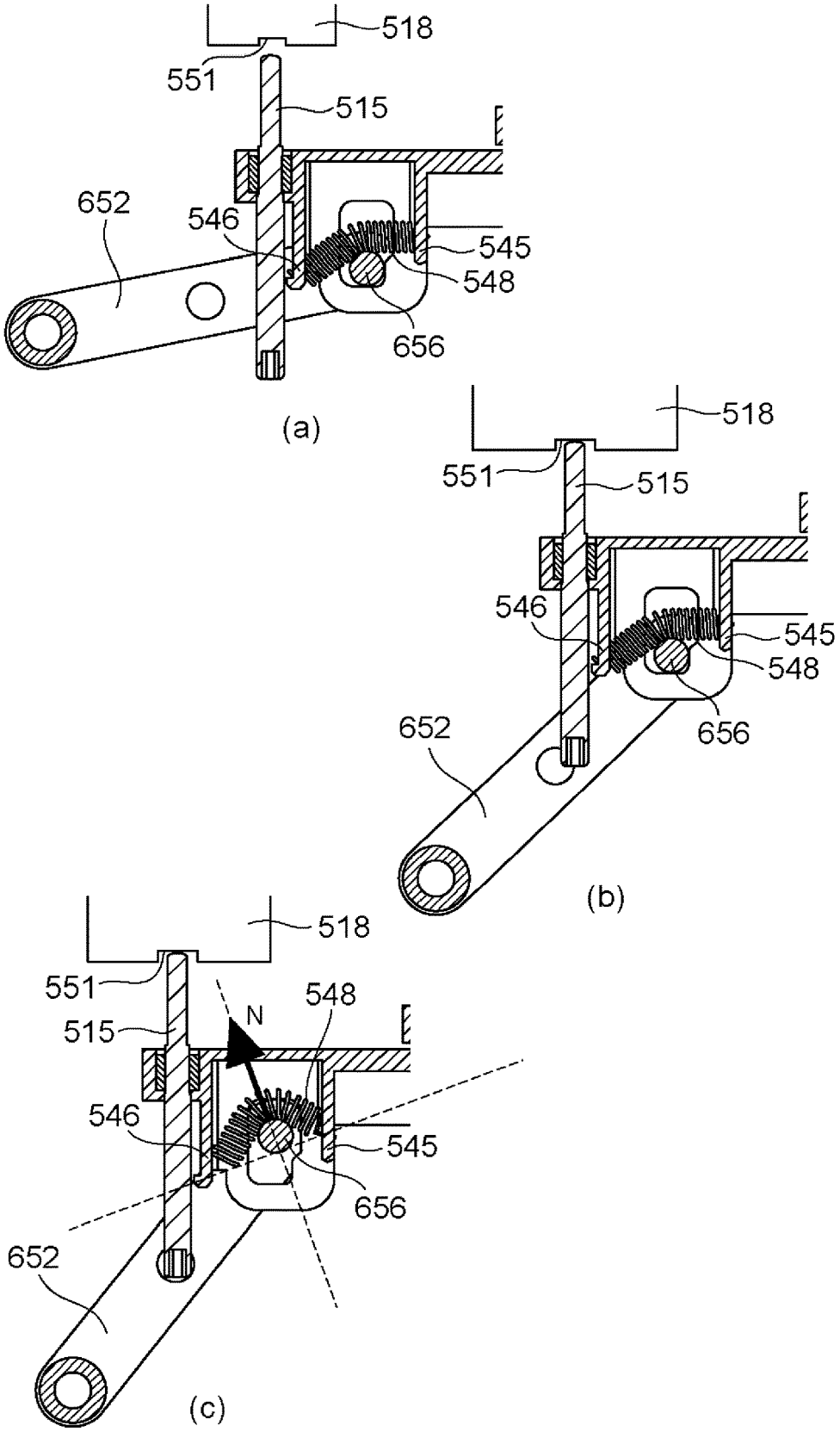
FIG. 19 includes perspective views for illustrating the structure of the holding member on both ends.

Part (a) of FIG. 19 is a view showing a state in which the contact pin 515 provided in the holding member 505 is retracted from the contact surface 551 of the drum unit 518. Part (b) of FIG. 19 is a view showing a time when the contact pin 515 contacted the contact surface 551 of the drum unit 518. Part (c) of FIG. 19 is a view showing a state in which the link member 652 is rotated counterclockwise from the state of part (b) of FIG. 19.

In the state of part (a) of FIG. 19, when the slidable portion 525 slides (moves), the link member 652 rotates counterclockwise in interrelation therewith, so that the projection 656 moves to the upper side. At this time, the projection 656 presses the coil spring 548 toward the upper side. When the projection 656 presses the coil spring 548 toward the upper side, a force acts on the holding member 505 on the upper side via the third engaging portion 545 and the fourth engaging portion 546. The contact pin 515 is out of contact with the drum unit 518. There is no force against a force, by which the projection 656 presses the coil spring 548, except for gravitation acting on the optical print head 105. For that reason, when the force acting on the third engaging portion 545 and the fourth engaging portion 546 toward the upper side becomes larger than the gravitation acting on the optical print head 105, the holding member 505 moves toward the upper side by the force acting on the third engaging portion 545 and the fourth engaging portion 546. Here, when the holding member 505 is in the retracted position, a lower end of the contact pin 515 (514) and the holding member 505 are supported by the apparatus main assembly, so that the projection 656 (655) of the link member 652 (651) may also be made out of contact with the coil spring 548 (547).

When the holding member 505 moves to the upper side, as shown in part (b) of FIG. 19, the contact pin 515 contacts the contact surface 551 of the drum unit 518. In part (b) of FIG. 19, the optical print head 105 is disposed at the exposure position, but an urging force, acting on the optical print head 105, for urging the optical print head 105 toward the drum unit 518 is insufficient. For that reason, in order to impart the above-described urging force to the optical print head 105, the moving mechanism 640 of this embodiment has a constitution in which the link member 652 is further rotatable from the state of part (b) of FIG. 19.

Even when the link member 652 further rotates counterclockwise from the state of part (b) of FIG. 19, the contact pin 515 contacts the contact surface 551 of the drum unit 518, and therefore, the position of the holding member 505 does not change. On the other hand, the projection 656 moves in the upper side direction, and therefore, the coil spring 548 is pressed between the third engaging portion 545 and the fourth engaging portion 546 by the projection 656 and is extended by being bent as shown in part (c) of FIG. 19.

The state of part (c) of FIG. 19 corresponds to states of the cover 558 in parts (c) and (d) of FIG. 15. That is, the slidable portion 525 is in a state in which the slidable portion 525 does not further slide (move) toward the upper side. For that reason, the slidable portion 525 does not slide (move), and therefore, the link member 652 does not rotate counterclockwise from the state shown in part (c) of FIG. 19, and the projection 656 is at rest in the position of part (c) of FIG. 19 without moving toward the upper side. In this state, a contracting force of the coil spring 548 acts on the third engaging portion 545 and the fourth engaging portion 546. A component of the contracting force of the coil spring 548 acting on the third engaging portion 545 and the fourth engaging portion 546 is pointed in an upper direction, and therefore, an urging force for urging the holding member 505 toward the drum unit 518 side acts on the holding member 505 so that the holding member 505 is urged toward the drum unit 518 via the contact pin 515.

As described above, the third engaging portion 545 is disposed on the photosensitive drum 103 side than the fourth engaging portion 546 is, and therefore, drag (reaction) in an arrow N direction acts on the coil spring 548 from the projection 656. A component of the drag in the arrow N direction acts on the holding member 505. For that reason, on the contact pin 515, a force toward the rear side with respect to the front-rear direction acts, so that the contact pin 515 contacted to the contact surface 551 is urged against and contacted to the rear side wall surface 596 on the rear side of the engaging portion 685. The reason why the first engaging portion 543 is disposed on the photosensitive drum 103 side than the second engaging portion 544 is also similar to the above-described reason.

Figure 24:
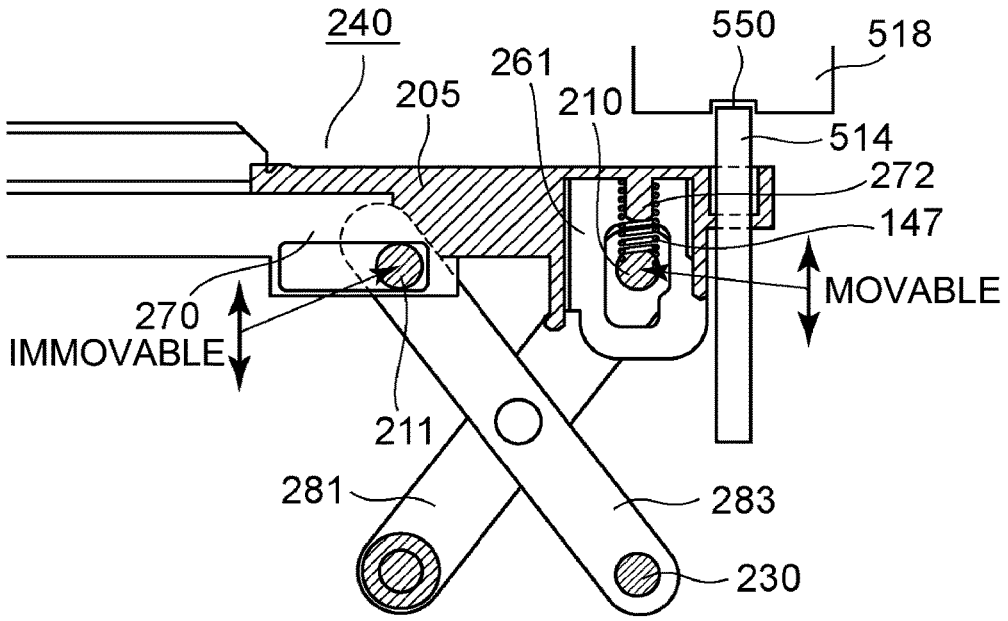
FIG. 24 includes views showing a moving mechanism in a comparison example.
Figure 24:
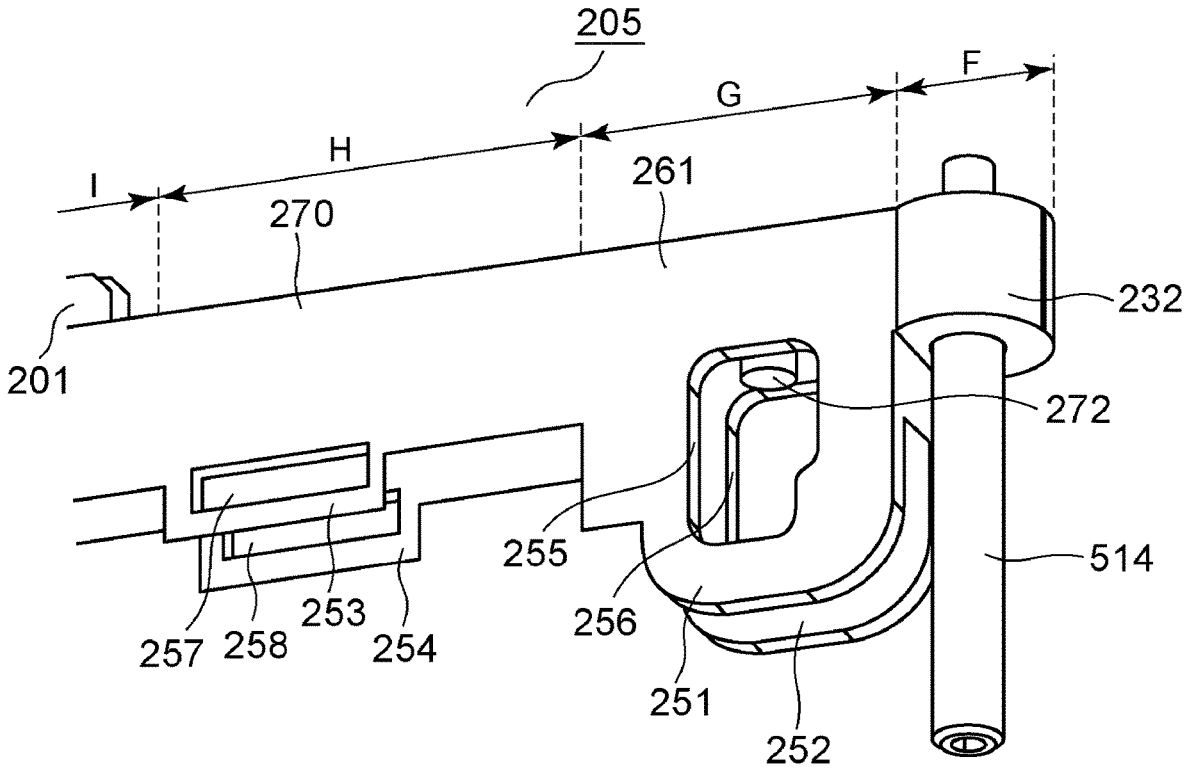

Thus, in order to impart a sufficient urging force toward the drum unit 518 to the holding member 505 by deforming the coil spring 547 and the coil spring 548, it is desirable that a constitution in which the link member 651 and the link member 652 are further rotatable from the point in time when the end portion of the contact pin 514 contacts the contact surface 550 and the end portion of the contact pin 515 contacts the contact surface 551 is employed. Parts (a) and (b) of FIG. 24 are views showing the moving mechanism 240 which is a comparison example of this embodiment. Incidentally, members having the substantially same functions as those in this embodiment will be described by adding the same symbols, and redundant description is omitted in same cases. The moving mechanism 240 shown in part (a) of FIG. 24 includes the holding member 205, the link member 281 and the link member 283, and the link member 281 and the link member 283 cross each other and are connected to each other at a crossing portion. Part (b) of FIG. 24 is a view in which from the moving mechanism 240 shown in part (a) of FIG. 24, the link member 281 and the link member 283 are not shown. The holding member 205 shown in part (b) of FIG. 24 includes the lens mounting portion 701 in which the lens array 506 is mounted, the spring mounting portion 261 in which the coil spring 147 is mounted, the spring mounting portion 262 in which the coil spring 147 is mounted, the link mounting portion 270 on which the link member 283 is mounted, the link mounting portion 271 on which the link member 284 is mounted, the pin mounting portion 232 in which the contact pin 514 is mounted, and the pin mounting portion 233 in which the contact pin 515 is mounted. Incidentally, in part (b) of FIG. 24, only the front side of the holding member 505 is shown, and therefore, the spring mounting portion 262 in which the coil spring 548 is mounted, the link mounting portion 271 on which the link member 284 is mounted, and the pin mounting portion 233 in which the contact pin 515 is mounted are not shown in the figure. With respect to the front-rear direction, the spring mounting portion 261 is disposed at one end side of the holding member 205 than the lens mounting portion 701 is, and the pin mounting portion 232 is disposed on further end portion side of the holding member 205 than the spring mounting portion 261 is. Further, with respect to the front-rear direction, the spring mounting portion 262 is disposed at the other end side of the holding member 205 than the lens mounting portion 701 is, and the pin mounting portion 232 is disposed on further end portion side of the holding member 205 than the spring mounting portion 262 is. Between the lens mounting portion 701 and the spring mounting portion 261, the link mounting portion 270 is provided. Further between the lens mounting portion 701 and the spring mounting portion 262, the link mounting portion 271 is provided.

First, the spring mounting portion 261 will be described using part (b) of FIG. 24. The spring mounting portion 261 contains the first wall portion 251, the second wall portion 252 and the engaging portion 272. Further, when portions where the lens mounting portion 201, the link mounting portion 270, the spring mounting portion 261 and the pin mounting portion 232 are formed are illustrated using part (b) of FIG. 24, the portions are portions indicated by a region I, a region H, a region G and a region F, respectively. The first wall portion 251 is disposed at one end side of the holding member 205 with respect to the left-right direction, and the second wall portion 252 is provided at the other end side of the holding member 205 with respect to the left-right direction. In this embodiment, with respect to the left-right direction, the first wall portion 251 and the second wall portion 252 are disposed on both sides of the contact pin 514. The first wall portion 251 is provided with the opening 255, and the second wall portion 252 is provided with the opening 256. The opening 255 and the opening 256 are elongated holes extending in the up-down direction. Into the opening 255 and the opening 256, as shown in part (a) of FIG. 24, the projection 210 is inserted from the left side of the holding member 205 in the order of the opening 256 and the opening 255. The projection 210 is not engaged with the opening 755 and the opening 756 and is inserted with a gap of about 0.5 mm. For that reason, the projection 210 is guided in the up-down direction in terms of the movement direction thereof by the opening 755 and the opening 756 without receiving a large frictional force from inner wall surfaces of the opening 755 and the opening 756. As shown in part (b) of FIG. 24, the engaging portion 272 is a cylindrical projection standing from an upper side toward a lower side between the first wall portion 251 and the second wall portion 252. Further, as shown in part (a) of FIG. 24, around the engaging portion 272, one end of the coil spring 547 is inserted from the lower side toward the upper side. Further, the other end side of the coil spring 547 contacts the projection 210.

Next, the link mounting portion 270 will be described using part (b) of FIG. 24. The link mounting portion 270 contains the first wall portion 253 and the second wall portion 254. The first wall portion 253 is disposed at one end side of the holding member 205 with respect to the left-right direction, and the second wall portion 254 is provided at the other end side of the holding member 205 with respect to the left-right direction. The first wall portion 253 is provided with the opening 257, and the second wall portion 254 is provided with the opening 258. The opening 257 and the opening 258 are elongated holes extending in the front-rear direction. Into the opening 257 and the opening 258, as shown in part (a) of FIG. 24, the cylindrical projection 211 standing from the left side toward the right side at the other end side of the link member 283 is inserted from the left side of the holding member 205 in the order of the opening 258 and the opening 257. The projection 211 is movable while rotating in the front-rear direction along edges of the opening 257 and the opening 258.

Part (a) of FIG. 24 is a state in which the contact pin 514 contacts the contact surface 550. In this state, when the slidable portion 525 is slid (moved) from the front side toward the rear side, the projection 202 also moves together with the slidable portion 525 from the front side toward the rear side. Simultaneously, the link member 281 rotates clockwise about a shaft center of the projection 202 as a rotation center, and the link member 283 rotates counterclockwise about a shaft center of the connecting spring portion 230 as a rotation center. The projection 211 provided at the other end side of the link member 283 moves from the front side toward the rear side along elongated hole formed in the link mounting portion 270. By the above, the projection 210 and the projection 211 move the holding member 205 from the upper side toward the lower side.

Here, a deformation aspect of the coil spring 147 in a state in which the contact pin 514 shown in FIG. 24 contacts the contact surface 550 will be considered. In the state of FIG. 24, the link member 281 cannot be rotated by further moving the slidable portion 525 toward the front side. This is because in order to further rotate the link member 281 counterclockwise, there is a need to rotate also the link member 283 clockwise, but a constitution in which the projection 211 provided at the other end side of the link member 283 is not movable in the up-down direction relative to the holding member 205 is not employed. In the state in which the contact pin 514 contacted the contact surface 550, it is impossible that the holding member 205 moves toward the upper side, and therefore, the projection 210 which cannot move in the up-down direction relative to the holding member 205 also cannot move toward the upper side. That is, the coil spring 147 is not deformed in the state in which the contact pin 514 contacted the contact surface 550.

Accordingly, there is a need that the other end side of the link member 283 is constituted so as to be in out of contact with the holding member 205 and is not prevented from rotating.

Figure 20:
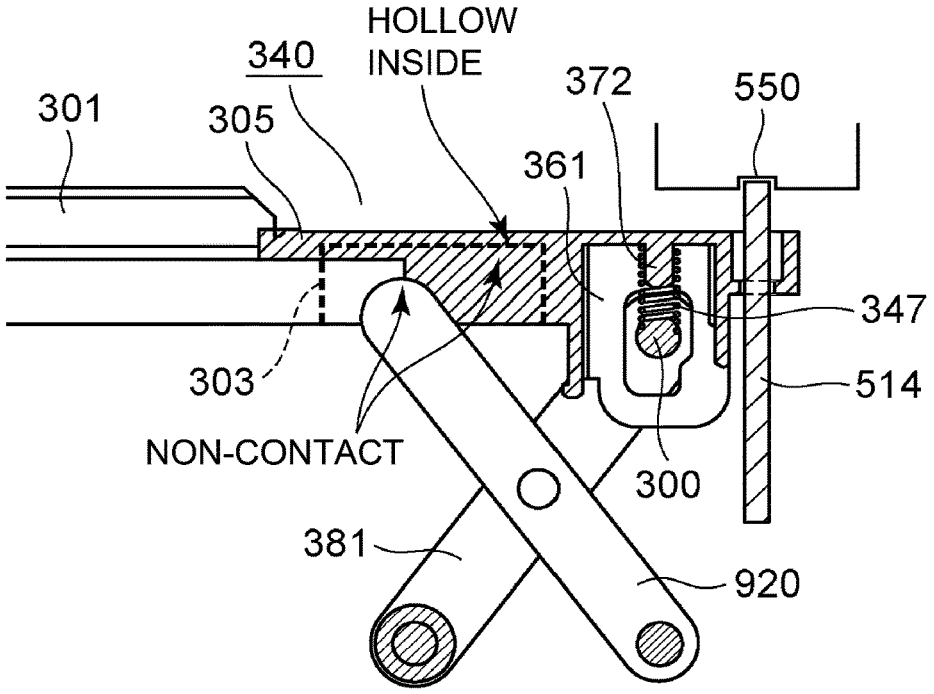
FIG. 20 includes modified embodiments of the moving mechanism.
Figure 20:
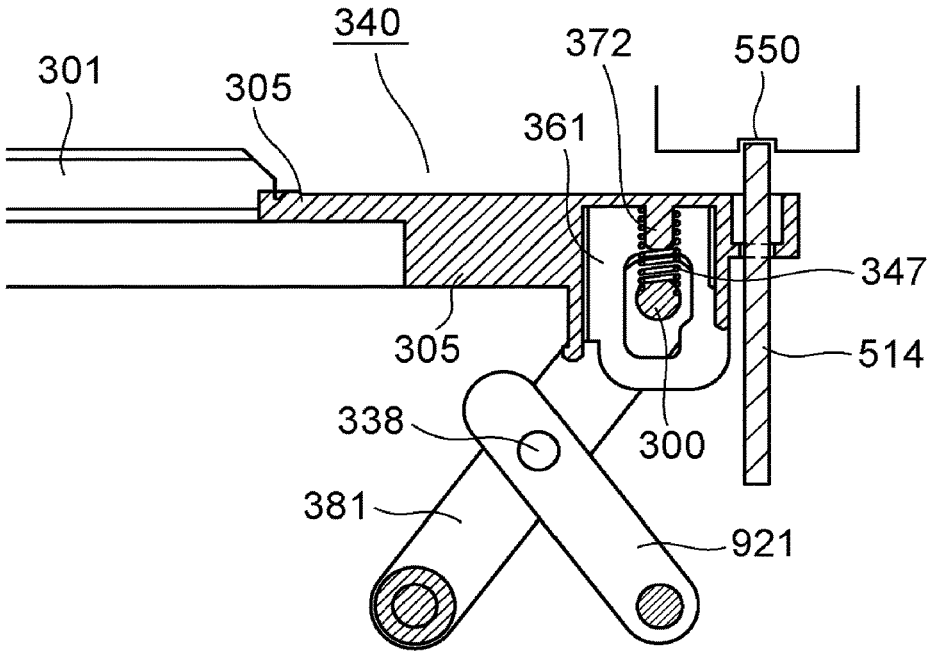

To address such a problem, the exposure unit in this embodiment has a structure in which an upper end of the rotating link member 283 is out of contact with the holding member 205. In the following, the structure will be exemplified using FIG. 20. A holding member 305 shown in part (a) of FIG. 20 is provided with a movement space 303 in which one end side of a link member 920 is movable toward the lower side on the front side and between a front end of a lens mounting portion 301 and a spring mounting portion 361. The movement space 303 is a hole formed from the lower side of the holding member 305 and is hollow portion. None of inner wall surfaces of the movement space 303 contact a portion corresponding to an upper end of the rotating link member 920. By providing the movement space 303, rotation of the link member 920 is not prevented by the holding member 305. Incidentally, from balance with a length of the link member 920 with respect to a longitudinal direction, at an upper surface portion of the holding member 305 positioned at an upper portion of the movement space 303, a structure in which a through hole penetrating in the up-down direction is provided and a gap through which the other end side of the rotating link member 920 passes may also be employed.

Further, as shown in part (b) of FIG. 20, a length of the link member 381 with respect to the longitudinal direction which is a direction connecting one end and the other end of the link member 921 may also be made short compared with the link member 381 with respect to the longitudinal direction which is a direction connecting one end and the other end of the link member 381 so that one end side of the link member 921 is in a position where the link member 921 cannot contact the holding member 305 even when the link member 921 rotates. The length of the link member 921 with respect to the longitudinal direction is sufficient if the length is such that the portion corresponding to the upper end of the rotating link member 381 is positioned between the holding member 305 and the connecting shaft portion 338 as an example of a fourth connecting portion.

Embodiment 2

Next, an embodiment 2 will be described using part (a) of FIG. 21. Incidentally, a member having the substantially same function as the moving mechanism 340 will be described by adding the same symbol, and redundant description will be omitted in some cases.

Figure 21:
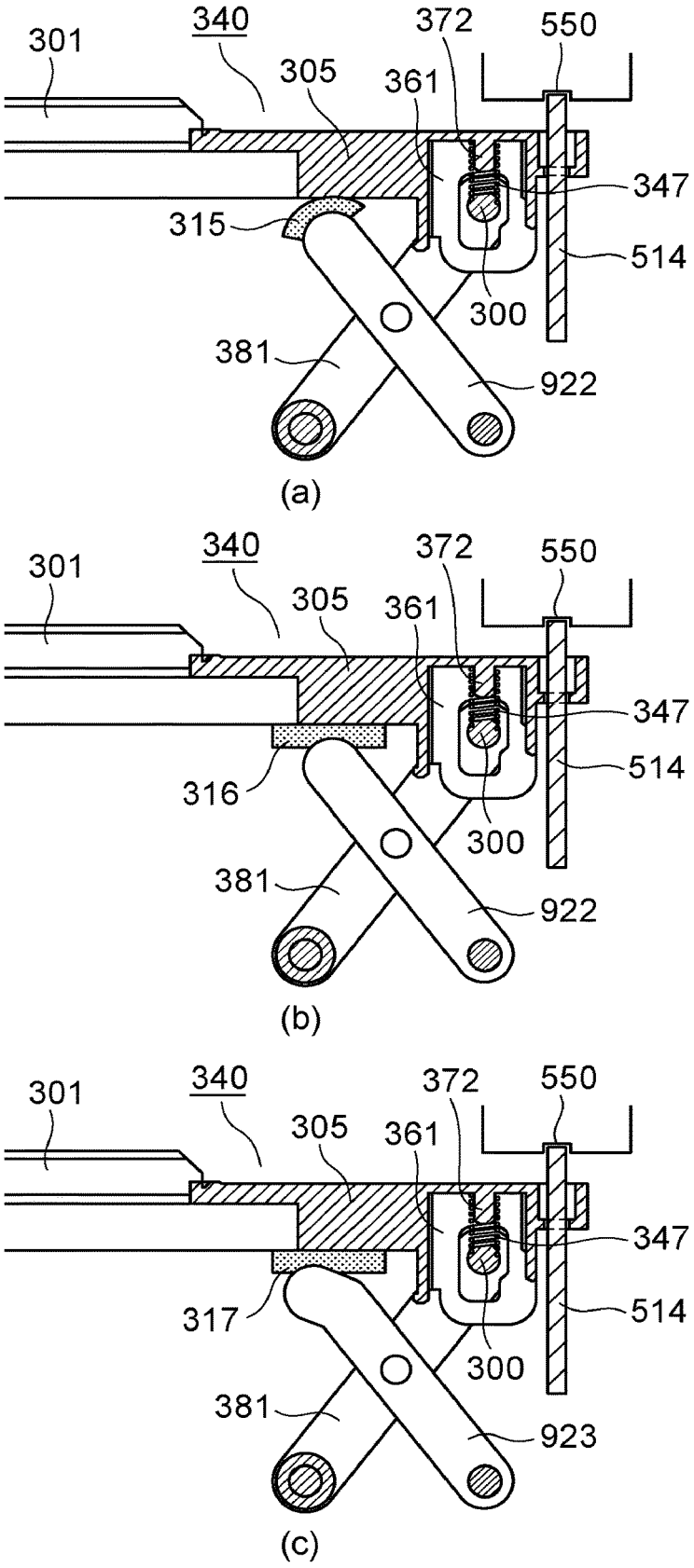
FIG. 21 includes views for illustrating moving mechanisms according to a second embodiment, a third embodiment and a fourth embodiment.

Part (a) of FIG. 21 is an example in which a portion corresponding to an upper end of a rotating link member 922 (portion corresponding to an end portion on the holding member 305 side) is provided with an elastic member 315. The elastic member 315 may only be required to be a member, having sufficient cushion property and expansion and contraction property, such as urethane, sponge or rubber, for example.

Part (a) of FIG. 21 is a state immediately after the optical print head 105 moves from the retracted position toward the exposure position and the contact pin 514 contacts the contact surface 550. Although the optical print head 105 is disposed at the exposure position, but an urging force, for urging the optical print head toward the drum unit 518, acting on the optical print head 105 is insufficient. In this embodiment, at this time, the elastic member 315 provided at the portion corresponding to the upper end of the link member 922 contacts the holding member 305.

The elastic member 315 is provided at the portion corresponding to the upper end of the link member 922, and therefore, the link member 922 is further rotatable clockwise from the state of part (a) of FIG. 21. When the link member 922 rotates clockwise, although the elastic member 315 is depressed and elastically deformed by being nipped between the corresponding to portion the upper end of the link member 922 and the holding member 305, the holding member 305 does not prevent the rotation of the link member 922. Here, even when the link member 922 rotates clockwise, the contact pin 514 and the contact pin 515 contact the contact surface 550 and the contact surface 551, and therefore, the position of the holding member 305 does not change. On the other hand, the projection 300 which is an example of a first moving portion moves in an upper side direction, and therefore, the projection 300 urges and compresses the other end of the coil spring 547 mounted on an engaging portion 372 at one end of the coil spring 547, in the upper side direction. By a restoring force of the compressed coil spring 547, the urging force for urging the holding member 305 toward the drum unit 518 side acts on the holding member 305, so that the holding member 305 is urged toward the drum unit 518 via the contact pin 514. The portion corresponding to the upper end of the link member 922 also moves in the upper side direction with the movement of the projection 300 in the upper side direction, and therefore, although the elastic member 315 positioned between the link member 922 and the holding member 305 is further depressed and elastically deformed, the holding member 305 does not prevent the movement, toward the upper side, of the portion corresponding to the upper end of the link member 922. Incidentally, in the embodiment 2, an example in which the coil spring 347 is urged by the projection 300 was described, but the first moving portion is constituted by the upper end of the link member 381, not the projection 300, and the coil spring 347 may also be urged by the upper end of the link member 381. Further, in place of the projection 300, a structure in which the upper end side of the link member 381 is bent in the rotational axis direction of the link member 381 may also be employed. The bent portion of the link member 381 is used as the first moving portion, and urges the coil spring 347.

A state in which the link member 922 further rotates clockwise from the above-described state of part (a) of FIG. 21 corresponds to the states of the cover 558 shown in parts (c) and (d) of FIG. 14 and parts (c) and (d) of FIG. 15. That is, the slidable portion 525 is in a state in which the slidable portion 525 does not further slide (move) toward the front side. The slid 525 does not slides (move), and therefore, the link member 922 does not further rotate clockwise, so that the projection 300 is at rest without moving toward the upper side.

Embodiment 3

Next, an embodiment 3 will be described using part (b) of FIG. 21. Incidentally, a member having the substantially same function as the moving mechanism 340 will be described by adding the same symbol, and redundant description will be omitted in some cases.

Part (b) of FIG. 21 is an example in which an elastic member 316 is stretched on the front side and the lower side of the holding member 305 between the front end of the lens mounting portion 301 and the spring mounting portion 361. The elastic member 316 may only be required to be a member, having sufficient cushion property and expansion and contraction property, such as urethane, sponge or rubber, for example.

Part (b) of FIG. 21 is a state immediately after the optical print head 105 moves from the retracted position toward the exposure position and the contact pin 514 contacts the contact surface 550. Although the optical print head 105 is disposed at the exposure position, but an urging force, for urging the optical print head toward the drum unit 518, acting on the optical print head 105 is insufficient. In this embodiment, at this time, the portion corresponding to the upper end of the link member 922 (portion corresponding to an end portion on the holding member 305 side) contacts the elastic member 316 stretched at a lower end of the holding member 305.

As shown in part (b) of FIG. 21, at the lower end of the holding member 305, the elastic member 316 is stretched, and therefore, the link member 922 is further rotatable clockwise from the state of part (b) of FIG. 21. When the link member 922 rotates clockwise, although the elastic member 316 is depressed and elastically deformed by being nipped between the corresponding to portion the upper end of the link member 922 and the holding member 305, the holding member 305 does not prevent the rotation of the link member 922. Here, even when the link member 922 rotates clockwise, the contact pin 514 and the contact pin 515 contact the contact surface 550 and the contact surface 551, and therefore, the position of the holding member 305 does not change. On the other hand, the projection 300 moves in an upper side direction, and therefore, the projection 300 urges and compresses the other end of the coil spring 347 mounted on an engaging portion 372 at one end of the coil spring 347, in the upper side direction. By a restoring force of the compressed coil spring 347, the urging force for urging the holding member 305 toward the drum unit 518 side acts on the holding member 305, so that the holding member 305 is urged toward the drum unit 518 via the contact pin 515. The portion corresponding to the upper end of the link member 922 also moves in the upper side direction with the movement of the projection 300 in the upper side direction, and therefore, although the elastic member 316 positioned between the link member 922 and the holding member 305 is further depressed and elastically deformed, the holding member 305 does not prevent the movement, toward the upper side, of the portion corresponding to the upper end of the link member 922.

A state in which the link member 922 further rotates clockwise from the above-described state of part (b) of FIG. 21 corresponds to the states of the cover 558 shown in parts (c) and (d) of FIG. 14 and parts (c) and (d) of FIG. 15. That is, the slidable portion 525 is in a state in which the slidable portion 525 does not further slide (move) toward the front side. The slid 525 does not slides (move), and therefore, the link member 922 does not further rotate clockwise, so that the projection 300 is at rest without moving toward the upper side.

Embodiment 4

Next, an embodiment 2 will be described using part (a) of FIG. 21. Incidentally, a member having the substantially same function as the moving mechanism 340 will be described by adding the same symbol, and redundant description will be omitted in some cases.

Part (a) of FIG. 21 is an example in which an elastic member 317 is stretched on the front side and the lower side of the holding member 305 between the front end of the lens mounting portion 301 and the spring mounting portion 361. Further, the link member 923 in this embodiment has a structure in which a portion corresponding to an upper end of a rotating link member 923 (portion corresponding to an end portion on the holding member 305 side) is flexed. The elastic member 317 may only be required to be a member, having sufficient cushion property and expansion and contraction property, such as urethane, sponge or rubber, for example.

Part (c) of FIG. 21 is a state immediately after the optical print head 105 moves from the retracted position toward the exposure position and the contact pin 514 contacts the contact surface 550. Although the optical print head 105 is disposed at the exposure position, but an urging force, for urging the optical print head toward the drum unit 518, acting on the optical print head 105 is insufficient. In this embodiment, at this time, the portion corresponding to the upper end of the link member 923 contacts the elastic member 316 stretched at a lower end of the holding member 305 and is flexed.

As shown in part (c) of FIG. 21, the elastic member 317 is stretched at the lower end of the holding member 305, and further, the portion corresponding to the upper end of the link member 923 is a flexing structure and therefore, the link member 923 is further rotatable clockwise from the state of part (c) of FIG. 21. When the link member 923 rotates clockwise, although the elastic member 317 is depressed and elastically deformed by being nipped between the corresponding to portion the upper end of the link member 923 and the holding member 305, the holding member 305 does not prevent the rotation of the link member 923. Here, even when the link member 923 rotates clockwise, the contact pin 514 and the contact pin 515 contact the contact surface 550 and the contact surface 551, and therefore, the position of the holding member 305 does not change. On the other hand, the projection 300 moves in an upper side direction, and therefore, the projection 300 urges and compresses the other end of the coil spring 347 mounted on an engaging portion 372 at one end of the coil spring 347, in the upper side direction. By a restoring force of the compressed coil spring 347, the urging force for urging the holding member 305 toward the drum unit 518 side acts on the holding member 305, so that the holding member 305 is urged toward the drum unit 518 via the contact pin 515. The portion corresponding to the upper end of the link member 923 also moves in the upper side direction with the movement of the projection 300 in the upper side direction, and therefore, the elastic member 317 positioned between the link member 923 and the holding member 305 is further depressed and elastically deformed. Further, although the other end side of the link member 923 is also further flexed, the holding member 305 does not prevent the movement, toward the upper side, of the portion corresponding to the upper end of the link member 923, so that a contact surface between the elastic member 317 and the holding member 305, and the link member 923 do not contact each other.

A state in which the link member 923 further rotates clockwise from the above-described state of part (c) of FIG. 21 corresponds to the states of the cover 558 shown in parts (c) and (d) of FIG. 14 and parts (c) and (d) of FIG. 15. That is, the slidable portion 525 is in a state in which the slidable portion 525 does not further slide (move) toward the front side. The slid 525 does not slides (move), and therefore, the link member 922 does not further rotate clockwise, so that the projection 300 is at rest without moving toward the upper side.

Modified Embodiment 1

Next, regarding the coil spring 361, and the coil spring 547 and the coil spring 548 mounted on the coil mounting portion 362, a modified example of a mounting method thereof will be described using part (a) of FIG. 22 and part (b) of FIG. 22. Incidentally, a member having the substantially same function as the moving mechanism 340 will be described by adding the same symbol, and redundant description will be omitted in some cases.

A mounting method of the coil spring 547 shown in part (a) of FIG. 22 and part (b) of FIG. 22 is similar to that in the comparison example of the moving mechanism 240 described above using FIG. 24. The holding member 305 shown in part (a) of FIG. 22 and part (b) of FIG. 22 includes the lens mounting portion 301 on which the lens array 506 is mounted, the spring mounting portion 361 in which the coil spring 347 is mounted, the spring mounting portion 362 in which the coil spring 348 is mounted, the pin mounting portion 387 in which the contact pin 514 is mounted, and the pin mounting portion 388 in which the contact pin 515 is mounted. Incidentally, in part (b) of FIG. 23, only the front side of the holding member 305 is shown, and therefore, the spring mounting portion 362 in which the coil spring 348 is mounted and the pin mounting portion 388 in which the contact pin 515 is mounted are not shown in the figure. The lens mounting portion 301, the spring mounting portion 361, the spring mounting portion 362, the pin mounting portion 387 and the pin mounting portion 388 are an integrally molded product through injection molding. With respect to the front-rear direction, the spring mounting portion 361 is disposed at one end side of the holding member 305 than the lens mounting portion 301 is, and the pin mounting portion 387 is disposed on a further end portion side of the holding member 305 than the spring mount portion 361 is. Further, with respect to the front-rear direction, the spring mounting portion 362 is disposed at the other end side of the holding member 305 than the lens mounting portion 301 is, and the pin mounting portion 388 is disposed on a further end portion side than the spring mounting portion 362 is.

Using part (b) of FIG. 22, the spring mounting portion 361 will be described. The spring mounting portion 361 includes a first wall portion 351, a second wall portion 352, and an engaging portion 372. Further, using part (b) of FIG. 22, when portions where the lens mounting portion 301, the spring mounting portion 361 and the pin mounting portion 387 are formed are shown in the figure, the portions are portions shown by the region of L, a region of K and a region of J, respectively. The first wall portion 351 is disposed at one end side of the holding member 305 with respect to the left-right direction, and the second wall portion 352 is disposed at the other end side of the holding member 305 with respect to the left-right direction. In this modified embodiment, with respect to the left-right direction, the first wall portion 351 and the second wall portion 352 are disposed on both sides of the contact pin 514. In the first wall portion 351, an opening 355 is formed, and in the first wall portion 352, an opening 356 is formed. The opening 355 and the opening 356 are elongated holes extending in the up-down direction. In the opening 355 and the opening 356, the projection 300 is inserted from the left side of the holding member 305 in the order of the opening 355 and the opening 356. The projection 300 is not engaged with the opening 355 and the opening 356, and is inserted with a gap of about 0.5 mm at a narrowest portion with respect to the front-rear direction. For that reason, a movement direction of the projection 300 is guided with respect to the up-down direction by the opening 355 and the opening 356 without receiving a large frictional force from the inner wall surfaces of the opening 355 and the opening 356. As shown in part (b) of FIG. 22, the engaging portion 372 is a cylinder-shaped projection standing from the upper side toward the lower side between the first wall portion 351 and the second wall portion 352. Further, as shown in part (a) of FIG. 22, around the engaging portion 372, one end of the coil spring 347 is inserted from the lower side toward the upper side. Further, the other end side of the coil spring 347 contacts the projection 300. That is, a contact between the other end side of the coil spring 347 and the projection 300 is positioned on the side lower than a contact portion between one end side of the coil spring 347 and the engaging portion.

Further, part (a) of FIG. 22 is a state immediately after the optical print head 105 moves from the retracted position toward the exposure position and the contact pin 514 contacts the contact surface 550. The optical print head 105 is disposed at the exposure position, but an urging force, acting on the optical print head 105, for urging the optical print head 105 toward the drum unit 518 is insufficient. For that reason, in order to impart the above-described urging force to the optical print head 105, the moving mechanism 340 of this modified embodiment has a constitution in which the link member 381 and the link member 383 are further rotatable from the state of part (b) of FIG. 22.

Even when the link member 381 further rotates counterclockwise from the state of part (b) of FIG. 22, the contact pin 514 contacts the contact surface 550 of the drum unit 518, and therefore, the position of the holding member 305 does not change. On the other hand, the projection 300 moves in the upper side direction, and therefore, the coil spring 547 is nipped and compressed between the engaging portion 372 and the projection 300.

A state in which the link member 381 rotates counterclockwise from the above-described state of part (c) of FIG. 22 corresponds to states of the cover 558 in parts (c) and (d) of FIG. 14 and parts (c) and (d) of FIG. 15. That is, the slidable portion 525 is in a state in which the slidable portion 525 does not further slide (move) toward the upper side. The slidable portion 525 does not slide (move), and therefore, the link member 381 does not rotate counterclockwise further, and also the projection 300 is at rest without moving toward the upper side. In this state, by a restoring force of the compressed coil spring 347, an urging force for urging the holding member 305 toward the drum unit 518 side acts on the holding member 305, so that the holding member 305 is urged toward the drum unit 518 via the contact pin 515.

Modified Embodiment 2

Next, regarding a mounting method of a coil spring 447 and a coil spring 448 mounted to a holding member 405, another modified example will be described using part (a) of FIG. 23 and part (b) of FIG. 23.

Figure 23:
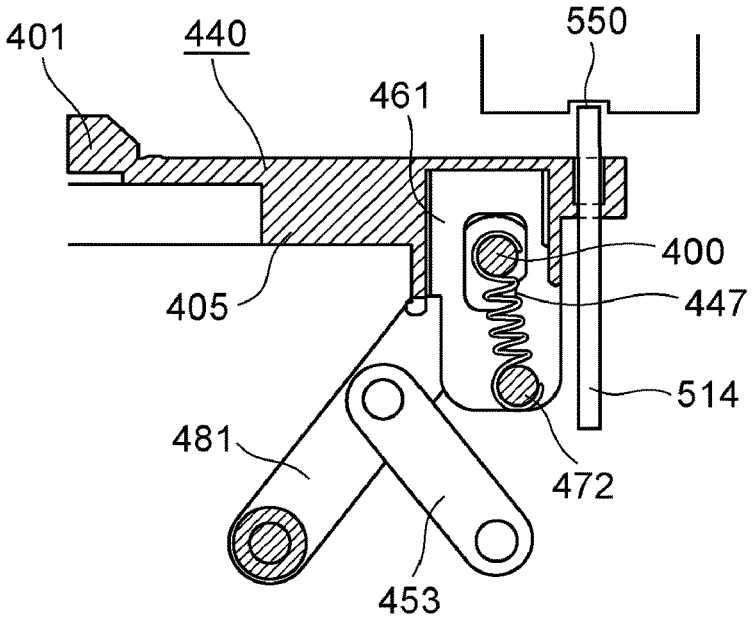
FIG. 23 includes views for illustrating a moving mechanism according to a modified embodiment 2.
Figure 23:
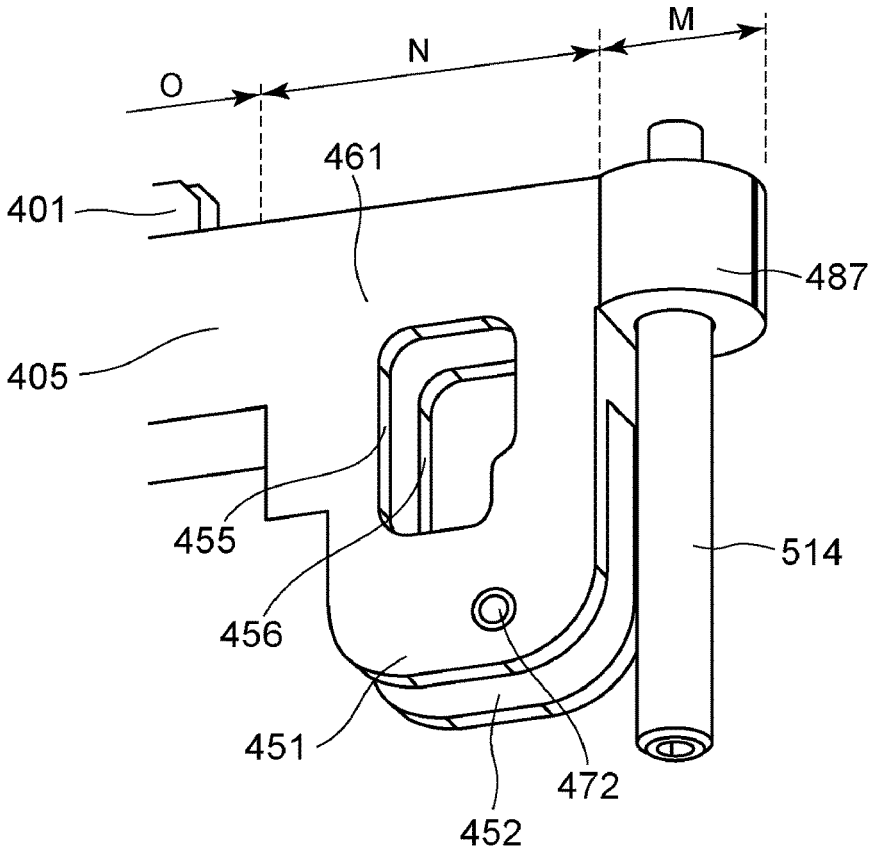

The holding member 405 shown in part (a) of FIG. 23 and part (b) of FIG. 23 includes the lens mounting portion 401 on which the lens array 506 is mounted, the spring mounting portion 461 in which the coil spring 447 is mounted, the spring mounting portion 462 in which the coil spring 448 is mounted, the pin mounting portion 487 in which the contact pin 514 is mounted, and the pin mounting portion 488 in which the contact pin 515 is mounted. Incidentally, in part (b) of FIG. 23, only the front side of the holding member 405 is shown, and therefore, the spring mounting portion 462 in which the coil spring 448 is mounted and the pin mounting portion 488 in which the contact pin 515 is mounted are not shown in the figure. The lens mounting portion 401, the spring mounting portion 461, the spring mounting portion 462, the pin mounting portion 487 and the pin mounting portion 488 are an integrally molded product through injection molding. With respect to the front-rear direction, the spring mounting portion 461 is disposed at one end side of the holding member 405 than the lens mounting portion 401 is, and the pin mounting portion 487 is disposed on a further end portion side of the holding member 405 than the spring mount portion 461 is. Further, with respect to the front-rear direction, the spring mounting portion 462 is disposed at the other end side of the holding member 405 than the lens mounting portion 401 is, and the pin mounting portion 488 is disposed on a further end portion side than the spring mounting portion 462 is.

Using part (b) of FIG. 23, the spring mounting portion 461 will be described. The spring mounting portion 461 includes a first wall portion 451, a second wall portion 452, and an engaging portion 472. Further, using part (b) of FIG. 23, when portions where the lens mounting portion 401, the spring mounting portion 461 and the pin mounting portion 487 are formed are shown in the figure, the portions are portions shown by the region of O, a region of N and a region of M, respectively. The first wall portion 451 is disposed at one end side of the holding member 405 with respect to the left-right direction, and the second wall portion 452 is disposed at the other end side of the holding member 405 with respect to the left-right direction. In this modified embodiment, with respect to the left-right direction, the first wall portion 451 and the second wall portion 452 are disposed on both sides of the contact pin 514. In the first wall portion 451, an opening 455 is formed, and in the second wall portion 452, an opening 456 is formed. The opening 455 and the opening 456 are elongated holes extending in the up-down direction. In the opening 455 and the opening 456, as shown in part (b) of FIG. 23, the projection 655 is inserted from the left side of the holding member 405 in the order of the opening 755 and the opening 756. The projection 655 is not engaged with the opening 755 and the opening 756, and is inserted with a gap of about 0.5 mm at a narrowest portion with respect to the front-rear direction. For that reason, a movement direction of the projection 400 which is an example of a second moving portion is guided with respect to the up-down direction by the opening 455 and the opening 456 without receiving a large frictional force from the inner wall surfaces of the opening 455 and the opening 456. As shown in part (b) of FIG. 23, the engaging portion 472 is inserted from a hole provided in the first wall portion 451 toward the second wall portion 452 on the lower side of the opening 455 of the first wall portion 451 and the opening 456 of the second wall portion 452, and is fixed to the first wall portion 451. As shown in part (a) of FIG. 23, between the first wall portion 451 and the second wall portion 452, the other end of the coil spring 447 is hung on the engaging portion 472. Further, one end side of the coil spring 447 is rotatably connected to the projection 400. That is, a contact between the other end side of the coil spring 447 and the projection 400 is positioned on the side upper than a contact portion between one end side of the coil spring 447 and the engaging portion 472.

Further, part (a) of FIG. 23 is a state immediately after the optical print head 105 moves from the retracted position toward the exposure position and the contact pin 514 contacts the contact surface 550. The optical print head 105 is disposed at the exposure position, but an urging force, acting on the optical print head 105, for urging the optical print head 105 toward the drum unit 518 is insufficient. For that reason, in order to impart the above-described urging force to the optical print head 105, the moving mechanism 440 of this modified embodiment has a constitution in which the link member 481 is further rotatable from the state of part (b) of FIG. 23.

Even when the link member 481 further rotates counterclockwise from the state of part (b) of FIG. 23, the contact pin 514 contacts the contact surface 550 of the drum unit 518, and therefore, the position of the holding member 405 does not change. On the other hand, the projection 400 moves in the upper side direction, and therefore, the coil spring 447 is expanded by between the engaging portion 472 and the projection 400.

A state in which the link member 481 rotates counterclockwise from the above-described state of part (c) of FIG. 23 corresponds to states of the cover 558 in parts (c) and (d) of FIG. 14 and parts (c) and (d) of FIG. 15. That is, the slidable portion 525 is in a state in which the slidable portion 525 does not further slide (move) toward the upper side. The slidable portion 525 does not slide (move), and therefore, the link member 481 does not rotate counterclockwise further, and also the projection 400 is at rest without moving toward the upper side. In this state, by a restoring force of the expanded coil spring 447, an urging force for urging the holding member 405 toward the drum unit 518 side acts on the holding member 405, so that the holding member 405 is urged toward the drum unit 518 via the contact pin 514.

Here, the coil spring 447 may also have a structure in which the coil spring 447 is directly expanded by the upper end portion of the link member 481, not the projection 400, i.e., the first moving portion may also be the upper end portion of the link member 481.

As described above, in the image forming apparatus 1 according to the above-described embodiments and modified embodiments, rotation of the link member 483 rotating for moving the optical print head 105 from the retracted position toward the exposure position is not prevented by the holding member 405, and therefore, the coil spring 447 contacting the link member 481 and the holding member 405 can be deformed, so that the urging force for urging the optical print head 105 toward the drum unit 518 can be obtained.

INDUSTRIAL APPLICABILITY

According to the present invention, there is provided the image forming apparatus including the moving mechanism for contacting and urging the optical print head from the position retracted from the exchange unit including the photosensitive drum toward the exchange unit by moving the optical print head.

The invention claimed is:

1. An image forming apparatus comprising:

a rotatable photosensitive drum;

an optical print head for exposing said photosensitive drum to light; and a moving unit for moving said optical print head from a retracted position retracted from said photosensitive drum toward an exposure position closer to said photosensitive drum than the retracted position and where said photosensitive drum is exposed, said moving unit including:

a slidable portion slidable along a rotational axis direction of said photosensitive drum;

a first link portion provided with a first connecting portion rotatably connected to said slidable portion at one end side and provided with a first moving portion rotatably connected to said optical print head at the other end side for moving said optical print head, said first connecting portion having a rotation shaft;

a second link portion provided with a second connecting portion rotatably connected to said slidable portion at one end side and provided with a second moving portion rotatably connected to said optical print head at the other end side for moving said optical print head, said second connecting portion having a rotation shaft; and a third link portion which is rotatably connected to said first link portion at a position between said first connecting portion and said first moving portion so that said first moving portion and said second moving portion are moved toward said photosensitive drum by rotation of said first link portion about the rotation shaft of said first connecting portion and by rotation of said second link portion about the rotation shaft of said second connecting portion in interrelation with the slide of said slidable portion, said third link portion being rotatable relative to an apparatus main assembly, wherein said third link portion includes a portion which corresponds to an end portion on said optical print head side and which is out of contact with said optical print head.

2. An image forming apparatus according to claim 1, wherein one end side of said third link portion forms a third connecting portion by being connected to said apparatus main assembly and the other end side of said third link portion forms a fourth connecting portion by being connected to said first link portion, and wherein a length of said third link portion in a direction connecting said third connecting portion and said fourth connecting portion is shorter than a length of said first link portion in a direction connecting said first connecting portion and said second connecting portion.

3. An image forming apparatus according to claim 2, wherein a distance between a rotation center of said first connecting portion and a rotation center of said fourth connecting portion, a distance between a rotation center of said first moving portion and the rotation center of said fourth connecting portion, and a distance between a rotation center of said third connecting portion and the rotation center of said fourth connecting portion are all equal to each other.

4. An image forming apparatus according to claim 1, further comprising:

a first spring provided at one end side of said optical print head with respect to the rotational axis direction for imparting, to said optical print head, an urging force for urging said optical print head toward said photosensitive drum; and a second spring provided at the other end side of said optical print head with respect to the rotational axis direction for imparting, to said optical print head, an urging force for urging said optical print head toward said photosensitive drum, wherein said first moving portion deforms said first spring in contact with said first spring and said second moving portion deforms said second spring in contact with said second spring.

5. An image forming apparatus according to claim 4, further comprising:

a pair of first mounting portions which are formed on the one end side of said optical print head with respect to the rotational axis direction and to which each of one end side and the other end side of said first spring with respect to a longitudinal direction of said first spring is mounted; and a pair of second mounting portions which are formed on the other end side of said optical print head with respect to the rotational axis direction and to which each of one end side and the other end side of said second spring with respect to a longitudinal direction of said second spring is mounted, wherein said first moving portion is mounted in said pair of first mounting portions and said first link portion is rotatably connected to said slidable portion and said optical print head so that said first moving portion contacts said first spring between the one end side and the other end side of said first spring with respect to the longitudinal direction of said first spring, said first moving portion contacting said first spring on a side of said first spring opposite from a side where said photosensitive drum is disposed relative to said first spring, wherein said second moving portion is mounted in said pair of first mounting portions and said second link portion is rotatably connected to said slidable portion and said optical print head so that said second moving portion contacts said second spring between the one end side and the other end side of said second spring with respect to the longitudinal direction of said second spring, said second moving portion contacting said second spring on a side of said second spring opposite from a side where said photosensitive drum is disposed relative to said second spring, and wherein said slidable portion slides in a state in which said optical print head contacts said photosensitive drum, and said first moving portion elongates said first spring toward said photosensitive drum in interrelation with the slide and said second moving portion elongates said second spring toward said photosensitive drum in interrelation with the slide, and the urging forces are imparted to said optical print head by action of a restoring force of each of said first spring and said second spring which are elongated.

6. An image forming apparatus according to claim 5, wherein said first moving portion formed at one end side of said first link portion with respect to a longitudinal direction of said first link portion is a projection projecting in a rotational axis direction of said first link portion rotating relative to said optical print head, and wherein said second moving portion formed at one end side of said second link portion with respect to a longitudinal direction of said second link portion is a projection projecting in a rotational axis direction of said second link portion rotating relative to said optical print head.

7. An image forming apparatus comprising:

a rotatable photosensitive drum;

an optical print head for exposing said photosensitive drum to light; and a moving unit moving said optical print head from a retracted position retracted from said photosensitive drum toward an exposure position closer to said photosensitive drum than the retracted position and where said photosensitive drum is exposed, said moving unit including:

a slidable portion slidable along a rotational axis direction of said photosensitive drum;

a first link portion provided with a first connecting portion rotatably connected to said slidable portion at one end side and provided with a first moving portion rotatably connected to said optical print head at the other end side for moving said optical print head, said first connecting portion having a rotation shaft;

a second link portion provided with a second connecting portion rotatably connected to said slidable portion at one end side and provided with a second moving portion rotatably connected to said optical print head at the other end side for moving said optical print head, said second connecting portion having a rotation shaft;

a third link portion which is rotatably connected to said first link portion at a position between said first connecting portion and said first moving portion so that said first moving portion and said second moving portion are moved toward said photosensitive drum by rotation of said first link portion about the rotation shaft of said first connecting portion and by rotation of said second link portion about the rotation shaft of said second connecting portion in interrelation with the slide of said slidable portion, said third link portion being rotatable relative to an apparatus main assembly and having a third connecting portion connecting said third link portion and said apparatus main assembly; and a fourth connecting portion connecting said third link portion and said first link portion, said fourth connecting portion being shorter than a length of said first link portion in a direction connecting said first connecting portion and said first moving portion, wherein a rotatable portion of said third link portion corresponds to an end portion on said optical print head side and is positioned between said optical print head and said fourth connecting portion.

8. An image forming apparatus according to claim 7, wherein one end side of said third link portion forms said third connecting portion by being connected to said apparatus main assembly and the other end side of said third link portion forms said fourth connecting portion by being connected to said first link portion, and wherein a length of said third link portion in a direction connecting said third connecting portion and said fourth connecting portion is shorter than a length of said first link portion in a direction connecting said first connecting portion and said second connecting portion.

9. An image forming apparatus according to claim 8, wherein a distance between a rotation center of said first connecting portion and a rotation center of said fourth connecting portion, a distance between a rotation center of said first moving portion and the rotation center of said fourth connecting portion, and a distance between a rotation center of said third connecting portion and the rotation center of said fourth connecting portion are all equal to each other.

10. An image forming apparatus according to claim 7, further comprising:

a first spring provided at one end side of said optical print head with respect to the rotational axis direction for imparting, to said optical print head, an urging force for urging said optical print head toward said photosensitive drum; and a second spring provided at the other end side of said optical print head with respect to the rotational axis direction for imparting, to said optical print head, an urging force for urging said optical print head toward said photosensitive drum, wherein said first moving portion deforms said first spring in contact with said first spring and said second moving portion deforms said second spring in contact with said second spring.

11. An image forming apparatus according to claim 10, further comprising:

a pair of first mounting portions which are formed on the one end side of said optical print head with respect to the rotational axis direction and to which each of one end side and the other end side of said first spring with respect to a longitudinal direction of said first spring is mounted; and a pair of second mounting portions which are formed on the other end side of said optical print head with respect to the rotational axis direction and to which each of one end side and the other end side of said second spring with respect to a longitudinal direction of said second spring is mounted, wherein said first moving portion is mounted in said pair of first mounting portions and said first link portion is rotatably connected to said slidable portion and said optical print head so that said first moving portion contacts said first spring between the one end side and the other end side of said first spring with respect to the longitudinal direction of said first spring, said first moving portion contacting said first spring on a side of said first spring opposite from a side where said photosensitive drum is disposed relative to said first spring, wherein said second moving portion is mounted in said pair of first mounting portions and said second link portion is rotatably connected to said slidable portion and said optical print head so that said second moving portion contacts said second spring between the one end side and the other end side of said second spring with respect to the longitudinal direction of said second spring, said second moving portion contacting said second spring on a side of said second spring opposite from a side where said photosensitive drum is disposed relative to said second spring, and wherein said slidable portion slides in a state in which said optical print head contacts said photosensitive drum, and said first moving portion elongates said first spring toward said photosensitive drum in interrelation with the slide and said second moving portion elongates said second spring toward said photosensitive drum in interrelation with the slide, and the urging forces are imparted to said optical print head by action of a restoring force of each of said first spring and said second spring which are elongated.

12. An image forming apparatus according to claim 11, wherein said first moving portion formed at one end side of said first link portion with respect to a longitudinal direction of said first link portion is a projection projecting in a rotational axis direction of said first link portion rotating relative to said optical print head, and wherein said second moving portion formed at one end side of said second link portion with respect to a longitudinal direction of said second link portion is a projection projecting in a rotational axis direction of said second link portion rotating relative to said optical print head.

13. An image forming apparatus comprising:

a rotatable photosensitive drum;

an optical print head for exposing said photosensitive drum to light; and a moving unit for moving said optical print head from a retracted position retracted from said photosensitive drum toward an exposure position closer to said photosensitive drum than the retracted position and where said photosensitive drum is exposed, said moving unit including:

a slidable portion slidable along a rotational axis direction of said photosensitive drum;

a first link portion provided with a first connecting portion rotatably connected to said slidable portion at one end side and provided with a first moving portion rotatably connected to said optical print head at the other end side for moving said optical print head, said first connecting portion having a rotation shaft;

a second link portion provided with a second connecting portion rotatably connected to said slidable portion at one end side and provided with a second moving portion rotatably connected to said optical print head at the other end side for moving said optical print head, said second connecting portion having a rotation shaft;

a third link portion which is rotatably connected to said first link portion at a position between said first connecting portion and said first moving portion so that said first moving portion and said second moving portion are moved toward said photosensitive drum by rotation of said first link portion about the rotation shaft of said first connecting portion and by rotation of said second link portion about the rotation shaft of said second connecting portion in interrelation with the slide of said slidable portion, said third link portion being rotatable relative to an apparatus main assembly; and an elastic member provided at an end portion of said third link portion on which said optical print head is located, wherein said elastic member is elastically deformable by being sandwiched by said optical print head and said third link portion in a state in which said optical print head is positioned at the exposure position.

14. An image forming apparatus according to claim 13, wherein one end side of said third link portion forms a third connecting portion by being connected to said apparatus main assembly and the other end side of said third link portion forms a fourth connecting portion by being connected to said first link portion, and wherein a length of said third link portion in a direction connecting said third connecting portion and said fourth connecting portion is shorter than a length of said first link portion in a direction connecting said first connecting portion and said second connecting portion.

15. An image forming apparatus according to claim 14, wherein a distance between a rotation center of said first connecting portion and a rotation center of said fourth connecting portion, a distance between a rotation center of said first moving portion and the rotation center of said fourth connecting portion, and a distance between a rotation center of said third connecting portion and the rotation center of said fourth connecting portion are all equal to each other.

16. An image forming apparatus according to claim 13, further comprising:

a first spring, provided at one end side of said optical print head with respect to the rotational axis direction, for imparting, to said optical print head, an urging force for urging said optical print head toward said photosensitive drum; and a second spring, provided at the other end side of said optical print head with respect to the rotational axis direction, for imparting, to said optical print head, an urging force for urging said optical print head toward said photosensitive drum, wherein said first moving portion deforms said first spring in contact with said first spring and said second moving portion deforms said second spring in contact with said second spring.

17. An image forming apparatus according to claim 16, comprising, a pair of first mounting portions which are formed on the one end side of said optical print head with respect to the rotational axis direction and to which each of one end side and the other end side of said first spring with respect to a longitudinal direction of said first spring is mounted; and a pair of second mounting portions which are formed on the other end side of said optical print head with respect to the rotational axis direction and to which each of one end side and the other end side of said second spring with respect to a longitudinal direction of said second spring is mounted, wherein said first moving portion is mounted in said pair of first mounting portions and said first link portion is rotatably connected to said slidable portion and said optical print head so that said first moving portion contacts said first spring between the one end side and the other end side of said first spring with respect to the longitudinal direction of said first spring, said first moving portion contacting said first spring on a side of said first spring opposite from a side where said photosensitive drum is disposed relative to said first spring, wherein said second moving portion is mounted in said pair of first mounting portions and said second link portion is rotatably connected to said slidable portion and said optical print head so that said second moving portion contacts said second spring between the one end side and the other end side of said second spring with respect to the longitudinal direction of said second spring, said second moving portion contacting said second spring on a side of said second spring opposite from a side where said photosensitive drum is disposed relative to said second spring, and wherein said slidable portion slides in a state in which said optical print head contacts said photosensitive drum, and said first moving portion elongates said first spring toward said photosensitive drum in interrelation with the slide and said second moving portion elongates said second spring toward said photosensitive drum in interrelation with the slide, and the urging forces are imparted to said optical print head by action of a restoring force of each of said first spring and said second spring which are elongated.

18. An image forming apparatus according to claim 17, wherein said first moving portion formed at one end side of said first link portion with respect to a longitudinal direction of said first link portion is a projection projecting in a rotational axis direction of said first link portion rotating relative to said optical print head, and wherein said second moving portion formed at one end side of said second link portion with respect to a longitudinal direction of said second link portion is a projection projecting in a rotational axis direction of said second link portion rotating relative to said optical print head.

19. An image forming apparatus comprising:

a rotatable photosensitive drum;

an optical print head for exposing said photosensitive drum to light; and a moving unit for moving said optical print head from a retracted position retracted from said photosensitive drum toward an exposure position closer to said photosensitive drum than the retracted position and where said photosensitive drum is exposed, said moving unit including:

a slidable portion slidable along a rotational axis direction of said photosensitive drum;

a first link portion provided with a first connecting portion rotatably connected to said slidable portion at one end side and provided with a first moving portion rotatably connected to said optical print head at the other end side for moving said optical print head, said first connecting portion having a rotation shaft;

a second link portion provided with a second connecting portion rotatably connected to said slidable portion at one end side and provided with a second moving portion rotatably connected to said optical print head at the other end side for moving said optical print head, said second connecting portion having a rotation shaft;

a third link portion which is rotatably connected to said first link portion at a position between said first connecting portion and said first moving portion so that said first moving portion and said second moving portion are moved toward said photosensitive drum by rotation of said first link portion about the rotation shaft of said first connecting portion and by rotation of said second link portion about the rotation shaft of said second connecting portion in interrelation with slide of said slidable portion, said third link portion being rotatable relative to an image forming apparatus main assembly; and an elastic member provided at one end side of said optical print head with respect to the rotational axis direction, said elastic member is elastically deformable by being sandwiched by said optical print head and an end portion of said third link portion on which said optical print head is located in a state in which said optical print head is positioned at the exposure position.

20. An image forming apparatus according to claim 19, further comprising:

a first spring, provided at one end side of said optical print head with respect to the rotational axis direction, for imparting, to said optical print head, an urging force for urging said optical print head toward said photosensitive drum; and a second spring, provided at the other end side of said optical print head with respect to the rotational axis direction, for imparting, to said optical print head, an urging force for urging said optical print head toward said photosensitive drum, wherein said first moving portion deforms said first spring in contact with said first spring and said second moving portion deforms said second spring in contact with said second spring.

* * * * *